US007055432B2

(12) United States Patent
Kan et al.

(10) Patent No.: US 7,055,432 B2
(45) Date of Patent: Jun. 6, 2006

(54) APPARATUS AND METHOD FOR CONVEYING MATERIAL TO AN IMAGING DRUM

(75) Inventors: Kazuma Kan, Kyoto (JP); Ryuuzo Tokimasa, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/940,684

(22) Filed: Sep. 15, 2004

(65) Prior Publication Data

US 2005/0028699 A1 Feb. 10, 2005

Related U.S. Application Data

(62) Division of application No. 10/388,651, filed on Mar. 17, 2003, now Pat. No. 6,792,861.

(30) Foreign Application Priority Data

Mar. 26, 2002 (JP) ..... P2002-086151

(51) Int. Cl.
*B41F 21/00* (2006.01)
*B65H 5/04* (2006.01)

(52) U.S. Cl. ..... 101/477; 101/401.1; 271/3.03; 271/225; 271/275

(58) Field of Classification Search ..... 101/477, 101/401.1, 382.1, 389.1; 271/3.01, 3.03, 271/225, 275, 902; 347/264, 262
See application file for complete search history.

(56) References Cited

U.S. PATENT DOCUMENTS

| | | | |
|---|---|---|---|
| 6,295,929 | B1 | 10/2001 | Tice et al. |
| 6,675,712 | B1 | 1/2004 | Marincic et al. |
| 6,712,003 | B1 | 3/2004 | Hashiguchi |

FOREIGN PATENT DOCUMENTS

| | | |
|---|---|---|
| JP | 2000-56467 | 2/2000 |
| JP | 2001-113849 | 4/2001 |

*Primary Examiner*—Leslie J. Evanisko
(74) *Attorney, Agent, or Firm*—McDermott Will & Emery LLP

(57) ABSTRACT

An image recorder of an external drum type includes a feed/discharge unit located above a drum and having an upper tray and a lower tray. The upper tray is inclined so that an edge thereof on the front side of an image recorder body is downward or at a lower level. For placing a plate on the upper tray, the plate is fed over the lower edge of the tray onto the tray. The upper tray has a movable suction pad for raising the plate. The image recorder of the external drum type can easily feed a large-size image recording material or plate over an upper edge of the inclined tray onto the tray.

7 Claims, 44 Drawing Sheets

MICROSWITCH (OFF)

MICROSWITCH (ON)

APPARATUS AND METHOD FOR CONVEYING MATERIAL TO AN IMAGING DRUM

This application is a divisional of U.S. application Ser. No. 10/388,651, filed Mar. 17, 2003, now U.S. Pat. No. 6,792,861.

BACKGROUND OF THE INVENTION

1. Field of the Invention

The present invention relates to an image recorder for directing an optical beam onto an image recording material such as a plate mounted on a drum to record an image on the image recording material.

2. Description of the Background Art

Conventionally, there is known an image recorder which comprises a cylindrical drum for mounting an image recording material on the outer peripheral surface thereof, a rotative drive mechanism for rotating the drum about a rotary shaft disposed along the axis of the drum, and a recording head for directing an optical beam modulated in accordance with an image signal onto the image recording material. Such an image recorder is adapted to record a desired image on the image recording material by directing the optical beam from the recording head onto the image recording material mounted on the outer peripheral surface of the drum being rotated at high speeds and by moving the recording head in a direction parallel to the rotary shaft of the drum.

For example, an image recorder disclosed in Japanese Patent Application Laid-Open No. 2000-56467 is designed such that for the purpose of feeding an image recording material to a drum, the image recording material is temporarily placed on a tray angularly disposed on the drum, and is then fed out of the tray toward the surface of the drum. The image recording material is placed onto the angularly disposed tray from above the upper edge of the tray.

When a small-size image recording material is used, the above-mentioned technique can be employed to place the image recording material on the tray. However, the use of a large-size image recording material entails an accordingly large-size tray, making it difficult to feed the image recording material from above the upper edge of the angularly disposed tray onto the tray.

SUMMARY OF THE INVENTION

The present invention is intended for a technique relating to an image recorder for directing an optical beam onto an image recording material such as a plate mounted on a drum to record an image on the image recording material.

According to the present invention, the image recorder having a front surface and a rear surface comprises: an exposure unit for performing an image formation process on an image recording material mounted on an outer surface of a recording drum; and an image recording material feed unit located above the recording drum for feeding the image recording material to the recording drum, the image recording material feed unit including a tray having a front edge on the front surface side and a rear edge on the rear surface side and located angularly so that the front edge is below the rear edge, a guide member for guiding the image recording material fed from the front surface side to near the front edge of the tray, and a raising member for holding the image recording material guided by the guide member to the tray to raise the image recording material until the image recording material is received throughout its length on the tray. This facilitates the operation of placing the image recording material on the tray.

Preferably, the raising member comprises: a suction pad; and a moving element for moving the suction pad along the tray. The suction pad achieves satisfactory holding of the image recording material.

Preferably, the raising member further comprises a lifting mechanism for moving the suction pad upwardly and downwardly with respect to an upper surface of the tray. The suction pad, which is moved upwardly and downwardly by the lifting mechanism, can provide increased flexibility of the vacuum-holding location of the image recording material fed from the guide member.

It is therefore an object of the present invention to provide an image recorder capable of easily feeding an image recording material onto an inclined tray even when the image recording material is large in size.

These and other objects, features, aspects and advantages of the present invention will become more apparent from the following detailed description of the present invention when taken in conjunction with the accompanying drawings.

DESCRIPTION OF THE PREFERRED EMBODIMENTS (Overall Construction)

Figure 1:
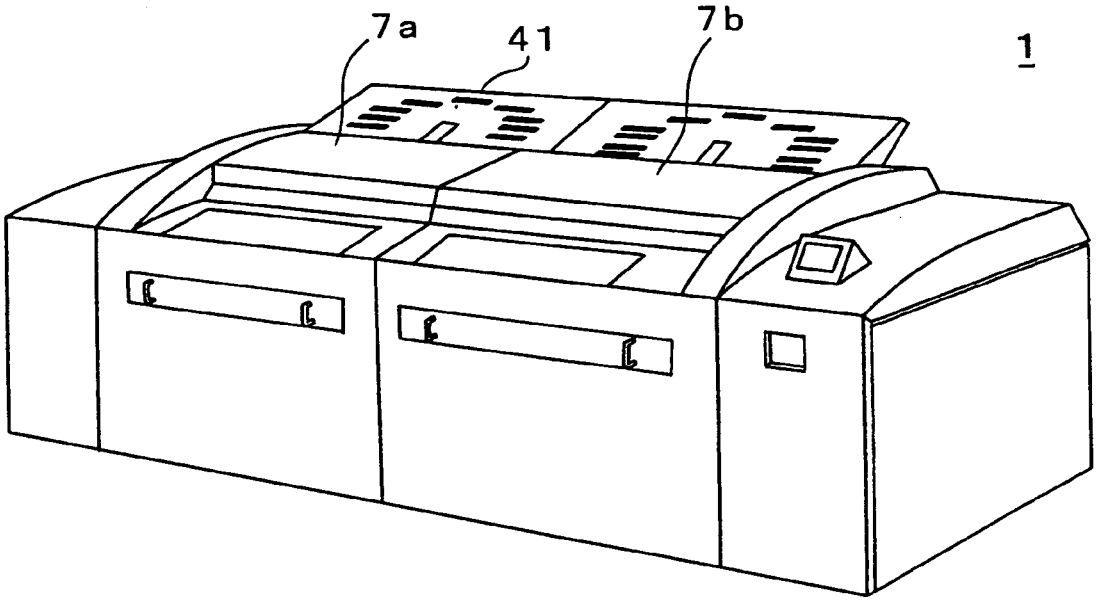
FIGS. 1 and 2 are perspective views of an image recorder according to a preferred embodiment of the present invention.
Figure 2:
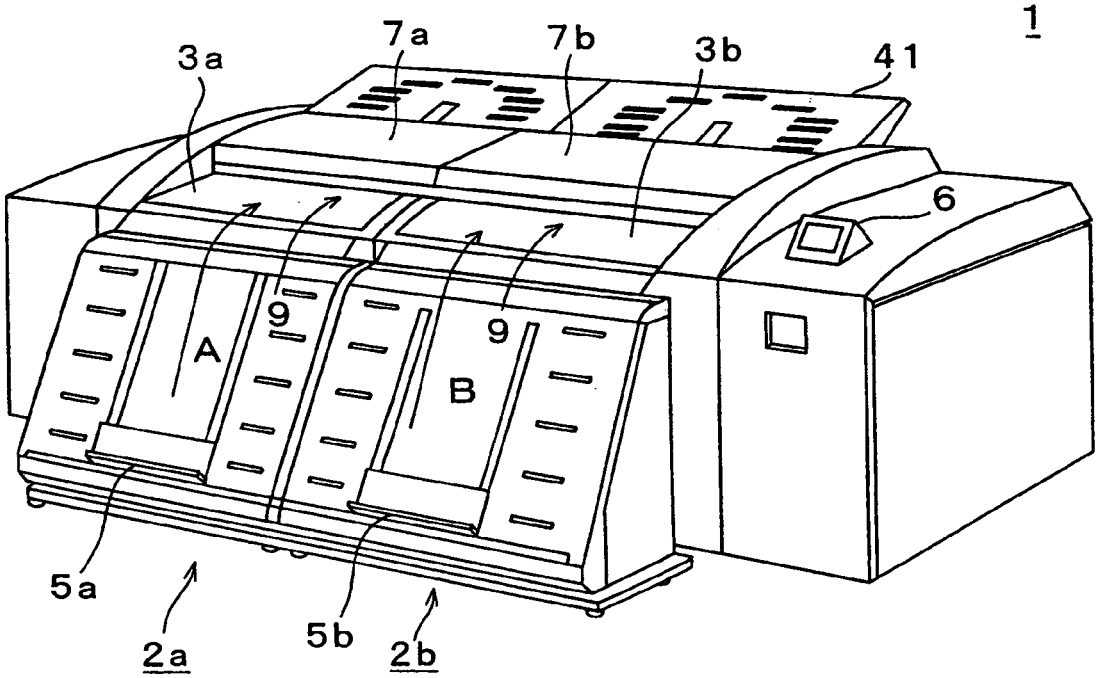

A preferred embodiment according to the present invention will now be described with reference to the drawings. FIGS. 1 and 2 are perspective views showing the external appearance of an image recorder 1 to which the present invention is applied. FIG. 2 shows the image recorder 1 of FIG. 1, with set tables 2*a*, 2*b* and plate guides 3*a*, 3*b* attached thereto for use as auxiliary equipment for loading the image recorder 1 with a plate serving as an image recording material. The set tables 2*a*, 2*b* and the plate guides 3*a*, 3*b* are attachable to and detachable from the image recorder 1. A plate, as that term is used herein, includes a printing plate on which an image will be recorded by irradiation from a beam source such as a laser light source.

A virgin plate P (that is, a plate which is not recorded yet) (not shown) is prepared in an inclined position on the set tables 2*a*, 2*b*. The set tables 2*a*, 2*b* have respective holding members 5*a*, 5*b* which hold the lower edge of the plate P. The vertical location of the holding members 5*a*, 5*b* is adjustable, and this location adjustment allows plates P of a variety of sizes to be set on the set tables 2*a*, 2*b*.

Each of the two set tables 2*a*, 2*b* is capable of setting thereon a single small-size plate P. Otherwise, both of the two set tables 2*a*, 2*b* may be used together to set a single large-size plate P thereon.

A control panel 6 is provided on the front surface of the image recorder 1. An operator can enter commands for starting the loading of a plate P and starting image recording, the number and sizes of plates P to be used, and other commands from the control panel 6 to a controller (not shown).

Openable and closable front covers 7*a*, 7*b* and rear covers 8*a*, 8*b* (not shown) are attached to the upper surface of the image recorder 1. A gap is defined between the front covers 7*a*, 7*b* and the rear covers 8*a*, 8*b*. A plate feed/discharge unit 20 (in which only an upper tray 41 thereof is shown in FIGS. 1 and 2) protrudes upwardly of the image recorder 1 from the gap.

The plates P on the set tables 2*a*, 2*b* move in directions indicated by the arrows A and B of FIG. 2, and pass over the plate guides 3*a*, 3*b*. Thereafter, the plates P pass through a slit 9 defined between the front covers 7*a*, 7*b* and the plate guides 3*a*, 3*b*, and are loaded onto the upper tray 41 of the image recorder 1.

The left-hand side and the right-hand side of the image recorder 1 as seen in FIGS. 1 and 2 are referred to hereinafter as a "home side" and an "away side," respectively. The full face side as seen in FIGS. 1 and 2 is referred to hereinafter as the front side of the image recorder 1, and the opposite side as the rear side thereof. An axis parallel to the axis of rotation of a drum 21 (to be described later) is defined as an X axis. A direction from the home side to the away side is defined as a +X direction, and the opposite direction as a −X direction. A vertical axis is defined as a Z axis. A vertical upward direction is defined as a +Z direction, and a vertical downward direction as a −Z direction. An axis perpendicular to the X and Z axes is defined as a Y axis. A direction from the rear side to the front side of the image recorder 1 is defined as a +Y direction, and the opposite direction as a −Y direction.

When the image recorder 1 has two members of the same type, identifying alphabetic characters "a" and "b" are added herein to the same reference character in principle to designate a member on the home side and a member on the away side, respectively, such as the plate guides 3*a* and 3*b*. However, such identifying alphabetic characters are dispensed with in some cases for description of the structure, function and the like common to the two members.

Figure 3:
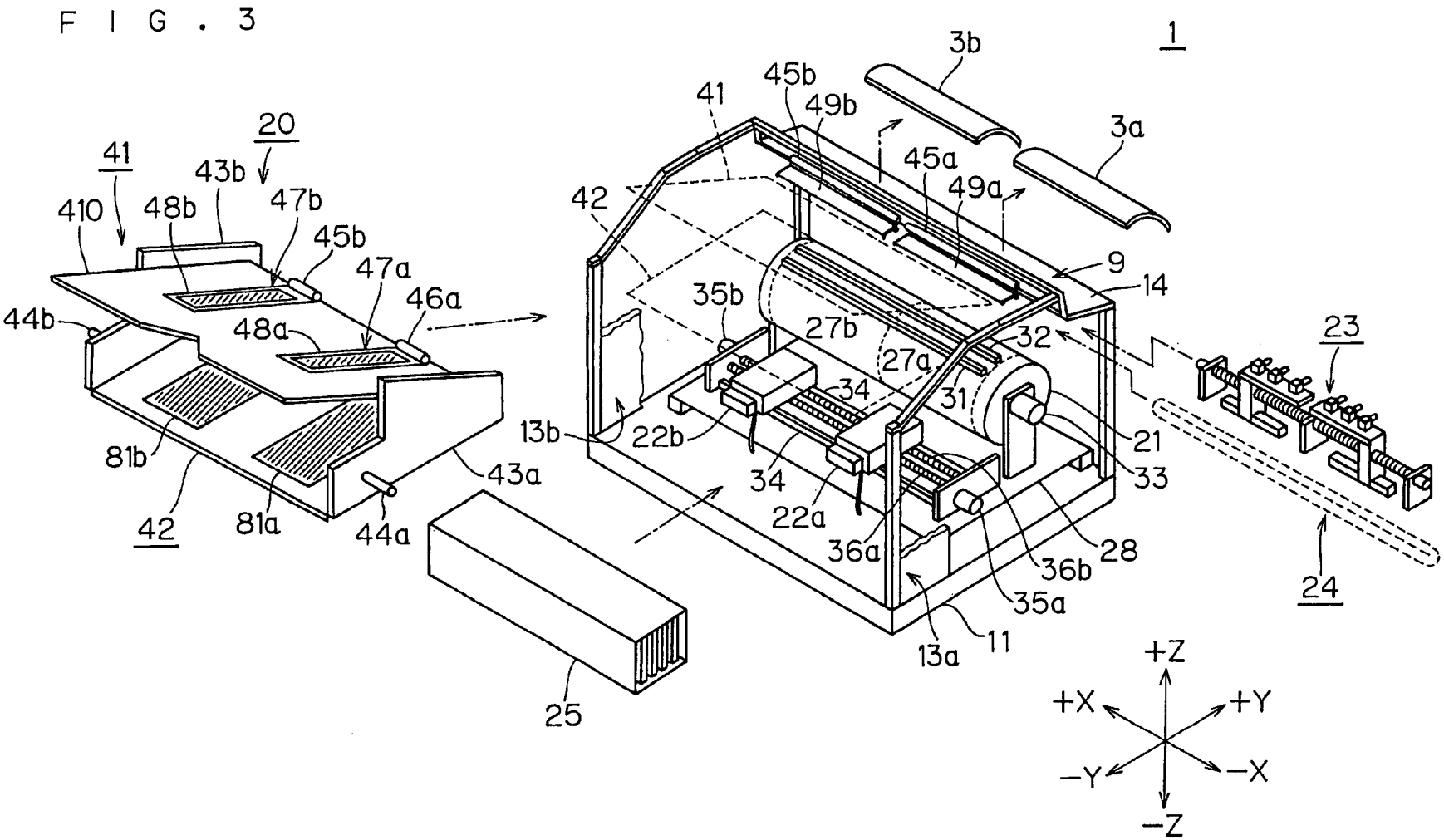
FIG. 3 is an exploded view showing the construction of the image recorder.

FIG. 3 is a schematic perspective view, with parts exploded, of the image recorder 1, as seen from the rear side of the image recorder 1. The above-mentioned front covers 7*a*, 7*b* and the rear covers 8*a*, 8*b* are not shown in FIG. 3.

The image recorder 1 is constructed such that side panels 13*a*, 13*b*, a plate mounting panel 14, the front covers 7*a*, 7*b* and the rear covers 8*a*, 8*b* are attached to a frame 11 having approximately the shape of a rectangular parallelepiped, and a required horizontal panel is provided across the interior of the frame 11. The plate feed/discharge unit 20, the cylindrical drum 21, a pair of recording heads 22*a*, 22*b*, a punch unit 23, a side-to-side adjustment unit 24, an electrical unit 25, a base 26, and the like are mounted to the frame 11 having approximately the shape of a rectangular parallelepiped.

The base 26 is secured to the bottom surface of the frame 11. The drum 21, the pair of recording heads 22*a*, 22*b*, and drive mechanisms for driving the drum 21 and the recording heads 22*a*, 22*b*, respectively, are mounted on the base 26.

The drum 21 is intended to mount one or two plates P on the outer peripheral surface thereof. When two plates P are mounted, the two plates P are arranged along the X axis. A plate mounting region on the outer peripheral surface of the drum 21 is divided into two regions arranged along the X axis: a right-hand region as seen in FIG. 3 which is referred to as a first plate mounting region 27*a*; and a left-hand region which is referred to as a second plate mounting region 27*b*. The plate mounting regions 27*a* and 27*b* have the same dimension along the X axis in this preferred embodiment, but may have different dimensions along the X axis. When only one of the plate mounting regions 27*a* and 27*b* is used to mount a plate P, the plate P is referred to as a double-mounting plate P2.

In some cases, a distinction will be made between double-mounting plates P2 to be mounted in the first and second plate mounting regions 27*a* and 27*b* by designating the former using the reference character P2*a* and the latter using the reference character P2*b*.

On the other hand, there is a plate P to be mounted using the two plate mounting regions 27*a* and 27*b* together. The plate P to be mounted in this fashion is referred to as a single-mounting plate P1.

(Drum 21)

The drum 21 comprises a leading edge clamp 31 for fixing the leading edge of a plate P, a trailing edge clamp 32 for fixing the trailing edge of the plate P, and a suction hole not shown for holding the back surface of the plate P by vacuum suction. The drum 21 is rotatable forwardly and backwardly at high or low speeds by a motor 33 attached to a rotary shaft of the drum 21. Clockwise and counterclockwise directions of rotation of the drum 21 when an end surface of the drum 21 is seen from the home side are referred to as a forward direction and a backward direction, respectively. Although not shown, the leading edge clamp 31 includes a plurality of pressing portions 310, and a pivotal shaft for coupling the pressing portions 310 together. A leading edge clamp opening/closing mechanism (not shown) mounted to the frame 11 of the image recorder 1 acts to pivot the pivotal shaft, thereby pivoting the plurality of pressing portions 310 simultaneously between a position for fixing the leading edge of the plate P and a position for releasing the same. The trailing edge clamp 32 includes a plurality of securing sections 320 (not shown). A trailing edge clamp opening/closing mechanism (not shown) mounted to the frame 11 acts to move the securing sections 320 of the trailing edge clamp 32 between a position for fixing the trailing edge of the plate P on the surface of the drum 21 and a position spaced apart from the drum 21 for releasing the trailing edge of the plate P. Thus, the trailing edge clamp 32 fixes and releases the trailing edge of the plate P. Specific structures of the leading edge clamp opening/closing mechanism and the trailing edge clamp opening/closing mechanism are not relevant to the present invention, and therefore will not be described in detail.

A plurality of positioning pins for positioning the plate P are provided upright on the surface of the drum 21.

(Recording Heads 22*a* and 22*b*)

The first and second recording heads 22*a* and 22*b* direct a plurality of optical beams modulated in accordance with an image signal, for example, from a plurality of light emitting devices onto a plate P mounted on the outer peripheral surface of the drum 21, thereby to form an image on the plate P. Both of the first and second recording heads 22*a* and 22*b* are disposed slidably along a pair of rails 34 secured on the base 26. The first recording head 22*a* is in threaded engagement with a feed screw 36*a* rotatably driven by a motor 35*a*. Thus, the first recording head 22*a* is driven by the motor 35*a* to produce a reciprocal movement in a direction parallel to the axis of rotation of the drum 21 (or parallel to the X axis). Similarly, the second recording head 22*b* is in threaded engagement with a feed screw 36*b* rotatably driven by a motor 35*b*. Thus, the second recording head 22*b* is driven by the motor 35*b* to produce a reciprocal movement in a direction parallel to the axis of rotation of the drum 21. In this manner, the image recorder 1 is capable of individually operating the two recording heads 22*a* and 22*b*.

The image recorder 1 is capable of recording an image at any resolution, and the feed speed (sub-scanning speed) of the first and second recording heads 22*a* and 22*b* is established based on a selected resolution. The first and second recording heads 22*a* and 22*b* are fed continuously, whereby the plate P is scanned in a spiral fashion. During the scanning, an adjustment known as a spiral correction is made which, for example, corrects the light emission timing of the light emitting devices of the recording heads for proper recording of a rectangular image.

Although plates P of different sizes may be used in the image recorder 1, the plates P, if of any size, are mounted to the drum 21 at the same angle. Specifically, each of the plates P is mounted to the drum 21 so that the leading edge thereof is always parallel to the axis of rotation of the drum 21. This eliminates the need to correct image data for compensating for changes in the mounting angle of the plates P.

(Punch Unit 23)

The punch unit 23 is intended to punch a hole for positioning and the like in a plate P before being mounted to the drum 21. The punch unit 23 also punches a hole serving as a reference for mounting of an image-recorded plate P onto a plate cylinder and the like of a printing apparatus. The details will be described later. The punched holes, as that term is used herein, include not only a circumferentially closed hole (such as printing holes R1 and R2 to be described later) but also a notch (such as a semicircular hole Q1 and an elongated hole Q2 to be described later) having a portion partially open to the outside.

(Side-to-Side Adjustment Unit 24)

The side-to-side adjustment unit 24 is a member for positioning a plate P along the X axis before the punching operation of the plate P by the punch unit 23. The side-to-side adjustment unit 24 is located on the rear side of the punch unit 23 (or forward of the punch unit 23 as seen in FIG. 3). The image recorder 1 is capable of mounting one or two plates P on the drum 21 at the same time. For mounting of a single-mounting plate P1, the side-to-side adjustment unit 24 performs a side-to-side adjustment operation so that the X-axis center of the plate P1 coincides with the X-axis center of the punch unit 23. For mounting of a double-mounting plate P2, the side-to-side adjustment unit 24 performs a side-to-side adjustment operation so that the X-axis center of the plate P2 coincides with the X-axis center of a movable punch unit (a first movable punch unit 102*a* or a second movable punch unit 102*b* to be described later) corresponding to the plate P2.

(Plate Feed/Discharge Unit 20)

The plate feed/discharge unit 20 is constructed such that two trays (an upper tray 41 and a lower tray 42) are fixed between a pair of side panels 43*a* and 43*b*. The plate feed/discharge unit 20 is mounted to the image recorder 1 by coupling rotary shafts 44*a* and 44*b* attached to the side panels 43*a* and 43*b* to the side panels 13*a* and 13*b*, respectively, of the image recorder 1. The plate feed/discharge unit 20 is pivoted about the rotary shafts 44*a* and 44*b* by a drive mechanism 90 to be described later (not shown in FIG. 3). In the image recorder 1, the plate feed/discharge unit 20 is pivoted about the rotary shafts 44*a* and 44*b*, thereby to achieve three angular positions to be described below.

The three angular positions are as follows: an angular position (or a plate loading position) assumed when a virgin plate P is loaded from the outside of the image recorder 1 onto the upper tray 41 of the plate feed/discharge unit 20; an angular position (or a punching position) assumed when the virgin plate P is fed from the upper tray 41 to the punch unit 23 and the side-to-side adjustment unit 24; and an angular position (or a feed/discharge position) allowing a plate P punched with holes to be fed from the upper tray 41 to the drum 21. The upper and lower trays 41 and 42 in the feed/discharge position are shown by chain-dotted lines in FIG. 3. When the plate feed/discharge unit 20 is in the plate loading position, an image-recorded plate P is moved in the −Y direction from the lower tray 42 and is transported out of the image recorder 1.

Two roller pairs (entrance roller pairs 45*a* and 45*b*) side by side along the X axis and guide panels 49*a* and 49*b* are disposed between the above-mentioned slit 9 and the plate feed/discharge unit 20 to assist in loading a plate P onto the upper tray 41.

The upper tray 41 of the plate feed/discharge unit 20 is constructed such that a plurality of components to be described later are attached to a single panel-like member (an upper tray body 410), and may be divided into two regions, i.e. a right-hand region and a left-hand region, depending on the usage thereof. Specifically, as shown in FIG. 4 which is a top view of the upper tray 41, the upper tray 41 is divided into a first upper tray region 41*a* on the home side and a second upper tray region 41*b* on the away side.

Figure 4:
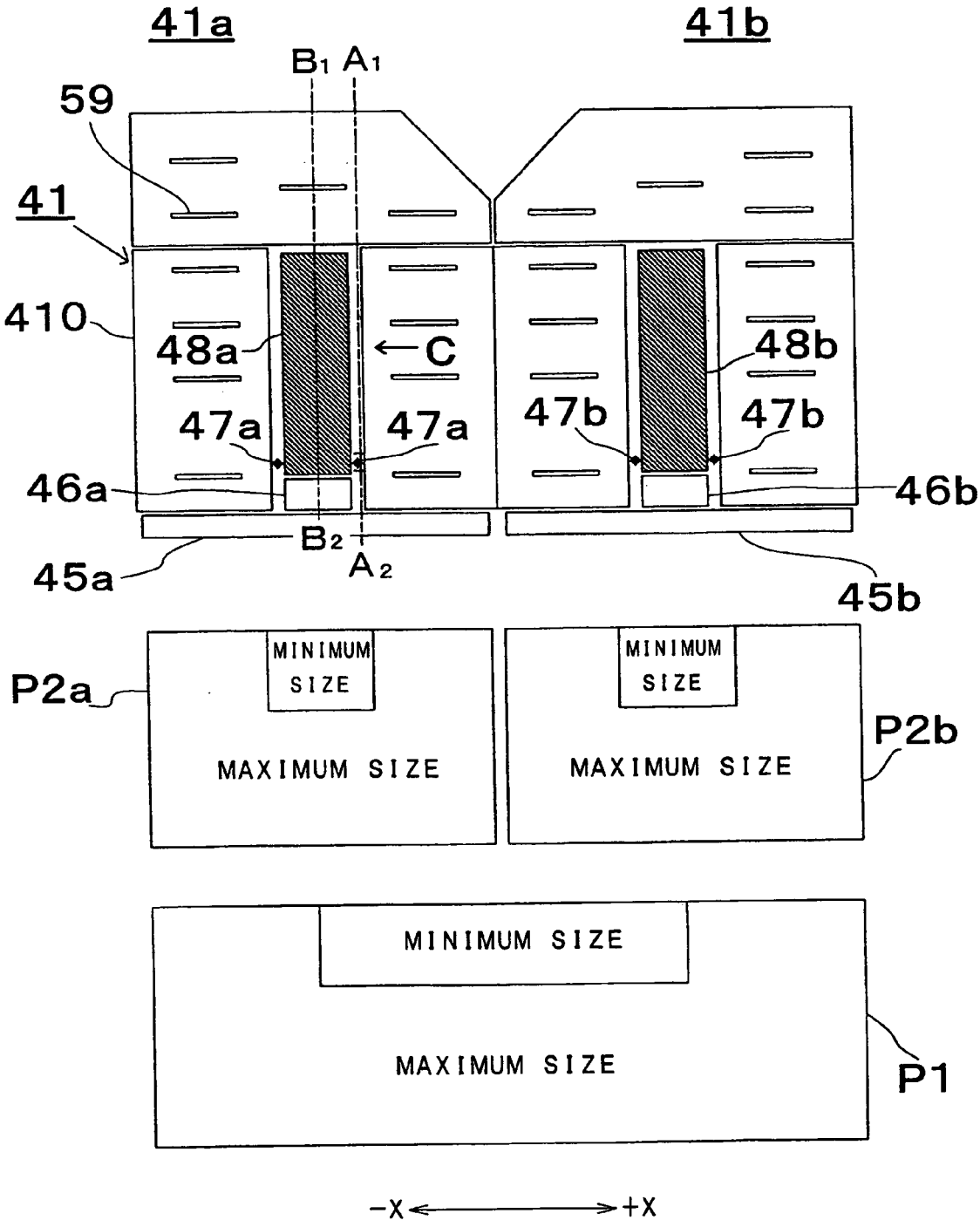
FIG. 4 is a top view of a plate feed/discharge unit.

The sizes of plates P loadable to the regions 41*a* and 41*b* are shown in FIG. 4 for reference. As shown in FIG. 4, each of the regions 41*a* and 41*b* can be loaded with a single one of the plates P (P2*a*, P2*b*) of various sizes ranging from a minimum size (e.g., 398 by 370 mm) to a maximum size (e.g., 1160 by 940 mm). Additionally, both of the regions 41*a* and 41*b* can be used together to be loaded with a single one of the plates P (P1) of various sizes ranging from a minimum size (e.g., 1160 by 940 mm) to a maximum size (e.g., 2382 by 1270 mm). Since the regions 41*a* and 41*b* are substantially identical in structure with each other, the first upper tray region 41*a* is taken as an example for description below (See FIGS. 4 and 5).

As illustrated in FIG. 4, the upper surface of the upper tray body 410, a loading transport roller pair 46*a*, two suction pads 47*a*, an entrance belt 48*a*, and twelve idle rollers 59 are exposed at the upper surface of the first upper tray region 41*a*. Each of the two suction pads 47*a* is moved in the upward and downward directions in FIG. 4, by a suction pad slide mechanism 54*a* to be described later, and is moved vertically with respect to the surface of the upper tray body 410 by a suction pad lifting mechanism 52*a*. The entrance belt 48*a* is driven by an entrance belt unit 70*a* to be described later in such a direction as to pull up a plate P onto the upper tray 41 and in its opposite direction.

The upper tray 41 has a length and a width large enough to receive the plate P of the maximum size for use in the image recorder 1. On the other hand, the movable range of the suction pads 47 and the entrance belt 48 is shorter than the plate P of the maximum size. However, such an arrangement can receive the full length of the plate P of the maximum size, which will be described in detail later.

Figure 5:
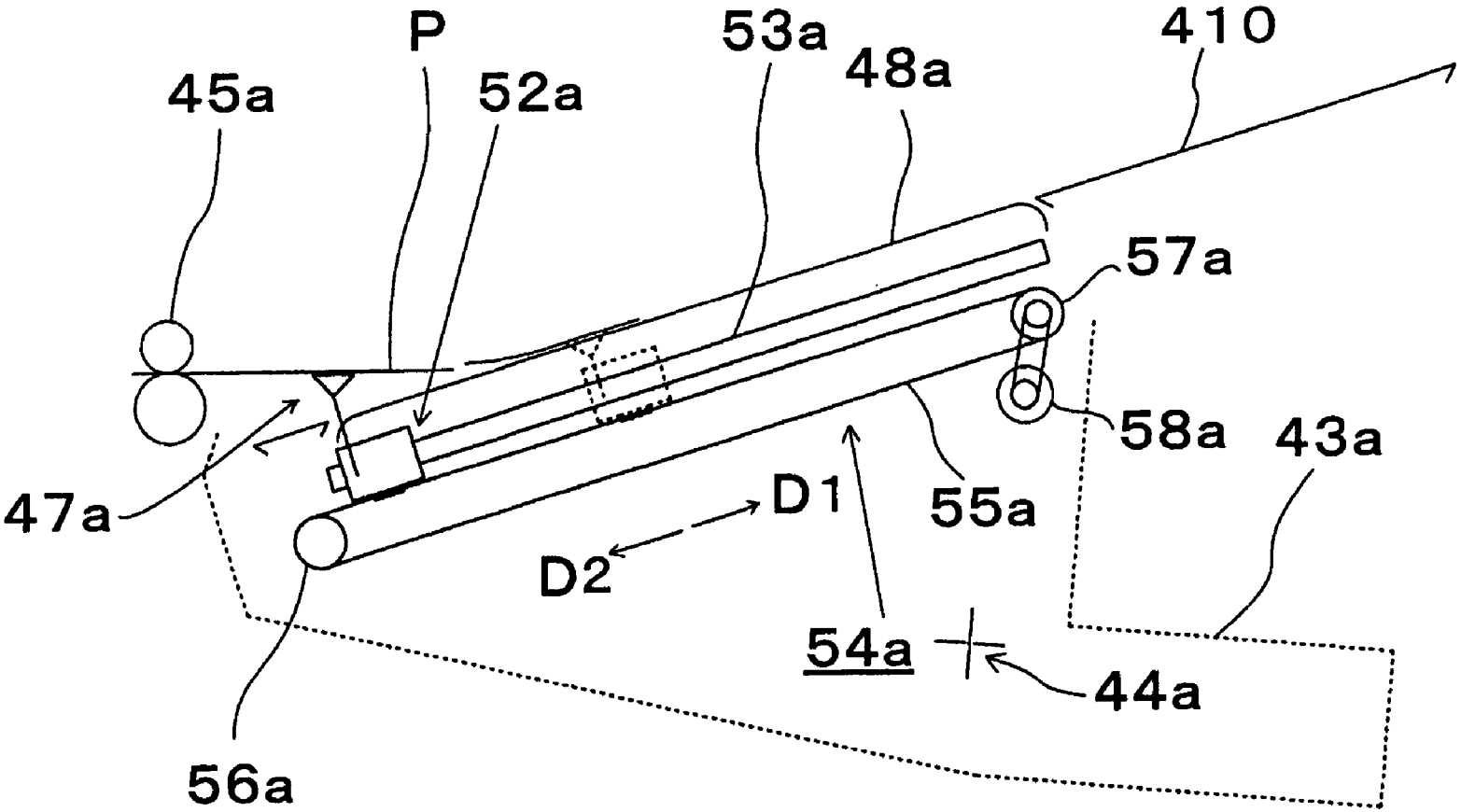
FIG. 5 is a sectional view of the plate feed/discharge unit.

FIG. 5 is a sectional view of the first upper tray region 41*a* taken along the dash-dot line A1–A2 of FIG. 4 as seen in the direction of the arrow C. The first upper tray region 41*a* includes the suction pad lifting mechanism 52*a* for vertically moving the suction pads 47*a*, and the suction pad slide mechanism 54*a* for reciprocally moving the suction pad lifting mechanism 52*a* along a guide member 53*a* in the directions indicated by the arrows D1 and D2.

The suction pad slide mechanism 54*a* includes the guide member 53*a* extending along the upper tray body 410, a drive belt 55*a*, first and second belt shafts 56*a* and 57*a* around which the drive belt 55*a* is looped, and a motor 58*a* for rotating the second belt shaft 57*a* The first and second belt shafts 56*a*, 57*a* and the motor 58*a* are fixed to the back surface of the upper tray body 410 by a connecting means not shown.

The drive belt 55*a* and the suction pad lifting mechanism 52*a* are coupled to each other in such a manner that a lifting mechanism base 61*a* (to be described later) of the suction pad lifting mechanism 52*a* is secured to the drive belt 55*a*. Thus, rotation of the motor 58*a* of the suction pad slide mechanism 54*a* drives the drive belt 55*a*, thereby to allow the suction pad lifting mechanism 52*a* to move along the guide member 53*a* in the directions indicated by the arrows D1 and D2.

Figure 6:
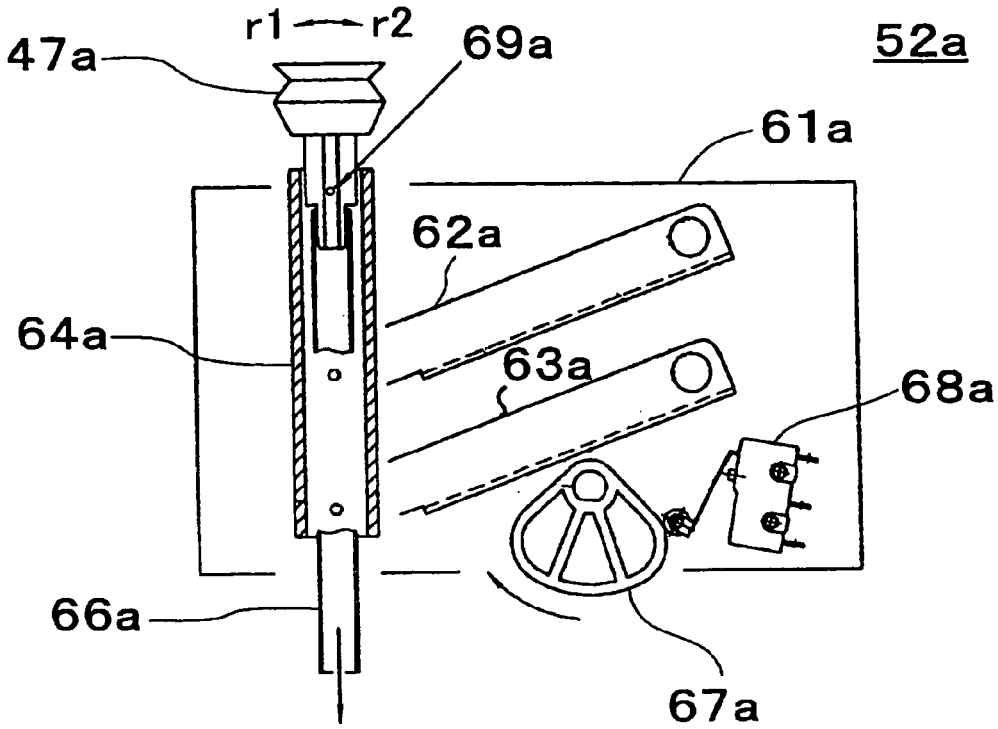
FIGS. 6 and 7 are sectional views of a suction pad lifting mechanism.

FIG. 6 is a schematic sectional view, on an enlarged scale, of the suction pad lifting mechanism 52*a* taken along the dash-dot line A1–A2 of FIG. 4 as seen in the direction of the arrow C. As shown in FIG. 6, the suction pad lifting mechanism 52*a* includes: the lifting mechanism base 61*a* which is a box-shaped member formed with predetermined openings in upper and lower surfaces thereof; first and second arms 62*a* and 63*a* (constituting a parallel link mechanism) each having one end rotatably supported by the inner surface of the lifting mechanism base 61*a*; a suction pad support pipe 64*a* held by the first and second arms 62*a* and 63*a*; a suction pad 47*a* and a suction hose 66*a* inserted in the suction pad support pipe 64*a*; a vacuum pump (not shown) coupled to the suction hose 66*a*; an eccentric cam 67*a* for pushing the second arm 63*a* upwardly to vertically move the suction pad 47*a*; a motor (not shown) for rotating the eccentric cam 67*a*; and a microswitch 68*a* for detecting the home position of the eccentric cam 67*a*.

The suction pad 47*a* is mounted to the inner surface of the suction pad support pipe 64*a* so as to be driven to pivot about a pin 69*a* in directions r1 and r2.

Figure 7:
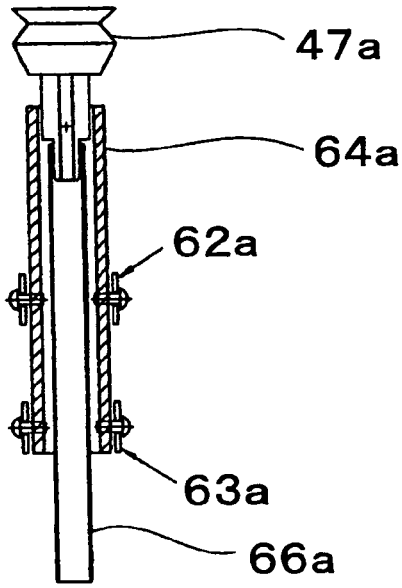

FIG. 7 is a partial sectional view of the suction pad support pipe 64*a* as seen from the left-hand side of FIG. 6. As shown in FIG. 7, the other end of each of the first and second arms 62*a* and 63*a* loosely grippingly holds the suction pad support pipe 64*a*.

Figure 8A:
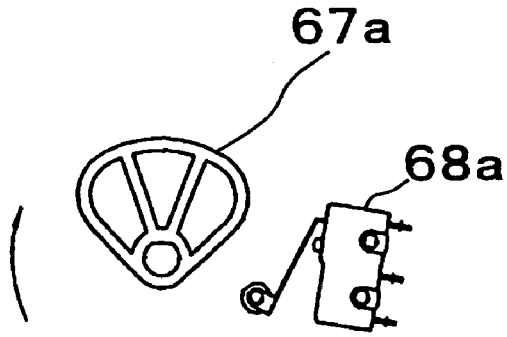
FIGS. 8A and 8B are views for illustrating the operation of an eccentric cam.
Figure 8B:
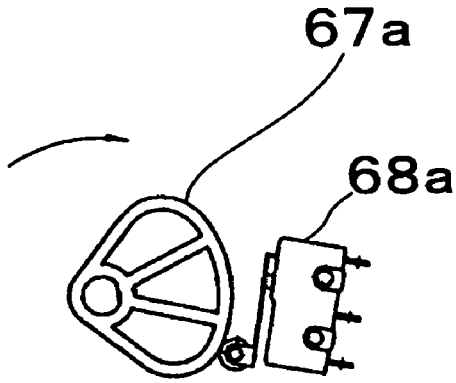

FIGS. 8A and 8B are views illustrating the detection of the home position of the eccentric cam 67*a*. The microswitch 68*a* is shown in the OFF position in FIG. 8A, and in the ON position in FIG. 8B. As illustrated in FIG. 8A, the eccentric cam 67*a* and the microswitch 68*a* are located so that a small-diameter portion of the eccentric cam 67*a* and a detection portion of the microswitch 68*a* do not make contact with each other. When a large-diameter portion of the eccentric cam 67*a* is oriented upward, the microswitch 68*a* is in the OFF position. When the eccentric cam 67*a* rotates, the large-diameter portion of the eccentric cam 67*a* presses the microswitch 68*a* (in a position shown in FIG. 8B). At this time, the microswitch 68*a* turns ON. The angular position of the eccentric cam 67*a* when the microswitch 68*a* makes an ON-to-OFF transition is defined as the home position thereof. Since the direction of rotation of the eccentric cam 67*a* is limited to one direction (indicated by the arrow in FIGS. 8A and 8B), the home position of the eccentric cam 67*a* is uniquely determined.

Figure 9A:
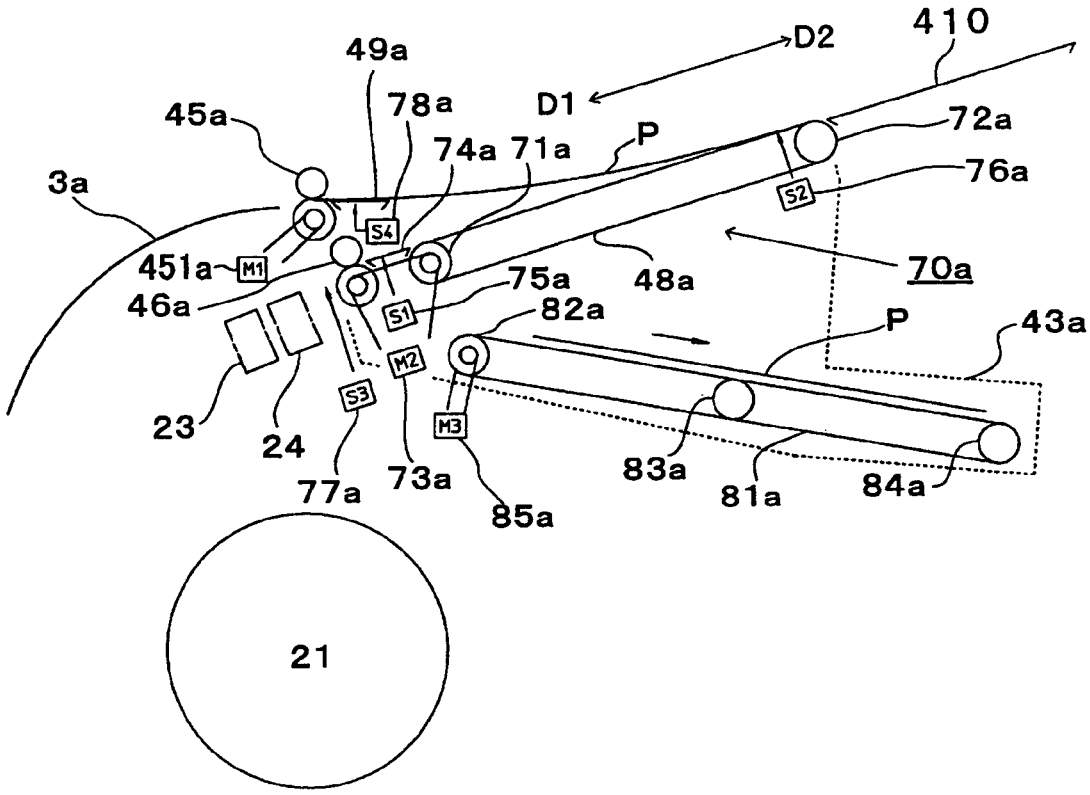
FIG. 9A is a sectional view of the plate feed/discharge unit.

FIG. 9A is a sectional view of the upper tray 41 (in the first upper tray region 41*a*) and the lower tray 42 taken along the dash-dot line B1–B2 of FIG. 4 as seen in the direction indicated by the arrow C.

The entrance belt unit 70*a* of the upper tray 41 includes: the entrance belt 48*a*; a driving roller 71*a* and a driven roller 72*a* around which the entrance belt 48*a* is looped; a pair of rollers (the loading transport roller pair 46*a*) disposed on the front end of the upper tray body 410 for feeding out a plate P on the upper tray 41; a motor 73*a* for simultaneously rotating the driving roller 71*a* and the loading transport roller pair 46*a*; a guide panel 74*a* disposed between the driving roller 71*a* and the loading transport roller pair 46*a*; a first sensor 75*a* for detecting a plate P on the guide panel 74*a*; a second sensor 76*a* for detecting a plate P near the driven roller 72*a*; a third sensor 77*a* for detecting the leading edge of a plate P in a location projecting out of the loading transport roller pair 46*a*; and a fourth sensor 78*a* for detecting a plate P on the guide panel 49*a*. The entrance roller pair 45*a* is driven by a motor 451*a*.

Each of the first to fourth sensors 75*a*, 76*a*, 77*a*, 78*a* is a reflective optical sensor which is in an ON state when a light beam for object detection emitted from a light emitting device is reflected from an object to return to a light receiving device. Such a sensor is in an OFF state in other cases, that is, when the light receiving device does not detect the light beam for object detection.

Figure 9B:
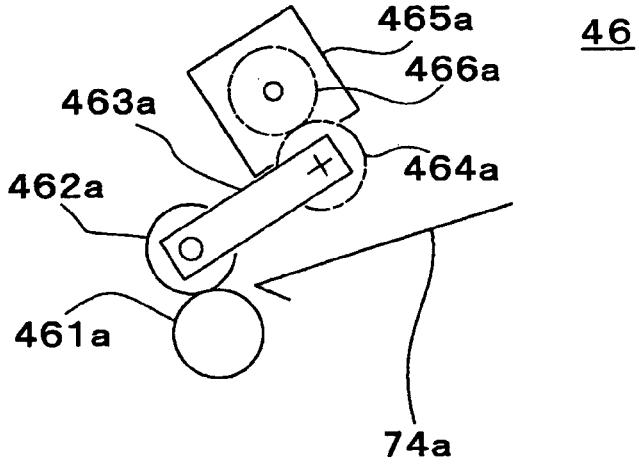
FIG. 9B is a sectional view of a loading transport roller.

FIG. 9B shows the loading transport roller pair 46*a*. As shown in FIG. 9B, the loading transport roller pair 46*a* includes a transport roller 461*a* rotatably driven by the motor 73*a*, and a nip roller 462*a* driven to rotate by the rotation of the transport roller 461*a*. The nip roller 462*a* is pivotably supported by a pivotal member 463*a*. A gear 464*a* is attached to the pivotal member 463*a*, and is in meshing engagement with a gear 466*a* of a motor 465*a*. Thus, when the motor 465*a* rotates, the pivotal member 463*a* is pivoted through the gears 464*a* and 466*a* to urge the nip roller 462*a* toward the transport roller 461*a*. This causes the transport roller 461*a* and the nip roller 462*a* to hold a plate P therebetween.

As shown in FIG. 3, discharge belts 81*a* and 81*b* are disposed in the lower tray 42. The discharge belts 81*a* and 81*b* are driven by respective drive mechanisms similar in construction to each other. The drive mechanism for the discharge belt 81*a* on the home side will be described as a representative example. The drive mechanism for the discharge belt 81*a* on the home side is shown in FIG. 9A. The discharge belt 81*a* is looped around three rollers 82*a*, 83*a*, 84*a*. A motor 85*a* is coupled to the shaft of the roller 82*a*. The rotation of the motor 85*a* drives the roller 82*a* to rotate, thereby causing the discharge belt 81*a* to transport a plate P placed thereon outwardly in the direction of the arrow.

(Drive Mechanism 90)

Figure 10:
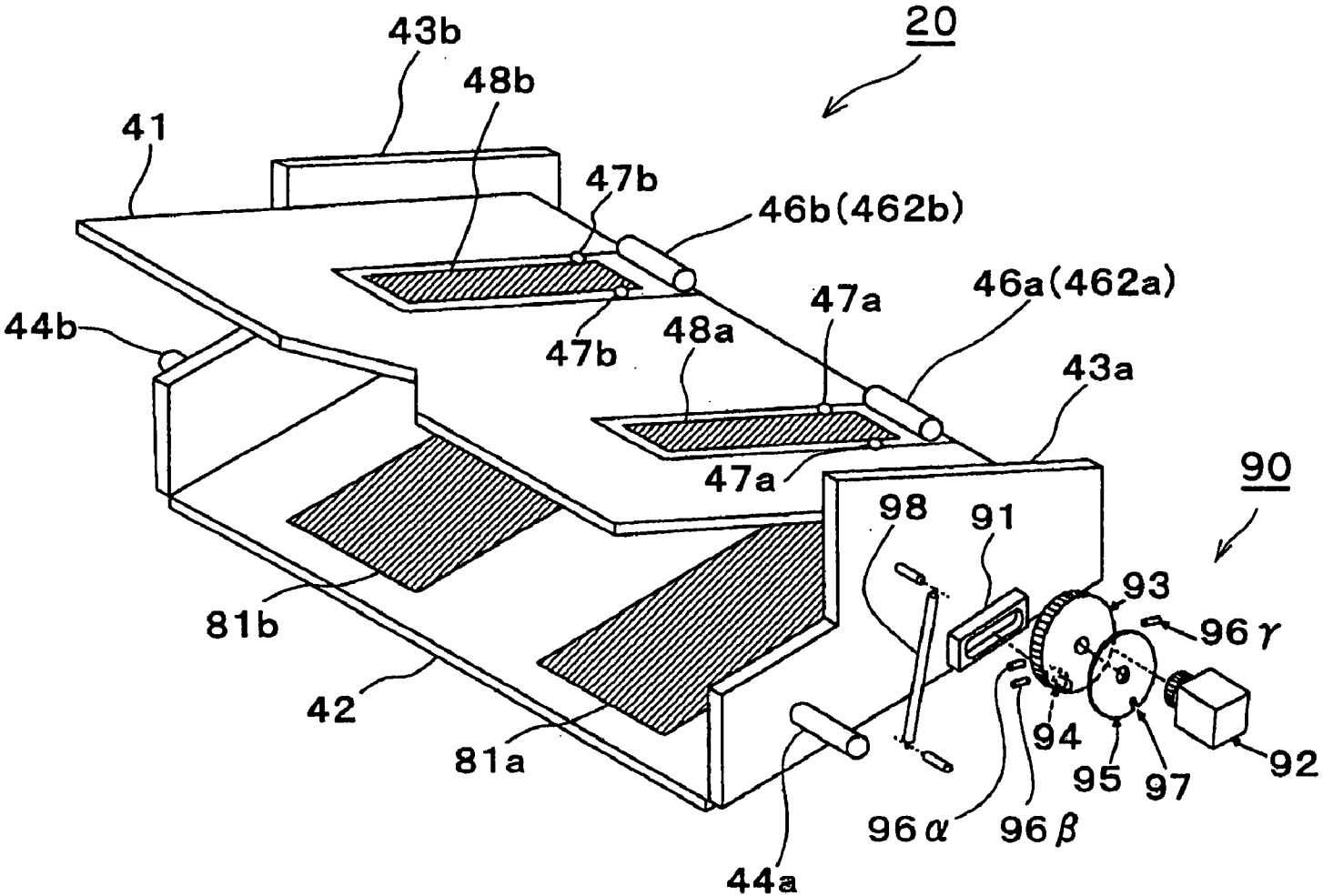
FIG. 10 is an exploded view of a drive mechanism.

FIG. 10 is a perspective view showing the plate feed/discharge unit 20 and the drive mechanism 90. The single drive mechanism 90 is disposed on each of the opposite sides of the plate feed/discharge unit 20. Although only the drive mechanism 90 on the home side is shown in FIG. 10, the similar drive mechanism 90 is also disposed on the away side.

Each of the drive mechanisms 90 includes a cam follower guide 91, a motor 92, a cam gear 93, a cam follower 94, a sensor detection panel 95, a sensor 96α, a sensor 96β and a sensor 96γ, and has the function of pivoting the plate feed/discharge unit 20 about the rotary shafts 44*a* and 44*b*. Both of the drive mechanisms 90 on the home and away sides need not always be provided with respective sensor detection panels 95. The cam follower guide 91 has the outer shape of a rectangular parallelepiped with a through hole elongated along the Y axis. The cam follower guide 91 is secured to the side panel 43*a* so that the through hole thereof is opposed to the through hole of the cam follower guide 91 of the drive mechanism 90 on the away side, with the plate feed/discharge unit 20, therebetween. The motor 92 on the home side is disposed near the side panel 43*a* and fixed to the frame 11 so as to be opposed to the motor 92 of the drive mechanism 90 on the away side, with the plate feed/discharge unit 20 therebetween. The cam gear 93 is fixed to the frame 11 so as to be opposed to the side panel 43*a*. The cam gear 93 receives a driving force generated by the motor 92 to rotate about its own axis. The cam follower 94 is fixed to the outer periphery of one surface (opposed to the side panel 43*a*) of the cam gear 93, and makes a circular motion about the axis of the cam gear 93. The cam follower 94 has the shape of a disc with a diameter approximately equal to the vertical width of the through hole of the cam follower guide 91, and fits into the through hole as indicated by the dash-dot line of FIG. 10. Thus, the cam follower guide 91 and the cam gear 93 are coupled to each other by the cam follower 94, whereby the plate feed/discharge unit 20 is supported by the drive mechanism 90. A cylinder 98 is a member having a first end coupled to the side panel 43*a* of the plate feed/discharge unit 20 and a second end coupled to the frame 11 for smoothing the pivotal movement of the plate feed/discharge unit 20.

The sensor detection panel 95 which is disc-shaped is disposed concentrically with the cam gear 93, and rotates with the cam gear 93. The sensor detection panel 95 has a single slit 97 in the outer periphery thereof. The sensors 96α, 96β, and 96γ are secured to the frame 11 so as to be able to detect the slit 97 formed in the sensor detection panel 95 being rotated. The use of the sensors 96α, 96β and 96γ allows the detection of the plate feed/discharge unit 20 reaching any one of the plate loading position, the punching position, and the feed/discharge position.

(Details of Punch Unit 23)

Figure 11:
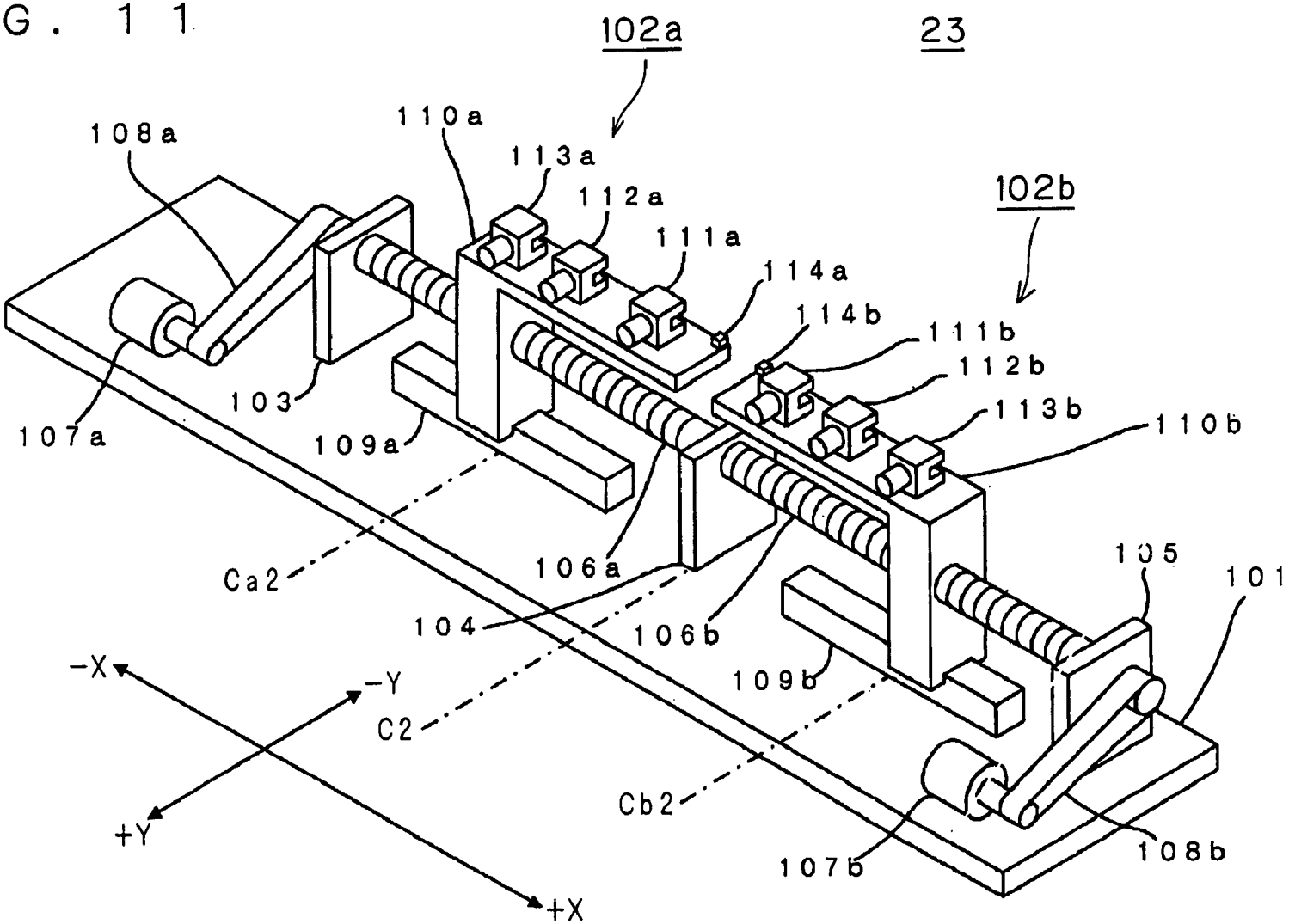
FIG. 11 is a perspective view of a punch unit.

FIG. 11 is a perspective view of the punch unit 23 as seen from the front side of the image recorder 1. The punch unit 23 generally comprises a horizontal panel 101 provided between the side panels 13*a* and 13*b* of the image recorder 1, and a pair of movable punch units (a first movable punch unit 102*a* and a second movable punch unit 102*b*) disposed on the horizontal panel 101.

The first movable punch unit 102*a* includes: holding panels 103 and 104; a feed screw 106*a* rotatably held between the holding panels 103 and 104; a motor 107*a* and a belt 108*a* for rotating the feed screw 106*a*; a rail 109*a*; a movable table 110*a* disposed slidably on the rail 109*a* and in threaded engagement with the feed screw 106*a*; punchers 111*a*, 112*a* and 113*a* placed on the movable table 10*a*; and a plate detection sensor 114*a*. The first movable punch unit 102*a* rotates the feed screw 106*a* by using the motor 107*a* and the belt 108*a* to move the movable table 10*a* and the punchers 111*a*, 112*a* and 113*a* placed on the movable table 110*a* along the rail 109*a*, thereby adjusting the locations of the movable table 110*a* and the punchers 111*a*, 112*a* and 113*a* along the X axis.

The second movable punch unit 102*b* includes: a holding panel 105; a movable table 110*b*; punchers 111*b*, 112*b* and 113*b*; and a plate detection sensor 114*b*. The locations of the movable table 110*b* and the punchers 111*b*, 112*b* and 113*b* placed on the movable table 110*b* are adjusted along the X axis by a mechanism similar to that of the first movable punch unit 102*a*. Specifically, the second movable punch unit 102*b* rotates a feed screw 106*b* by using a motor 107*b* and a belt 108*b* to move the movable table 110*b* and the punchers 111*b*, 112*b* and 113*b* placed on the movable table 110*b* along a rail 109*b*, thereby adjusting the locations of the movable table 110*b* and the punchers 111*b*, 112*b* and 113*b* along the X axis.

In the punch unit 23, the movement of the two movable tables 110*a* and 110*b* is controlled with reference to three X-axis positions. Specifically, for punching a single-mounting plate P1, the motors 107*a* and 107*b* of the first and second movable punch units 102*a* and 102*b* are controlled with reference to a reference line C2 lying at the X-axis central position of the punch unit 23. For punching a double-mounting plate P2*a* mounted in the first plate mounting region 27*a*, the motors 107*a* and 107*b* are controlled with reference to a reference line Ca2 lying at the X-axis central position of the first movable punch unit 102*a*. For punching a double-mounting plate P2*b* mounted in the second plate mounting region 27*b*, the motors 107*a* and 107*b* are controlled with reference to a reference line Cb2 lying at the X-axis central position of the second movable punch unit 102*b*.

It is desirable that the punch unit 23 is assembled so that the reference lines C2, Ca2 and Cb2 coincide with the X-axis centers (centerlines C1, Ca1 and Cb1) of the drum 21, the first plate mounting region 27*a* and the second plate mounting region 27*b*, respectively. Such an arrangement allows the above-mentioned punched hole for positioning to be brought into engagement or into loose engagement with a positioning pin on the drum 21 only by feeding out a plate P intactly straight toward the drum 21 after the plate P punched with the hole for positioning is returned to the plate feed/discharge unit 20. This facilitates the positioning of the plate P on the drum 21.

If each reference position along the X axis on the punch unit 23 does not coincide with the centerline of the drum 21 or the like, there arises a need to move the plate P along the X axis after the punch process of the plate P and before the feed out of the plate P toward the drum 21.

In the image recorder 1 according to this preferred embodiment, holes are punched in the plate P before image recording. The punched holes are classified into three types: a punched hole (referred to as a positioning hole) for use in determining the position of the plate P with respect to the drum 21 of the image recorder 1; a punched hole (referred to as an escape hole) formed to prevent the leading edge of the plate P from contacting the positioning pins provided upright on the drum 21; and a punched hole (referred to as a printing hole) for use in positioning the image-recorded plate P on a plate cylinder and the like of a printing apparatus.

The punchers 111*a* of the first movable punch unit 102*a* and the puncher 111*b* of the second movable punch unit 102*b* are punchers for selectively forming the positioning hole or the escape hole.

Figure 12:
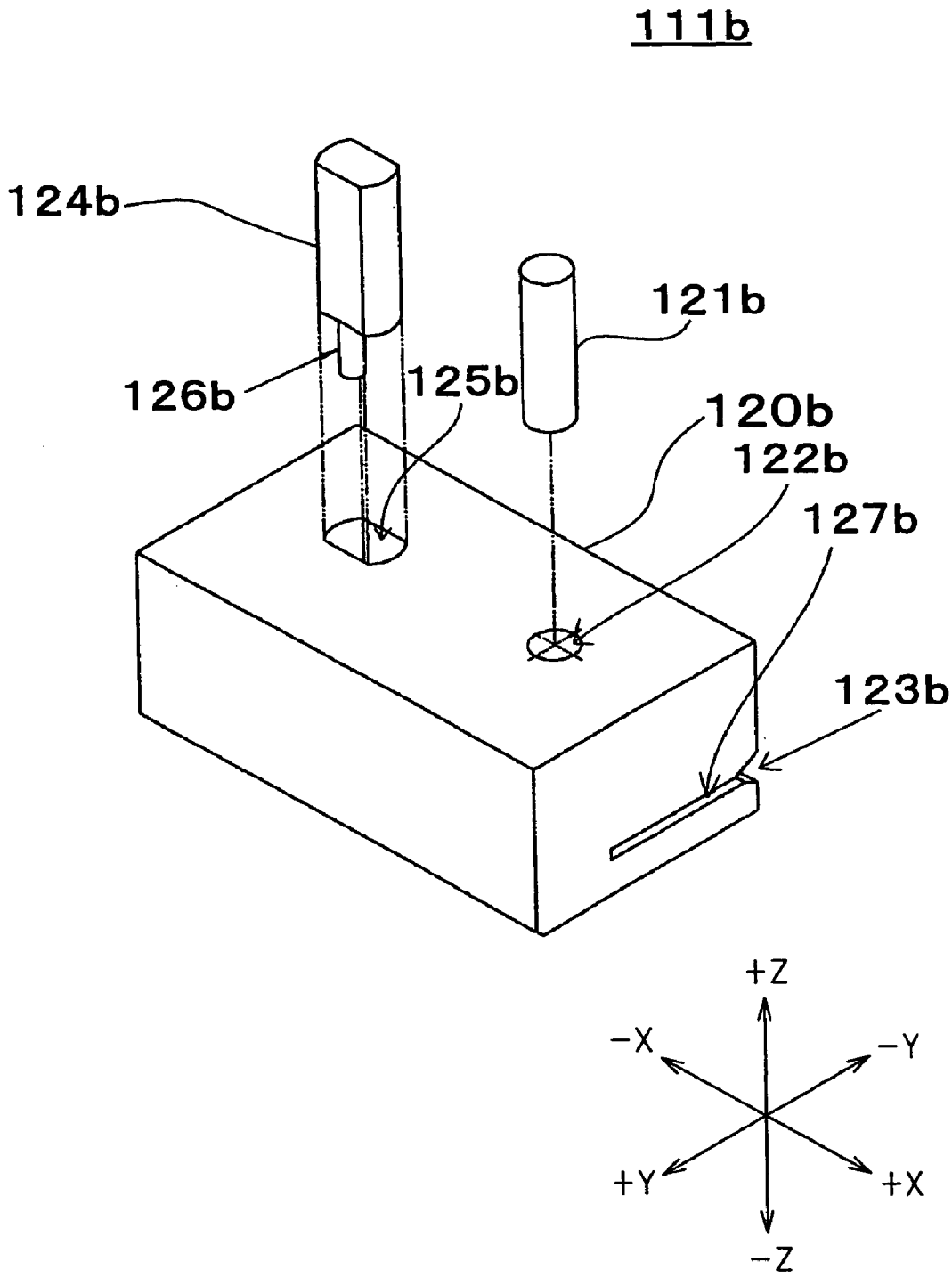
FIGS. 12 and 13 are perspective views of principal parts of a puncher.

FIG. 12 is a perspective view showing principal parts of the puncher 111*b*. As shown in FIG. 12, the puncher 111*b* comprises a main body 120*b* having a through hole 122*b* formed therein for receiving a round punch 121*b* moving up and down. The through hole 122*b* extends from the upper surface of the main body 120*b* through the main body 120*b*. The round punch 121*b* has a perfectly circular sectional configuration. The round punch 121*b* is used for purposes of punching the positioning hole or escape hole in the leading edge of the plate P. The main body 120*b* further has a clearance 123*b* for guiding the plate P. The main body 120*b* has a function as a guide member.

The main body 120*b* further has a through hole 125*b* formed therein for receiving an elongated punch 124*b* moving up and down. The through hole 125*b* extends from the upper surface of the main body 120*b* through the main body 120*b*. The elongated punch 124*b* has an elongated sectional configuration such that a dimension thereof along the Y axis is equal to the diameter of the section of the round punch 121*b*, and a dimension thereof along the X axis is not less than the diameter of the section of the round punch 121*b*. The elongated punch 124*b* is mainly used for purposes of punching the escape hole in the leading edge of the plate P, but is sometimes used to punch the positioning hole, which will be described in detail later.

A reference pin 126*b* is attached to the forward end of the elongated punch 124*b*. The reference pin 126*b* moves up and down together with the elongated punch 124*b*. The reference pin 126*b* has a perfectly circular sectional configuration with a diameter which is one-half the diameter of the section of the round punch 121*b*. The reference pin 126*b* is a member for positioning the plate P inserted into the clearance 123*b* along the Y axis.

Since the through hole 125*b* is formed in a flat surface 127*b* defined by the clearance 123*b*, the reference pin 126*b* can escape to below the flat surface 127*b* when the elongated punch 124*b* moves down. Punching chips resulting from the punching by the round punch 121*b* and the elongated punch 124*b* fall through the through holes 122*b* and 125*b* out of the lower surface of the main body 120*b*, and are collected by an additionally prepared collecting mechanism not shown.

The round punch 121*b*, the elongated punch 124*b* and the reference pin 126*b* are positioned along the Y axis so that the outermost edges thereof as seen in the +Y direction (or on the front side) are aligned. Specifically, the round punch 121*b*, the elongated punch 124*b* and the reference pin 126*b* are disposed so that a line connecting the outermost edges thereof as seen in the +Y direction is parallel to the X axis. A point at which the reference pin 126*b* contacts the plate P may be deviated in the −Y direction from the above-mentioned location. In other words, the reference pin 126*b* may come into contact with the plate P in a location displaced in the −Y direction.

The round punch 121*b* and the elongated punch 124*b* may be vertically moved individually by a drive mechanism not shown. Alternatively, the round punch 121*b* and the elongated punch 124*b* may be vertically moved in operative association with each other in accordance with a predetermined vertical movement cycle. For example, a drive mechanism may be used which repeats the following vertical movement cycle: (1) The round punch 121*b* and the elongated punch 124*b* are initially in their raised position; (2) Next, only the round punch 121*b* is moved up and down;

(3) Next, only the elongated punch 124*b* is moved up and down; (4) Finally, both of the round punch 121*b* and the elongated punch 124*b* are moved down.

The round punch 121*b* performs the operation of punching a hole in a manner to be described below. First, the elongated punch 124*b* is moved down until the tip of the reference pin 126*b* reaches the level of the flat surface 127*b*. In this state, a plate P is inserted into the clearance 123*b*, and is brought into contact with the reference pin 126*b*. This achieves the positioning of the plate P along the Y axis with respect to the puncher 111*b*. Since the diameter of the reference pin 126*b* is one-half the diameter of the round punch 121*b*, the plate P is positioned so that the leading edge of the plate P coincides with the line of the diameter of the round punch 121*b* along the X axis. In this state, when the round punch 121*b* is moved down, a semicircular hole is punched in the leading edge of the plate P. This punched hole is used as a positioning or escape hole. The positioning of the plate P along the X axis is determined by the processing of the side-to-side adjustment unit 24 to be described later.

The elongated punch 124*b* punches an elongated hole extending along the X axis in the plate P. This elongated hole is used as a positioning or escape hole.

For the formation of the elongated positioning hole, the plate P is inserted into the clearance 123*b*, with the reference pin 126*b* previously moved down, and the leading edge of the plate P is positioned using the reference pin 126*b*, following which the elongated punch 124*b* is further moved downwardly. After the plate P is positioned using the reference pin 126*b*, the elongated punch 124*b* is sometimes moved to another position and then moved downwardly to punch the elongated escape hole, which will be described in detail later.

The puncher 111*a* of the first movable punch unit 102*a* has a round punch 121*a* and an elongated punch 124*a* similar in construction to the round punch 121*b* and the elongated punch 124*b* of the puncher 11*b* of the second movable punch unit 102*b*. However, the round punch 121*a* and the elongated punch 124*a* are arranged in the reverse order, along the X axis, to the round punch 121*b* and the elongated punch 124*b* of the puncher 111*b*. In other words, the round punch 121*a* is spaced in the −X direction from the elongated punch 124*a* in the puncher 111*a*.

The puncher 112*a* (112*b*) of the first (second) movable punch unit 102*a* (102*b*) is a puncher for punching an elongated hole. This elongated hole is used as a positioning or escape hole.

Figure 13:
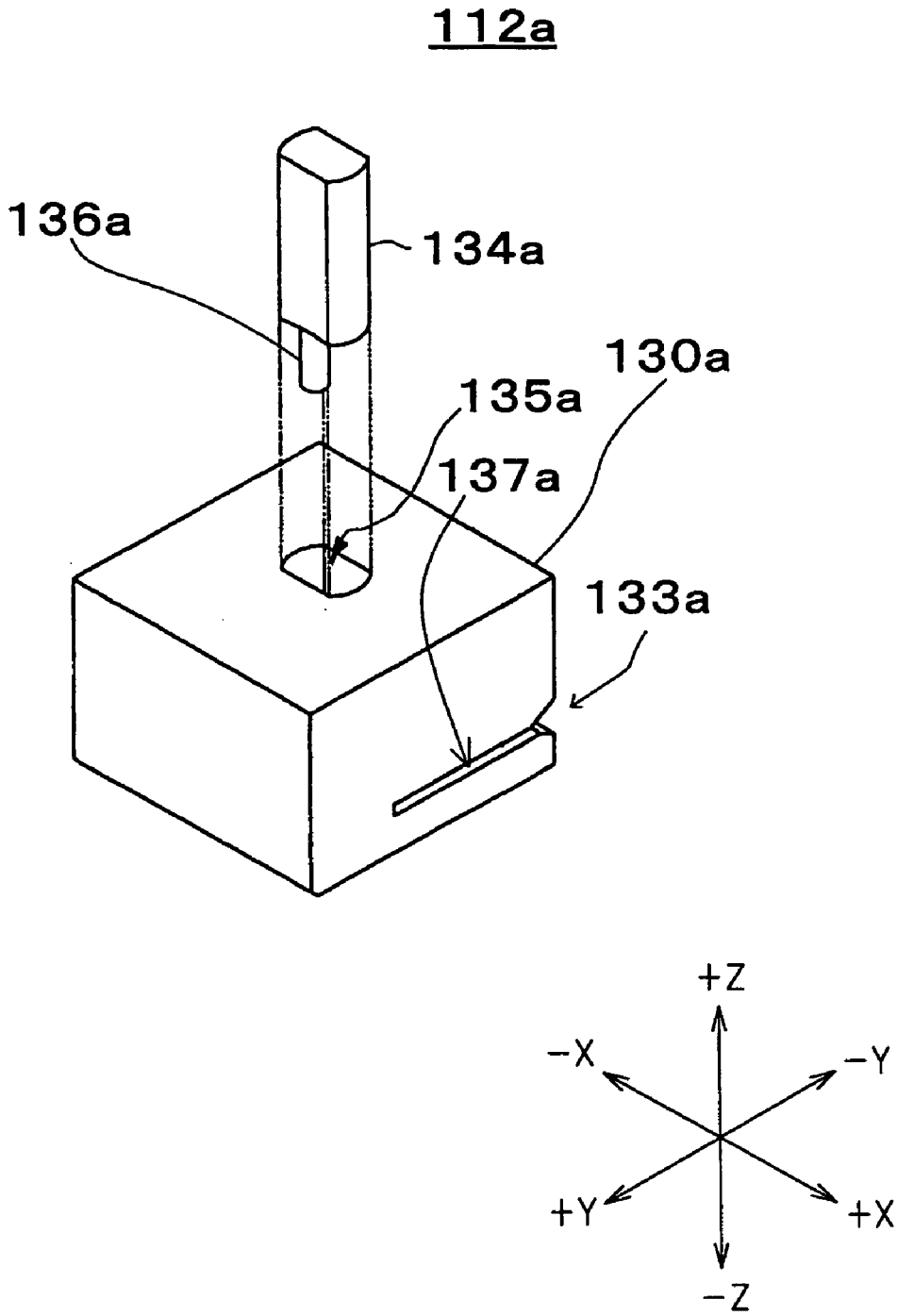

FIG. 13 is a perspective view showing principal parts of the puncher 112*a*. As shown in FIG. 13, the puncher 112*a* comprises a main body 130*a* having a through hole 135*a* formed therein for receiving an elongated punch 134*a* moving up and down. The through hole 135*a* extends from the upper surface of the main body 130*a* through the main body 130*a*. A reference pin 136*a* is attached to the forward end of the elongated punch 134*a*. The reference pin 136*a* moves up and down together with the elongated punch 134*a*. Since the through hole 135*a* is formed in a flat surface 137*a* defined by a clearance 133*a*, the reference pin 136*a* can escape to below the flat surface 137*a* when the elongated punch 134*a* moves down. Further, since the through hole 135*a* is formed in the flat surface 137*a* as described above, punching chips resulting from the punching by the elongated punch 134*a* fall through the through hole 135*a* out of the lower surface of the main body 130*a*, and are collected by an additionally prepared collecting mechanism not shown.

The elongated punch 134*a* is mainly used for purposes of punching the escape hole in the leading edge of the plate P fed on the front side, but is sometimes used to punch the positioning hole.

The usage of the elongated punch 134*a* is similar to that of the elongated punch 124*b* of the puncher 111*b* described above. For the formation of the positioning hole, the reference pin 136*a* is previously moved down so as to allow for the positioning of the leading edge of the plate P inserted into the clearance 133*a*. For the formation of the escape hole, on the other hand, the positioning of the plate P along the Y axis may be performed in another location by the reference pin 136*a*.

The elongated punch 134*a* and the reference pin 136*a* are positioned along the Y axis so that the outermost edges thereof as seen in the +Y direction (or on the front side) are aligned. Specifically, the elongated punch 134*a* and the reference pin 136*a* are disposed so that a line connecting the outermost edges thereof as seen in the +Y direction is parallel to the X axis.

The reference pin 136*a* has a perfectly circular sectional configuration with a diameter which is one-half the diameter of the section of the round punch 121*a* (121*b*).

As in the above-mentioned puncher 111*a* (111*b*), the elongated punch 134*a* is vertically moved by a drive mechanism not shown. The adjustment of the vertical position of the elongated punch 134*a* allows the elongated punch 134*a* to move fully downwardly, and allows the reference pin 136*a* to be situated in the clearance 133*a* for positioning of the plate P along the Y axis.

Since the puncher 112*b* of the second movable punch unit 102*b* is similar in construction to the puncher 112*a* of the first movable punch unit 102*a*, the puncher 112*b* will not be described in detail.

The reference pins 126*a*, 126*b* and the reference pins 136*a*, 136*b* are situated so that a line connecting the points at which the reference pins 126*a*, 126*b*, 136*a*, 136*b* make contact with the leading edge of the plate P (corresponding to the outermost edges of the reference pins 126*a*, 126*b*, 136*a*, 136*b* as seen in the −Y direction (or on the rear side)) is parallel to the axis of rotation of the drum 21 (or parallel to the X axis). Thus, the position of the plate P along the Y axis is determined by contact of the plate P with at least two of the reference pins 126*a*, 126*b*, 136*a*, 136*b*. The plate detection sensors 114*a* and 114*b* are situated so as to be able to detect the leading edge of the plate P at a location displaced by a small distance (e.g., 5 to 15 mm) in the −Y direction from the line connecting the outermost edges of the reference pins 126*a*, 126*b*, 136*a*, 136*b* as seen in the −Y direction.

The puncher 113*a* of the first movable punch unit 102*a* and the puncher 113*b* of the second movable punch unit 102*b* are punchers for punching printing holes. It should be noted that two or more punchers may be used to punch the printing holes. The punchers 113*a* and 113*b* may be disposed at different locations than those shown in FIG. 11. The printing holes may be of a variety of configurations such as a round configuration, an elongated configuration, an U-shaped configuration, and a V-shaped configuration. The punchers 113*a* and 113*b* of the image recorder 1 have punches 138*a* and 138*b* for punching round holes.

As discussed above, the plates P of a variety of sizes are mounted to the image recorder 1. It is hence necessary to punch holes in the plate P having different sizes in various locations depending on the sizes. The image recorder 1 according to this preferred embodiment, which can adjust the locations of the punchers 111*a*, 111*b*, 112*a*, 112*b*, 113*a*, 113*b* along the X axis as described above, is required only to comprise a minimum number of punchers.

(Details of Side-to-Side Adjustment Unit 24)

Figure 14:
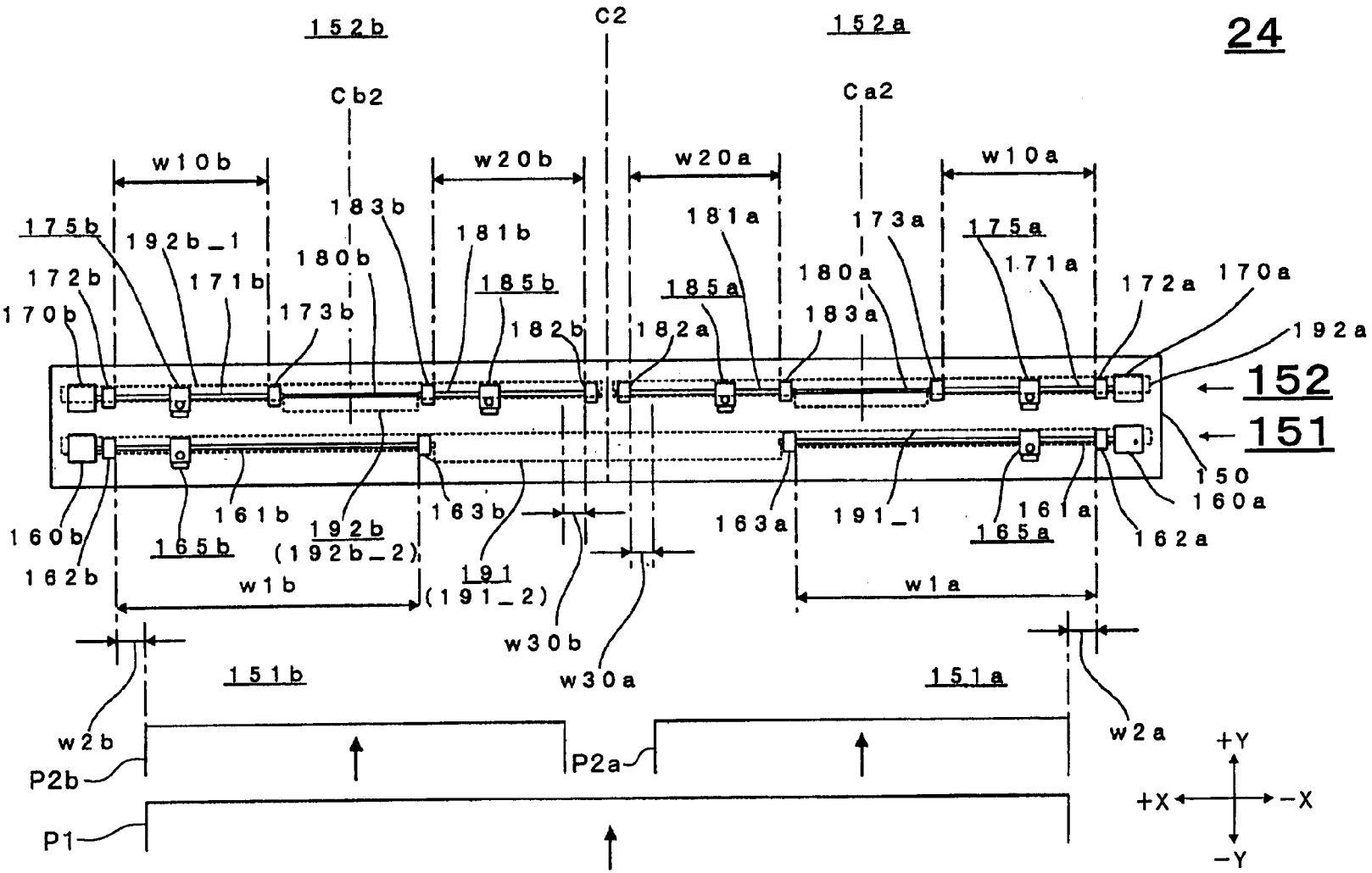
FIG. 14 is a top view of a side-to-side adjustment unit.

FIG. 14 is a plan view of the side-to-side adjustment unit 24. The reference line C2 indicates the X-axis central position of the punch unit 23; the reference line Ca2 indicates the X-axis central position of the first movable punch unit 102*a*; and the reference line Cb2 indicates the X-axis central position of the second movable punch unit 102*b*. A single-mounting plate P1 and double-mounting plates P2*a* and P2*b* to be positioned in the side-to-side adjustment unit 24 are also shown for reference, in addition to the plan view of the side-to-side adjustment unit 24. The plates P1, P2*a* and P2*b* shown in FIG. 14 are plates of the maximum size adaptable for the image recorder 1.

The side-to-side adjustment unit 24 comprises a base 150 provided between the side panels 13*a* and 13*b* of the image recorder 1, and a single-plate side-to-side adjustment unit 151 and a double-plate side-to-side adjustment unit 152 both placed on the base 150.

Figure 16:
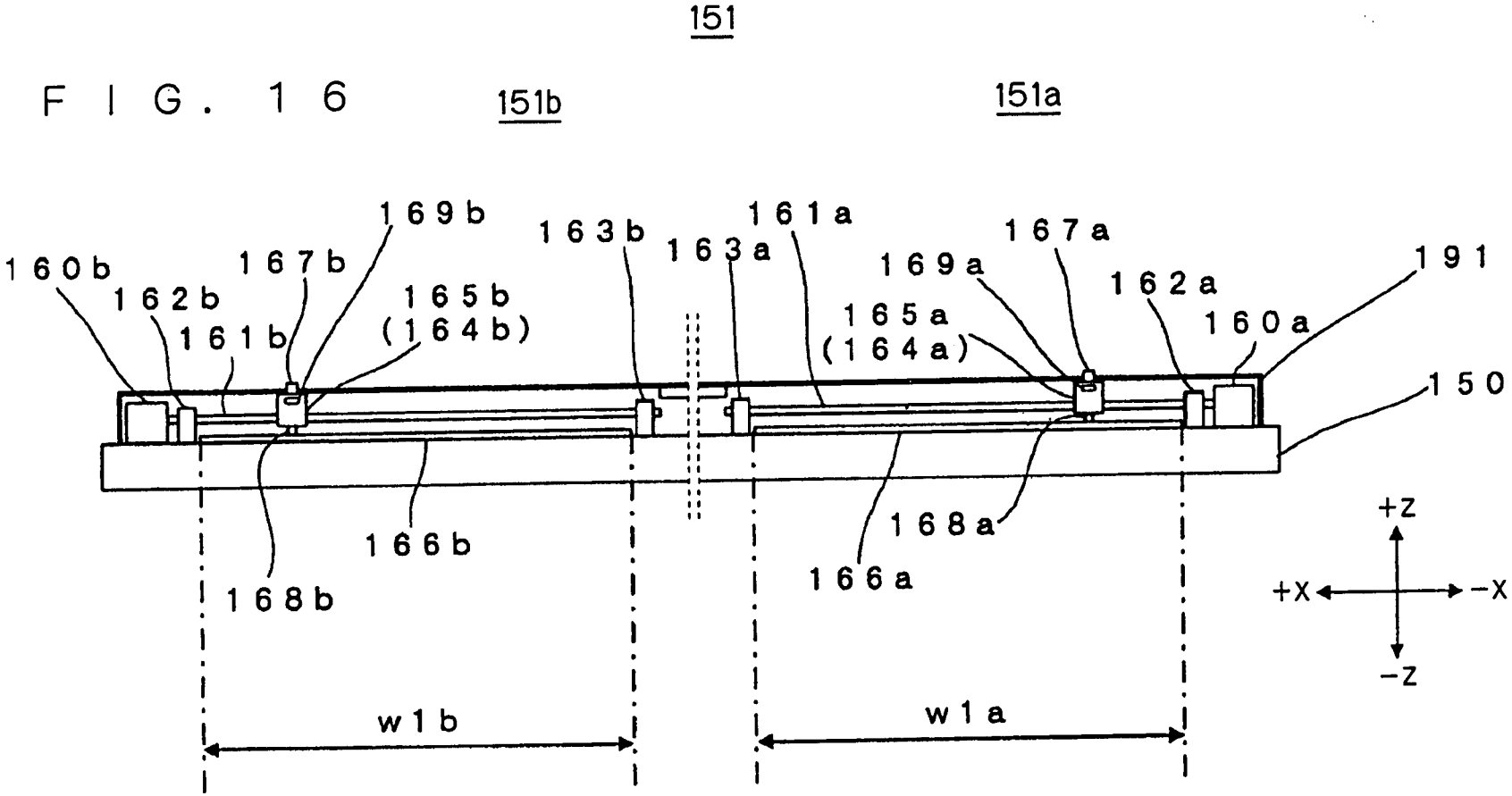
FIG. 16 is a front view of a single-plate side-to-side adjustment unit.

The details of the single-plate side-to-side adjustment unit 151 will be described with reference to FIGS. 14 and 16. FIG. 16 is a view of the single-plate side-to-side adjustment unit 151 as viewed from the rear side of the image recorder 1. A central portion of the single-plate side-to-side adjustment unit 151 is not shown in FIG. 16.

The single-plate side-to-side adjustment unit 151 includes a right-hand roller moving section 151*a* for pressing the home-side edge of the single-mounting plate P1 in the +X direction, a left-hand roller moving section 151*b* for pressing the away-side edge of the plate P1 in the −X direction, and a large guide 191 for guiding the plate P1 to a level (vertical position) high enough for the plate P1 to make contact with side-to-side adjustment rollers 167*a* and 167*b* of the respective right-hand and left-hand roller moving sections 15*la* and 151*b*.

The right-hand roller moving section 151*a* includes: a motor 160*a* fixed on the base 150; a ball screw 161*a* coupled to the driving shaft of the motor 160*a*; bearings 162*a* and 163*a* for rotatably supporting the ball screw 161*a*; a right-hand nut portion 165*a* having a nut body 164*a* in threaded engagement with the ball screw 161*a*; and a support rail 166*a* for preventing the right-hand nut portion 165*a* from rotating about the ball screw 161*a*.

The motor 160*a* is preferably a stepping motor. A sensor for detecting the location of the right-hand nut portion 165*a* is disposed near the bearing 162*a*. The electrical unit 25 generates a control signal, based on the location of the right-hand nut portion 165*a* outputted from the sensor to apply the control signal to the motor 160*a*, thereby precisely moving the right-hand nut portion 165*a* along the X axis.

The side-to-side adjustment roller 167*a* is rotatably attached to the upper surface of the nut body 164*a* of the right-hand nut portion 165*a*. A slider 168*a* moving in the support rail 166*a* is attached to the lower surface of the nut body 164*a*. A plate edge detection sensor 169*a* is attached to the front surface of the nut body 164*a*. A relationship between the support rail 166*a* and the slider 168*a* will be described in detail later.

Since the left-hand roller moving section 151*b* has the same mechanism as the right-hand roller moving section 151*a*, components of the left-hand roller moving section 151*b* are identified by similar reference numerals to the corresponding components of the right-hand roller moving section 151*a* except that a character "b" substituted for "a" is added, and will not be described in detail.

The motors 160*a* and 160*b* of the right-hand and left-hand roller moving sections 151*a* and 151*b* are integrally controlled so that a distance along the X axis (referred to hereinafter as an X-distance) between the side-to-side adjustment roller 167*a* and the reference line C2 is always equal to an X-distance between the side-to-side adjustment roller 167*b* and the reference line C2. It is desirable that the reference line C2 of the punch unit 23 coincides with the X-axis centerline of the drum 21, as discussed above. The movable range of the right-hand nut portion 165*a* is indicated by w1*a* in FIGS. 14 and 16. Specifically the right-hand nut portion 165*a* is movable within the range of the support rail 166*a*. Similarly, the left-hand nut portion 165*b* is movable within the range of the support rail 166*b*, and the movable range is indicated by w1*b*.

As shown in FIG. 14, the home positions (or the outermost movable positions in the side-to-side adjustment unit 24) of the respective right-hand and left-hand nut portions 165*a* and 165*b* are out of the paths of movement of the double-mounting plates P2*a* and P2*b*. In other words, retractable distances w2*a* and w2*b* are greater than the dimensions of the right-hand and left-hand nut portions 165*a* and 165*b* along the X axis. Thus, when the double-mounting plate P2*a* or P2*b* is mounted to the side-to-side adjustment unit 24, retracting the right-hand and left-hand nut portions 165*a* and 165*b* in their home positions prevents the right-hand and left-hand nut portions 165*a* and 165*b* from contacting the plate P2*a* or P2*b*.

(Double-Plate Side-to-Side Adjustment Unit 152)

Figure 17:
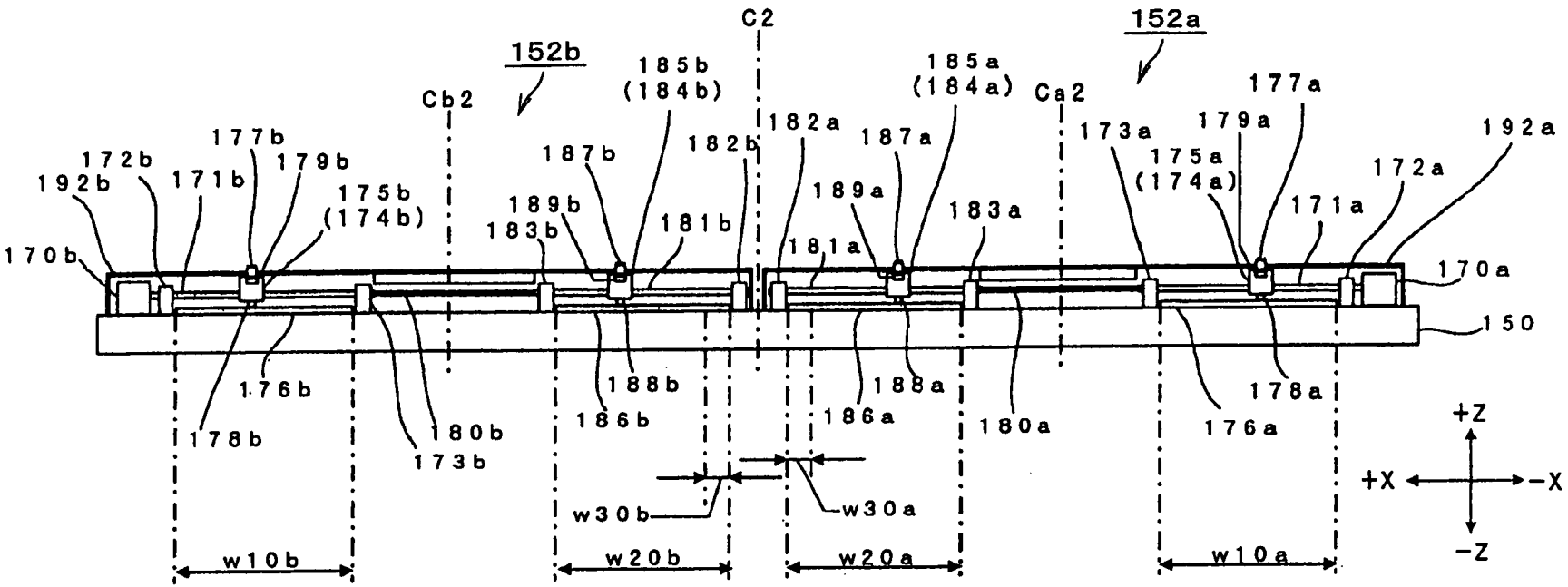
FIG. 17 is a front view of a double-plate side-to-side adjustment unit.

Next, the double-plate side-to-side adjustment unit 152 will be described with reference to FIGS. 14 and 17. FIG. 17 is a view of the double-plate side-to-side adjustment unit 152 as viewed from the rear side of the image recorder 1.

The double-plate side-to-side adjustment unit 152 includes a first side-to-side adjustment section 152*a* for centering the double-mounting plate P2*a* to be mounted in the first plate mounting region 27*a* of the drum 21, and a second side-to-side adjustment section 152*b* for centering the double-mounting plate P2*b* to be mounted in the second plate mounting region 27*b*.

The first side-to-side adjustment section 152*a* includes: a motor 170*a* fixed on the base 150; an outer ball screw 171*a* coupled to the driving shaft of the motor 170*a*; bearings 172*a* and 173*a* for rotatably supporting the outer ball screw 171*a*; an outer nut portion 175*a* having a nut body 174*a* in threaded engagement with the outer ball screw 171*a*; an outer support rail 176*a* for preventing the outer nut portion 175*a* from rotating about the outer ball screw 171*a*; a coupling shaft 180*a* coupled to an end of the outer ball screw 171*a* which is closer to the bearing 173*a*; an inner ball screw 181*a* coupled to the outer ball screw 171*a* through the coupling shaft 180*a*; bearings 182*a* and 183*a* for rotatably supporting the inner ball screw 181*a*; an inner nut portion 185*a* having a nut body 184*a* in threaded engagement with the inner ball screw 181*a*; an inner support rail 186*a* for preventing the inner nut portion 185*a* from rotating about the inner ball screw 181*a*; and a small guide 192*a*.

The threaded direction of the inner ball screw 181*a* is opposite from that of the outer ball screw 171*a*. Thus, the outer and inner nut portions 175*a* and 185*a* in threaded engagement with the respective ball screws 171*a* and 181*a* are moved toward or away from each other by the motor 170*a*. Adjustment is made so that a distance between the outer nut portion 175*a* and the reference line Ca2 is always equal to a distance between the inner nut portion 185*a* and the reference line Ca2. It is desirable that the reference line Ca2 which is the X-axis central position of the first movable punch unit 102*a* coincides with the X-axis centerline Ca1 of the first plate mounting region 27*a*, as discussed above.

The motor 170*a* is preferably a stepping motor. A sensor for detecting the location of the outer nut portion 175*a* is disposed near the bearing 172*a*. The electrical unit 25 generates a control signal, based on the location of the outer nut portion 175*a* outputted from the sensor to apply the control signal to the motor 170*a*, thereby precisely moving the outer and inner nut portions 175*a* and 185*a* along the X axis.

The movable range of the outer nut portion 175*a* is indicated by w10*a* in FIGS. 14 and 17. Specifically, the outer nut portion 175*a* is movable within the range of the outer support rail 176*a*. Similarly, the inner nut portion 185*a* is movable within the range of the inner support rail 186*a*, and the movable range is indicated by w20*a* in FIGS. 14 and 17.

Side-to-side adjustment rollers 177*a* and 187*a* are rotatably attached to the upper surfaces of the nut bodies 174*a* and 184*a* of the outer and inner nut portions 175*a* and 185*a*, respectively. Sliders 178*a* and 188*a* moving in the support rails 176*a* and 186*a* are attached to the lower surfaces of the nut bodies 174*a* and 184*a*, respectively. Plate edge detection sensors 179*a* and 189*a* are attached to the front surfaces of the nut bodies 174*a* and 184*a*, respectively. Relationships between the support rails 176*a*, 186*a* and the sliders 178*a*, 188*a* will be described in detail later.

Since the second side-to-side adjustment section 152*b* has the same mechanism as the first side-to-side adjustment section 152*a*, components of the second side-to-side adjustment section 152*b* are identified by similar reference numerals to the corresponding components of the first side-to-side adjustment section 152*a* except that a character "b" substituted for "a" is added, and will not be described in detail. The center of movement of the outer and inner nut portions 175*b* and 185*b* of the second side-to-side adjustment section 152*b* along the X axis is the reference line Cb2 (the dash-dot line Cb2 in FIGS. 14 and 17) which is the X-axis central position of the second movable punch unit 102*b*. It is desirable that the reference line Cb2 coincides with the X-axis centerline Cb1 of the second plate mounting region 27*b*, as discussed above.

As shown in FIG. 14, the movable ranges w20*a* and w20*b* of the inner nut portions 185*a* and 185*b* overlap the path of movement of the single-mounting plate P1. There is a danger that the inner nut portions 185*a* and 185*b* make contact with the single-mounting plate P1 to hinder the movement of the plate P1. To prevent this, the side-to-side adjustment unit 24 is constructed so that the inner nut portions 185*a* and 185*b* pivot about the ball screws 181*a* and 181*b* within ranges w30*a* and w30*b* (see FIGS. 14 and 17), respectively, to go out of the path of movement of the single-mounting plate P1.

Figure 15:
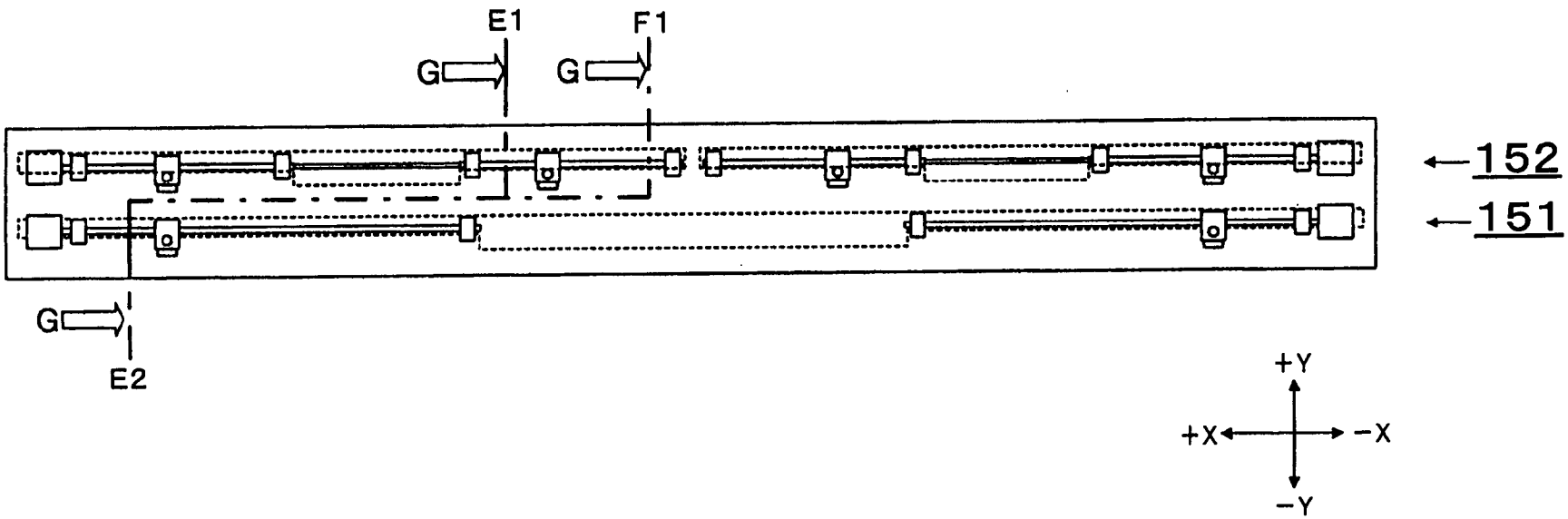
FIG. 15 is a top view illustrating sectional positions of the side-to-side adjustment unit.
Figure 18:
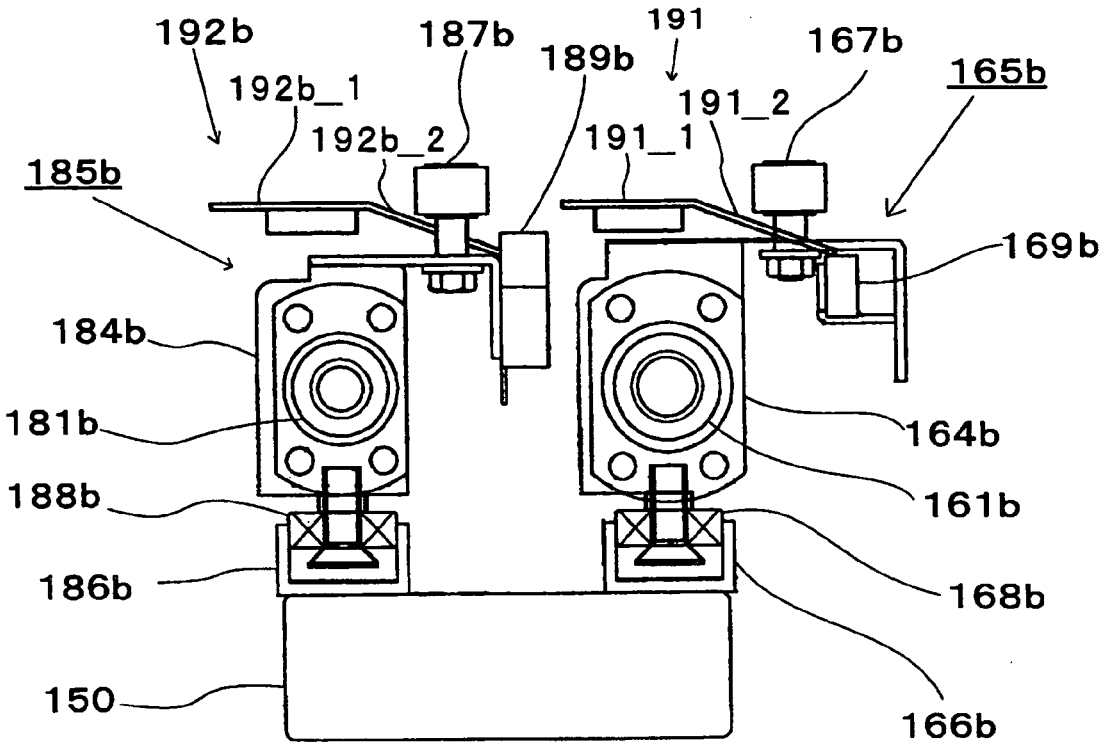
FIG. 18 is a sectional view of the side-to-side adjustment unit taken along the dash-dot lines E1–E2 of FIG. 15 as seen in the direction of the arrow G.
Figure 18:
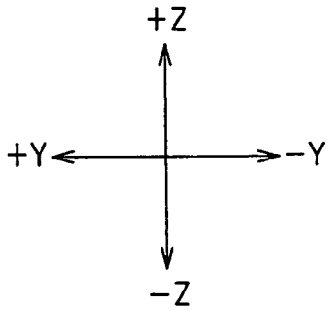
Figure 19:
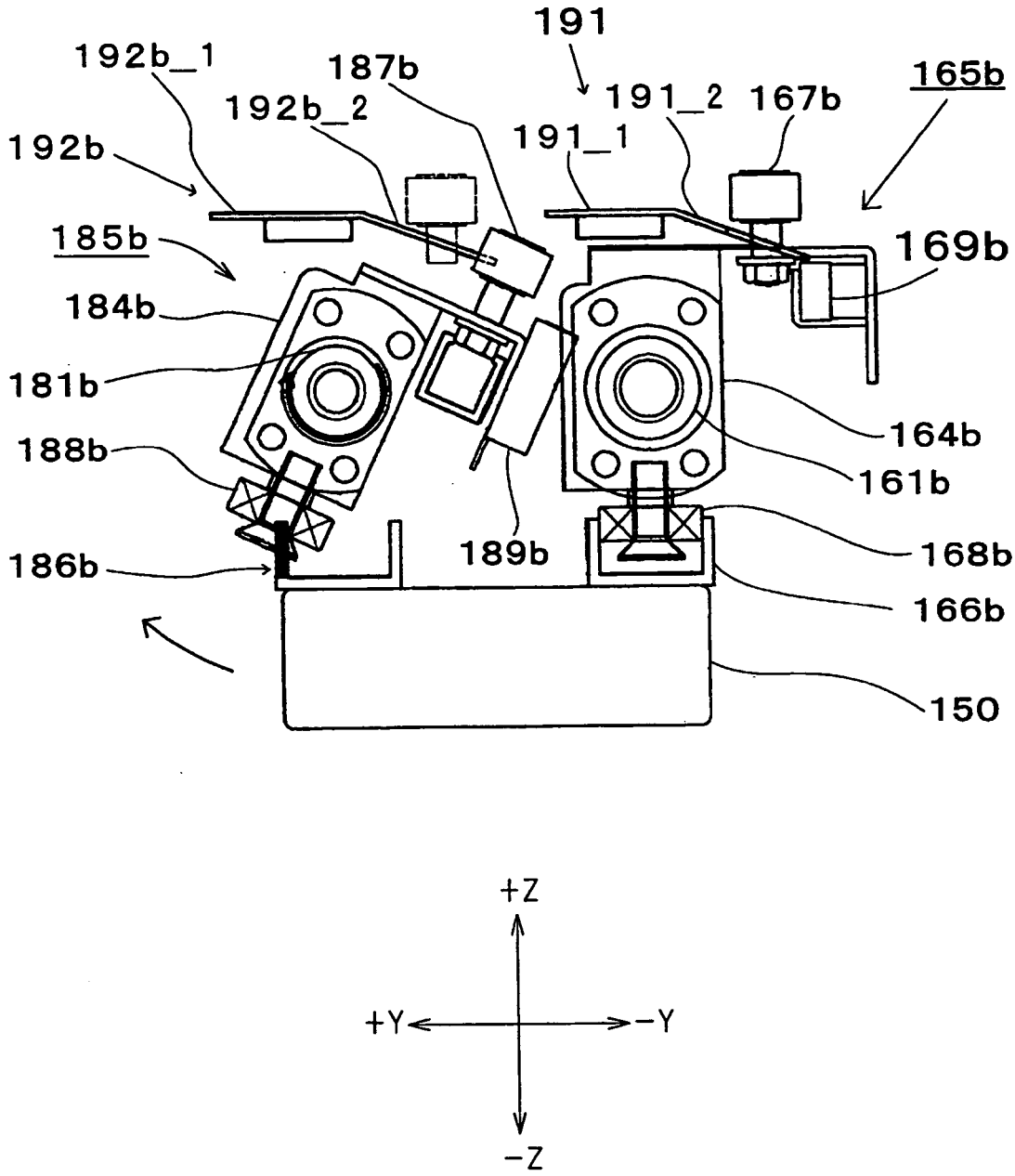
FIG. 19 is a sectional view of the side-to-side adjustment unit taken along the dash-dot lines F1–E2 of FIG. 15 as seen in the direction of the arrow G.

A construction for achieving this will be described with reference to FIGS. 15, 18 and 19. FIG. 15 is a view showing sectional positions of the side-to-side adjustment unit 24. FIG. 18 is a sectional view of the base 150, the single-plate side-to-side adjustment unit 151 and the double-plate side-to-side adjustment unit 152 taken along the lines E1–E2 of FIG. 15 as seen in the direction of the arrow G. FIG. 19 is a sectional view of the base 150, the single-plate side-to-side adjustment unit 151 and the double-plate side-to-side adjustment unit 152 taken along the lines F1–E2 of FIG. 15 as seen in the direction of the arrow G.

The slider 168*b* of the left-hand nut portion 165*b* of the single-plate side-to-side adjustment unit 151 is a bearing supported rotatably (about an axis parallel to the Z axis) by the nut body 164*b*, and moves along the X axis (or in a direction perpendicular to the plane of FIG. 18) while rotating in the support rail 166*b*. The ball screw 161*b* rotates in a clockwise direction as seen in FIG. 18 to produce a driving force for the nut body 164*b*. Since the side surfaces of the support rail 166*b* restrict the rotation of the slider 168*b* about the ball screw 161*b*, the nut body 164*b* does not rotate in operative association with the rotation of the ball screw 161*b*.

The large guide 191 is provided over the left-hand nut portion 165*b*. As illustrated in FIGS. 14 and 18, the large guide 191 has a main body portion 191_1, and a protruding portion 191_2 projecting in the −Y direction. The level (or vertical position) at which the main body portion 191_1 is provided is substantially the same as that of the lower end of the side-to-side adjustment roller 167*b* of the left-hand nut portion 165*b*. It is apparent from FIG. 18 that the protruding portion 191_2 is bent downwardly from the main body portion 191_1. The lower end of the protruding portion 191_2 is adjusted so as to lie under the side-to-side adjustment roller 167*b*, and is capable of raising the plate P to a level high enough for the plate P to make contact with the side-to-side adjustment roller 167*b* to guide the plate P to the main body portion 191_1.

The plate edge detection sensor 169*b* is attached to the rear side of the nut body 164*b*. The plate edge detection sensor 169*b* detects the plate P coming onto the large guide 191.

The slider 188*b* of the inner nut portion 185*b* of the double-plate side-to-side adjustment unit 152 is a bearing supported rotatably (about an axis parallel to the Z axis) by the nut body 184*b*, and moves along the X axis (or in a direction perpendicular to the plane of FIG. 18) while rotating in the inner support rail 186*b*. The inner ball screw 181*b* rotates in a clockwise direction as seen in FIG. 18 to produce a driving force for the nut body 184*b*. Since the side surfaces of the inner support rail 186*b* restrict the rotation of the slider 188*b* about the inner ball screw 181*b*, the nut body 184*b* does not rotate in operative association with the rotation of the ball screw 181*b*.

The small guide 192*b* is provided over the inner nut portion 185*b*. As illustrated in FIGS. 14 and 18, the small guide 192*b* has a main body portion 192*b*_1, and a protruding portion 192*b*_2 projecting in the −Y direction. The level (or vertical position) at which the main body portion 192*b*_1 is provided is substantially the same as that of the lower end of the side-to-side adjustment roller 187*b* of the inner nut portion 185*b*. It is apparent from FIG. 18 that the protruding portion 192*b*_2 is bent downwardly from the main body portion 192*b*_1. The lower end of the protruding portion 192*b*_2 is adjusted so as to lie under the side-to-side adjustment roller 187*b*.

The plate edge detection sensor 189*b* is attached to the rear side of the nut body 184*b*. The plate edge detection sensor 189*b* detects that the plate P passed over the large guide 191 comes onto the small guide 192*b*.

FIG. 19 is a sectional view within the pivotal retractable range w30*b* shown in FIG. 14. Within the pivotal retractable range w30*b* as shown in FIG. 19, a side surface of the inner support rail 186*b* on the front side is cut. This removes the restriction on the rotation by the inner support rail 186*b* within the pivotal retractable range w30*b*, which has been imposed in other ranges, to cause the inner nut portion 185*b* to pivot in the clockwise direction in operative association with the rotation of the inner ball screw 181*b*. Then, the side-to-side adjustment roller 187*b* is situated below the plate P when loaded. Therefore, the side-to-side adjustment roller 187*b* does not interfere with the plate P.

(Electrical Unit 25)

The electrical unit 25 is mounted to the frame 11 of the image recorder 1, as shown in FIG. 3. The electrical unit 25 is electrically connected to the above-mentioned components of the image recorder 1, and controls the operations of the image recorder 1 while sending and receiving signals to and from the components.

(General Sequence)

Plate handling in the image recorder 1 will be described below. As discussed above, the drum 21 of the image recorder 1 is capable of mounting thereon one single-mounting plate P1, one double-mounting plate P2 or two double-mounting plates P2 at the same time. Details of the plate handling, e.g. the operations of the punch unit 23 and the side-to-side adjustment unit 24, differ depending on whether one single-mounting plate P1, one double-mounting plate P2 or two double-mounting plates P2 are mounted on the drum 21. Therefore, common plate handling independent of the number and sizes of plates will be described first with reference to FIGS. 20 through 29 and FIGS. 30 through 33.

FIGS. 20 through 29 are schematic views showing the pivotal operation of the plate feed/discharge unit 20 in respective steps. FIGS. 30 through 33 are flowcharts showing a sequence of the plate handling.

The states of the components in the initial step of the operation of introducing a plate P onto the plate feed/discharge unit 20 are as follows. The angular position of the plate feed/discharge unit 20 is the plate loading position. The suction pad slide mechanism 54 moves the suction pad lifting mechanism 52 in the directions D1 and D2 so that the suction pads 47 can fix by suction the leading edge portion of the plate P being transported from the entrance roller pair 45. The suction pad lifting mechanism 52 maintains the suction pads 47 in the lowered position. The nip roller 462 of the loading transport roller pair 46 of the upper tray 41 is urged toward the transport roller 461 (which state is referred to as a nip ON state) (See FIG. 9*b*).

The drum 21 is rotated to- and stopped at a plate receiving position. When the plate feed/discharge unit 20 is pivoted to the plate feed/discharge position with the drum 21 in the plate receiving position, a tangent line to the loading transport roller pair 46 of the upper tray 41 intersects the positioning pins provided upright on the drum 21. The pressing portions 310 of the leading edge clamp 31 on the surface of the drum 21 are open by the leading edge clamp opening/closing mechanism not shown.

In the side-to-side adjustment unit 24, all of the nut portions 165*a*, 165*b*, 175*a*, 175*b*, 185*a* and 185*b* are retracted to their home positions.

Figure 30:
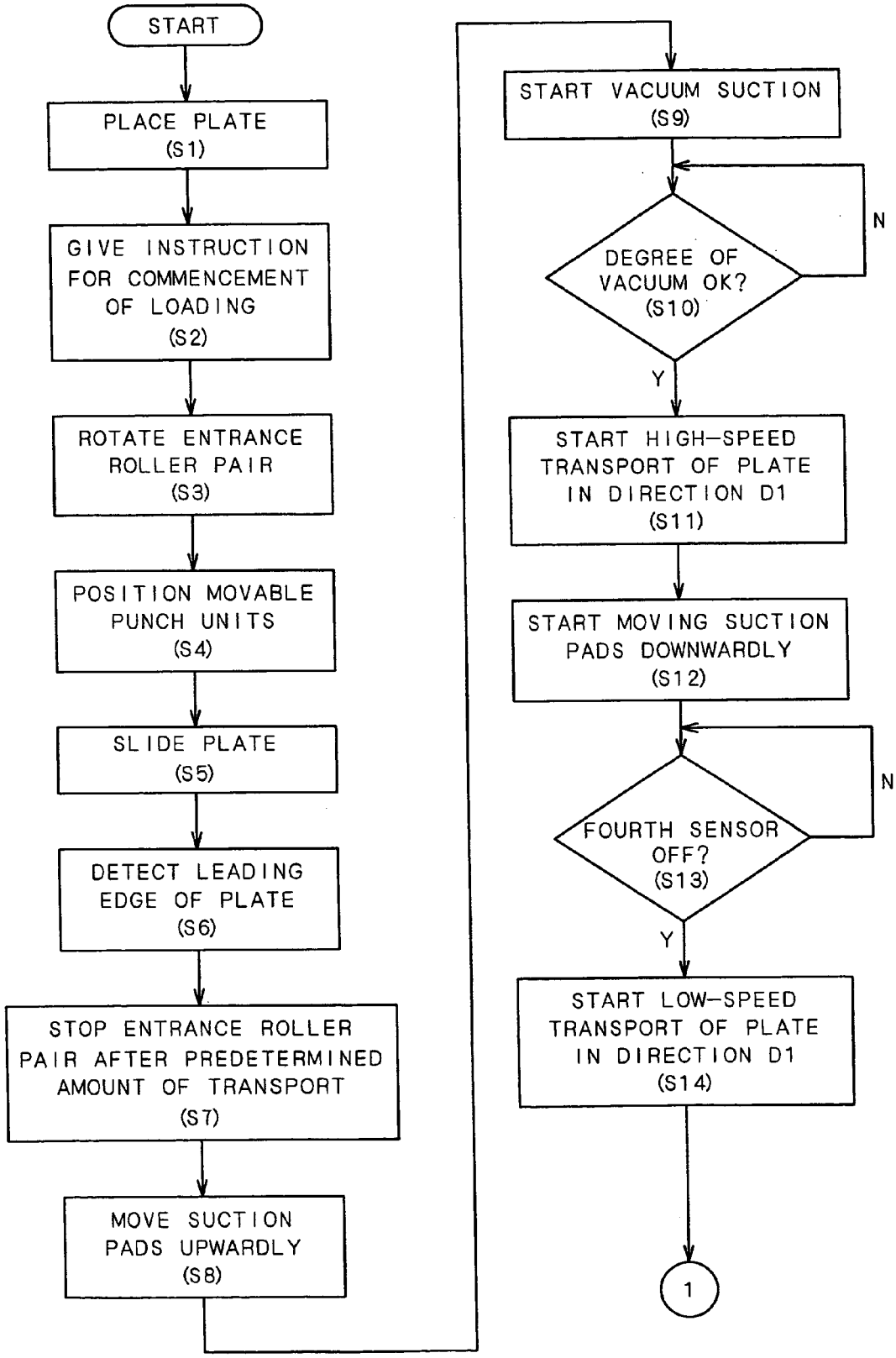
FIGS. 30 through 33 are flowcharts illustrating plate handling in the image recorder.

First, an operator places a virgin plate P on the set table 2 (See FIG. 2) (Step S1 of FIG. 30). Next, the operator enters the number and sizes of plates P placed on the set table 2 through the control panel 6 to the image recorder 1, and gives an instruction for the commencement of loading of the virgin plate P to the image recorder 1 (Step S2).

The electrical unit 25 of the image recorder 1 starts the rotation of the entrance roller pair 45 (Step S3).

The electrical unit 25 also drives the motors 107*a* and 107*b* of the punch unit 23 to move the movable tables 110*a* and 10*b* of the first and second movable punch units 102*a* and 102*b* to a location depending on the number and sizes of plates P entered in Step S2 (Step S4).

Figure 20:
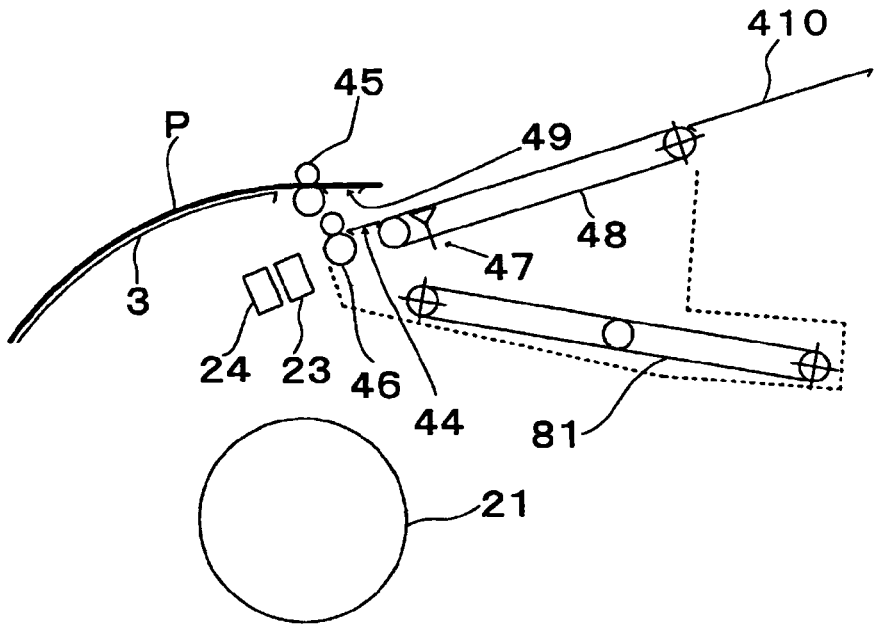
FIGS. 20 through 29 are views illustrating the operation of the plate feed/discharge unit.

Next, the operator slides the plate P along the plate guide 3 to introduce the plate P through the slit 9 (See FIG. 3) formed in the front surface of the image recorder 1 into the image recorder 1. The leading edge of the plate P is inserted between the rotating entrance roller pair 45, and the transport of the plate P is started (Step S5). The plate P is moved toward the upper tray 41 while being supported by the guide panel 49. Such a situation is shown in FIG. 20.

Next, a light beam for object detection emitted from the fourth sensor 78 (See FIG. 9A) is intercepted by the leading edge of the plate P, whereby the fourth sensor 78 turns ON. Thus, the fourth sensor 78 detects the leading edge of the moving plate P (Step S6).

Figure 21:
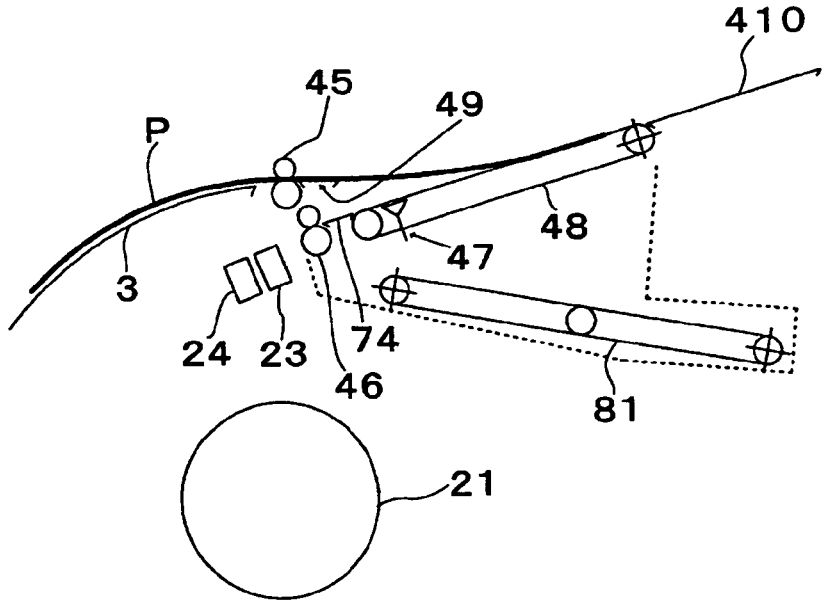

The electrical unit 25 stops the rotation of the entrance roller pair 45 after an elapse of predetermined time since the detection of the leading edge of the plate P by the fourth sensor 78 (Step S7). FIG. 21 shows a situation in which the entrance roller pair 45 is stopped rotating.

The above-mentioned predetermined time until the stop of rotation of the entrance roller pair 45 varies depending on the dimension of the plate P in a feed direction (in which the plate P is transported). This is because the location in which the plate P is supported by suction of the suction pads 47 varies depending on the size of the plate P. Since it is desirable that the suction pads 47 hold by vacuum suction the plate P at a location as close to the leading edge as possible in order to increase the raising efficiency of the plate P by the suction pads 47, a relatively short plate P is so controlled when in use. However, as discussed above, the movable range of the suction pads 47 is shorter than the length of the upper tray 41. For this reason, when a relatively long plate P is used, the suction pads 47 hold by vacuum suction a portion of the plate P which is apart from the leading edge of the plate P. In other words, such an arrangement allows the raising of plates P of all sizes even though the movable range of the suction pads 47 is shorter than the length of the upper tray 41.

Figure 22:
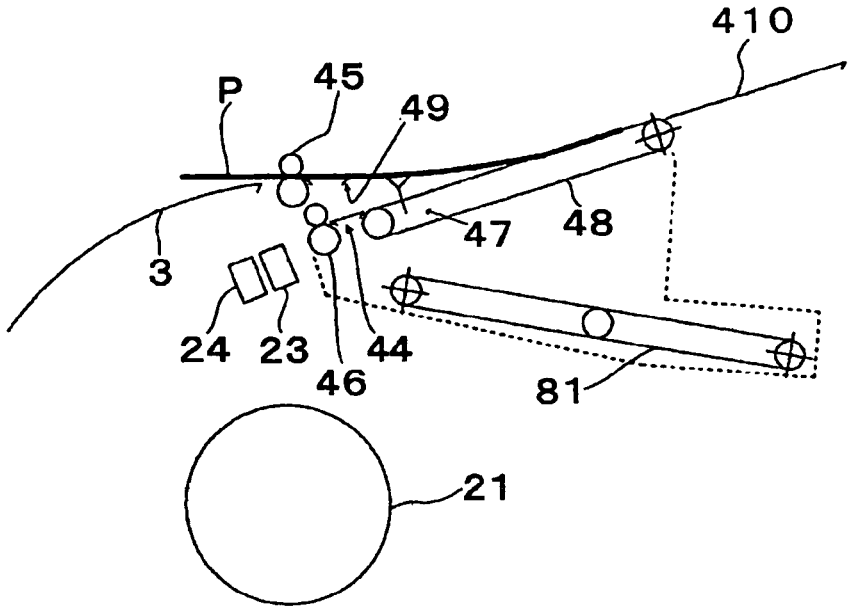

Next, the suction pad lifting mechanism 52 (See FIG. 5) moves the suction pads 47 upwardly to a location at which the suction pads 47 can support the back surface of the plate P by vacuum suction (Step S8). The upward movement of the suction pads 47 is achieved by rotating the eccentric cam 67 to push up the second arm 63, as described with reference to FIG. 6. While being moved upwardly, each of the suction pads 47 pivots about the pin 69 in the direction indicated by the arrow r2 of FIG. 6 so as to be parallel to the back surface of the plate P. FIG. 22 shows such a situation.

Then, the vacuum pump not shown starts the vacuum suction of the suction pads 47 (Step S9), and a sensor not shown measures the degree of vacuum of the suction pads 47. When it is recognized that the plate P is fixed by vacuum suction to the suction pads 47 (Step S10), the operation of raising the plate P onto the upper tray 41 at high speeds is started (Step S11).

In Step S11, the following components perform parallel operation. At the same time that the entrance roller pair 45 feeds out the plate P, the suction pad slide mechanism 54 moves the suction pad lifting mechanism 52 inclusive of the suction pads 47 holding the back surface of the plate P by vacuum suction along the guide member 53 in the direction D1 of FIG. 5. The entrance belt 48 is driven in such a direction as to move the plate P in the direction D1.

The suction pad lifting mechanism 52 gradually moves the suction pads 47 downwardly in operative association with this plate raising operation (Step S12).

The above-mentioned plate raising operation continues until the fourth sensor turns OFF (Step S13). The fourth sensor 78 turns OFF when the trailing edge of the plate P passes over the fourth sensor 78.

After the trailing edge of the plate P passes over the fourth sensor 78, the plate raising operation is changed from the high-speed operation to a low-speed operation (Step S14).

This lessens the impact of the trailing edge of the plate P falling from the guide panel 49 onto the upper tray body 410.

The low-speed plate raising operation in Step S13 continues until the first sensor 75 turns ON. The turning-ON of the first sensor 75 provides recognition of the timing of the fall of the trailing edge of the plate P from the guide panel 49 onto the upper tray body 410.

When the first sensor 75 turns ON (Step S15 of FIG. 31), the plate raising operation is temporarily suspended (Step S16). Then, the high-speed plate raising operation is started again (Step S17). This operation continues until the second sensor 76 (See FIG. 9A) detects the leading edge of the plate P to turn ON.

Figure 23:
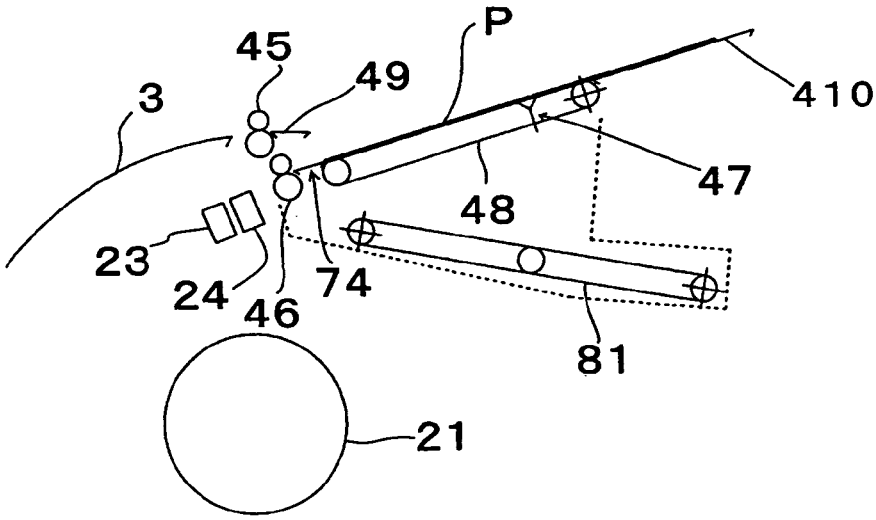

The turning-ON of the second sensor 76 allows recognition that the entire length of the plate P is received by the upper tray 41 of the plate feed/discharge unit 20. FIG. 23 shows such a situation. When the second sensor 76 turns ON (Step S18), the plate raising operation is completed (Step S19).

The image recorder 1 according to this preferred embodiment uses the suction pads 47 which fix the plate P by vacuum suction to raise or pull up the plate P onto the upper tray 41. This ensures the raising of the plate P if the upper tray 41 is inclined at a large angle. Additionally, the image recorder 1 can provide an increased angle of inclination of the upper tray 41, thereby to reduce the footprint of the upper tray 41 as compared with the conventional one.

The suction pads 47 are movable between the vertical position of the upper surface of the upper tray body 410 and a position extended from the upper surface. The use of this function may lessen the impact upon the plate P when the trailing edge of the plate P falls from the guide panel 49 onto the upper surface of the upper tray 41.

Additionally, since the plate P is raised while being fixed by the suction pads 47, the plate P is prevented from meandering while being moved along the upper tray 41.

After the completion of the loading of the plate P on the upper tray 41, the plate feed/discharge unit 20 is pivoted to the punching position (Step S20).

During the pivotal movement of the plate feed/discharge unit 20, the suction pads 47 continue fixing the plate P by vacuum suction. This prevents the plate P from being deviated from its proper position during the pivotal movement of the plate feed/discharge unit 20.

After the completion of the pivotal movement of the plate feed/discharge unit 20 to the punching position, the transport of the plate P in the direction D2 is started (Step S21).

In Step S21, the following components perform parallel operation. The suction pad slide mechanism 54 moves the suction pad lifting mechanism 52 inclusive of the suction pads 47 holding the back surface of the plate P by vacuum suction along the guide member 53 in the direction D2 of FIG. 5. The entrance belt 48 and the loading transport roller pair 46 are driven in such a direction as to move the plate P in the direction D2.

After passing through the guide panel 74, the leading edge of the plate P moves along the large guide 191 and the small guide 192 of the side-to-side adjustment unit 24 (See FIG. 18). When the plate detection sensor 114 (See FIG. 11) provided on the punch unit 23 is turned ON by the leading edge of the plate P to detect that the leading edge of the plate P comes to near the punchers (Step S22), the plate transport operation in the direction D2 is stopped (Step S23).

Next, the motor 465 for the loading transport roller pair 46 is driven to move the nip roller 462 to a location spaced apart from the transport roller 461 (which state is referred to as a nip OFF state). At the same time, the suction pads 47 complete the holding of the plate P by vacuum suction (Step S24). This releases the fixing of the plate P to the upper tray 41.

Next, the plate P is moved in the direction indicated D2 at low speeds for a predetermined length of time (Step S25). This plate transport is carried out only by the entrance belt 48 and the transport roller 461 of the loading transport roller pair 46. The plate P is moved in the direction D2 at low speeds to come into contact with two of the reference pins 126*a*, 126*b*, 136*a* and 136*b* of the punch unit 23. The plate P which has been released from the fixing to the upper tray 41 has flexibility in movement along the X axis and the Y axis. Thus, the plate P slides on the upper tray 41, and the leading edge of the plate P positively comes into contact with the reference pins. All of the nut portions 165, 175 and 185 of the side-to-side adjustment unit 24, which are retracted to their home positions, do not interfere with the movement of the plate P along the guides 191 and 192 of the side-to-side adjustment unit 24. In particular, the inner nut portions 185*a* and 185*b* of the double-plate side-to-side adjustment unit 152, which are pivoted aside at their home positions, do not interfere with the movement of the single-mounting plate P1.

In Step S26, the side-to-side adjustment process is performed on the plate P. When the single-mounting plate P1 is used, the right-hand and left-hand nut portions 165*a* and 165*b* of the single-plate side-to-side adjustment unit 151 are moved at constant speeds from their home positions toward the X-axis center to effect the centering of the plate P1. The centering causes the X-axis center of the single-mounting plate P1 to coincide with the reference line C2 of the punch unit 23. As discussed above, it is desirable that the reference line C2 coincides with the X-axis centerline C1 of the drum 21.

When the double-mounting plate P2 is used, corresponding ones of the outer and inner nut portions 175 and 185 of the double-plate side-to-side adjustment unit 152 are moved at constant speeds from their home positions toward the X-axis center to effect the centering of the plate P2. The centering causes the X-axis center of the plate P2*a* for mounting in the first plate mounting region 27*a* to coincide with the reference line Ca2 of the first movable punch unit 102*a*, and causes the X-axis center of the plate P2*b* for mounting in the second plate mounting region 27*b* to coincide with the reference line Cb2 of the second movable punch unit 102*b*. As discussed above, it is desirable that the reference line Ca2 coincides with the X-axis centerline Ca1 of the first plate mounting region 27*a* and that the reference line Cb2 coincides with the X-axis centerline Cb1 of the second plate mounting region 27*b*.

Next, the pivotal member 463 is pivoted by the motor 465 to move the nip roller 462 toward the transport roller 461. Thus, the plate is held and fixed between the nip roller 462 and the transport roller 461 (Step S27).

Thereafter, the movable punch units 102*a* and 102*b* of the punch unit 23 are used to perform the punching process depending on the number and sizes of plates P (Step S28). The punching process will be detailed later.

Figure 24:
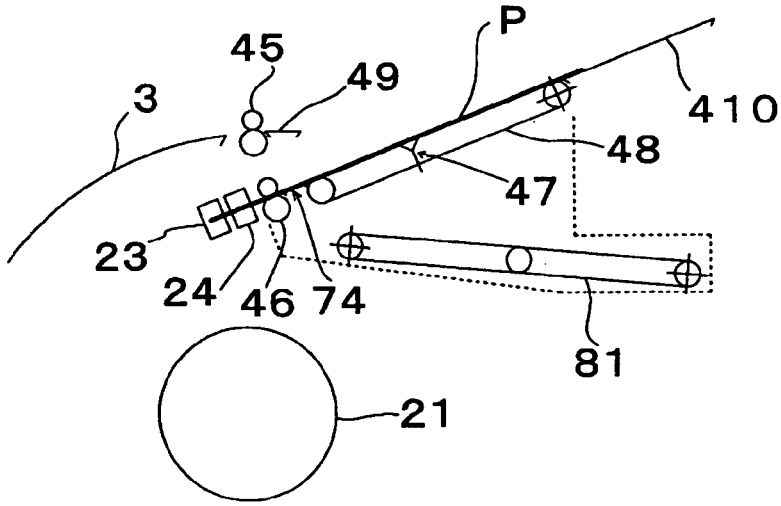

The punching process produces at least a positioning hole and a printing hole in the leading edge of the plate P, and produces an escape hole, as needed. FIG. 24 shows such a situation.

Next, at the same time that the suction pad slide mechanism 54 moves the suction pads 47 in the direction D1, the entrance belt 48 is driven in such a direction as to move the plate P in the direction D1. Thus, the plate P is moved back in the direction D1 (Step S29 of FIG. 32). The moving back of the plate P continues until the leading edge of the plate P as seen in the direction D2 reaches the loading transport roller pair 46. When the third sensor 77 (See FIG. 9A) detects the leading edge of the plate P passing thereover to turn OFF (Step S30), the movement of the plate P in the direction D1 is stopped (Step S31).

Figure 25:
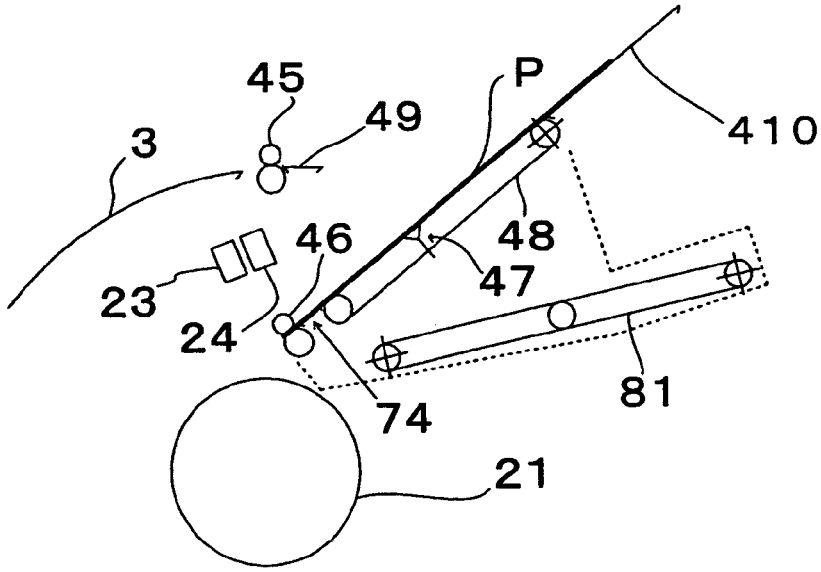

Next, the plate feed/discharge unit 20 is pivoted to the feed/discharge position (Step S32). At this time, the drum 21 is already stopped at the plate receiving position, and the pressing portions 310 of the leading edge clamp 31 are open. FIG. 25 shows such a situation.

Next, the plate P is moved in the direction D2 for a predetermined length of time (Steps S33 through S35). This transport in the direction D2 is carried out initially by driving the entrance belt 48 (in such a direction as to move the plate P in the direction D2) and rotating the loading transport roller pair 46 (Step S33). The loading transport roller pair 46 enters the nip OFF state in midstream (Step S34). Thereafter, the transport is carried out only by driving the entrance belt 48 (Step S35). This is so for purposes of releasing the fixing of the plate P to the upper tray 41 to increase the flexibility in movement of the plate P, thereby easily bringing the positioning hole punched in the leading edge of the plate into engagement with the positioning pin on the drum 21.

The predetermined length of time in Steps S33 through S35 is generally as long as the time required to bring the leading edge of the plate P being transported into contact with the positioning pin provided upright on the outer peripheral surface of the drum 21 to effect the positioning of the plate P.

After the completion of the positioning of the leading edge of the plate P, suction through the suction hole of the drum 21 is started (Step S36). Next, the pressing portions 310 of the leading edge clamp 31 are closed by the action of the leading edge clamp opening/closing mechanism not shown to secure the leading edge of the plate P (Step S37). Next, the drum 21 starts rotating at low speeds (Step S38). This causes the plate P to be gradually wound around the outer peripheral surface of the drum 21. In the winding process step, a squeegee roller may be used to improve the intimate contact of the plate P with the outer peripheral surface of the drum 21 in a manner well known in the art.

The rotation of the drum 21 is stopped when the plate P is wound throughout its length around the outer peripheral surface of the drum 21 (Step S39). Next, the fixing of the trailing edge of the plate P by the trailing edge clamp 32 (Step S40) and the pivotal movement of the plate feed/discharge unit 20 to the plate loading position (Step S41) are carried out concurrently.

If two plates P are placed on the upper tray 41 of the plate feed/discharge unit 20, the operation in Steps S32 through S41 is performed on the two plates P concurrently.

Figure 26:
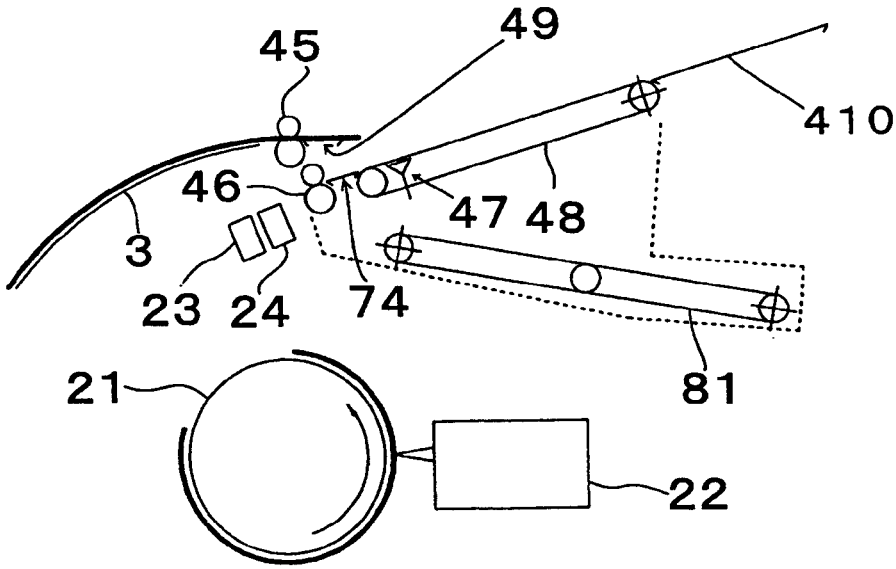

Next, the recording heads 22*a* and 22*b* record an image on the plate P fixed on the outer peripheral surface of the drum 21 (Step S42). The control of the recording heads 22 differs depending on the number and sizes of plates P fixed on the outer peripheral surface of the drum 21. More specifically, when only one double-mounting plate P2 is mounted, the image recording is performed by one of the recording heads 22 corresponding to the plate mounting region 27 in which the plate P2 is mounted. When two double-mounting plates P2 are mounted, the image recording is performed individually by the two recording heads 22. When one single-mounting plate P1 is mounted, the image recording is performed by one or both of the two recording heads 22. FIG. 26 shows such a situation.

While an image is being recorded on the plate P, the next plate P may be loaded to the plate feed/discharge unit 20. In this case, the operation in the steps S1 to S31 is performed concurrently with the image recording on the plate P.

After the completion of the image recording on the plate P mounted on the drum 21, the plate P is subjected to a discharge process. First, the plate feed/discharge unit 20 is pivoted to the feed/discharge position (Step S43 of FIG. 33). Next, the trailing edge clamp opening/closing mechanism not shown causes the trailing edge clamp 32 to release the trailing edge of the plate P (Step S44). Then, the elasticity of the plate P brings the trailing edge of the plate P out of contact with the outer peripheral surface of the drum 21. In this state, the drum 21 is rotated at low speeds in the reverse direction. (Step S45). Next, the discharge belt 81 of the plate feed/discharge unit 20 starts being driven (Step S46).

Figure 27:
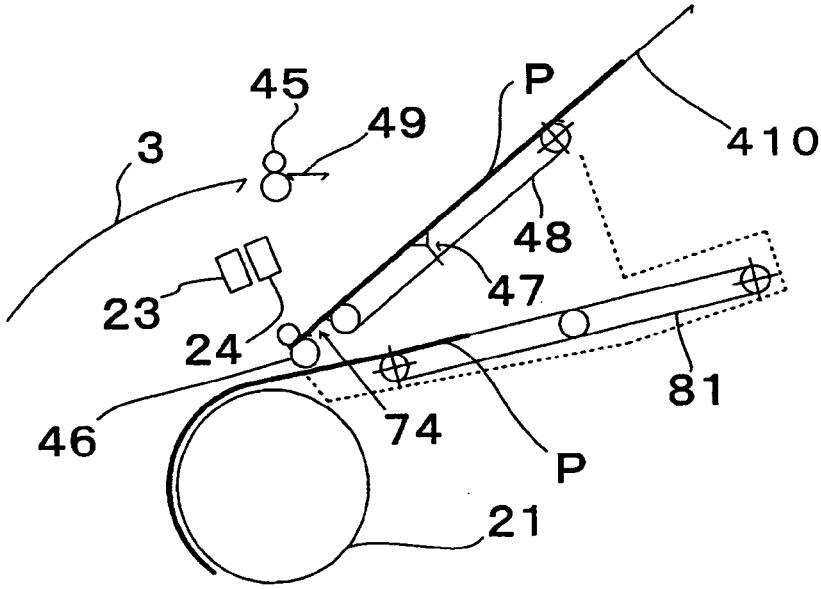

As the drum 21 rotates in the reverse direction, the plate P is discharged onto the discharge belt 81. FIG. 27 shows such a situation. The leading edge clamp 31 is opened in desired timed relation (Step S47) to discharge the plate P throughout its entire length onto the discharge belt 81. Thereafter, the vacuum suction in the drum 21 is stopped (Step S48).

Figure 28:
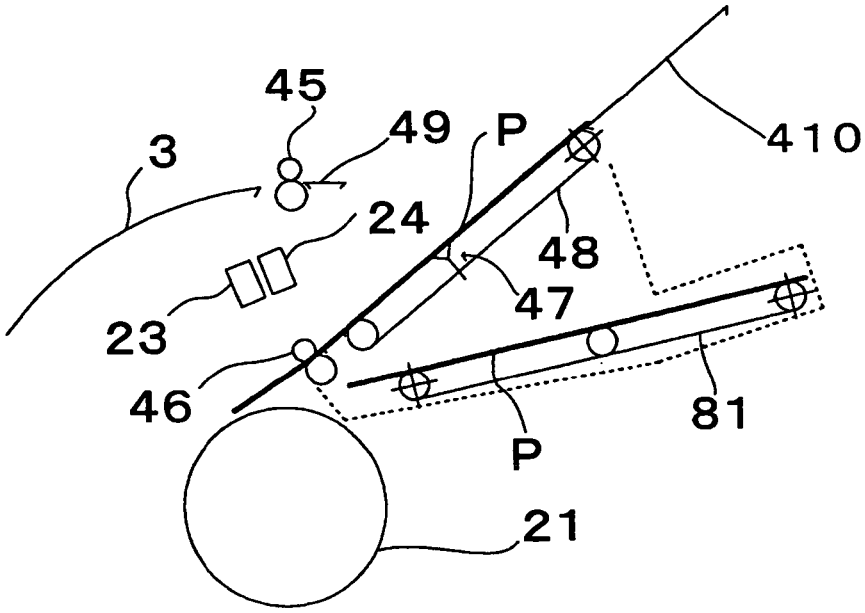

After the plate P is discharged throughout its entire length onto the discharge belt 81, the next plate P placed on the upper tray 41 starts being loaded to the drum 21, as shown in FIG. 28. More specifically, the process starting from Step S32 is performed.

Figure 29:
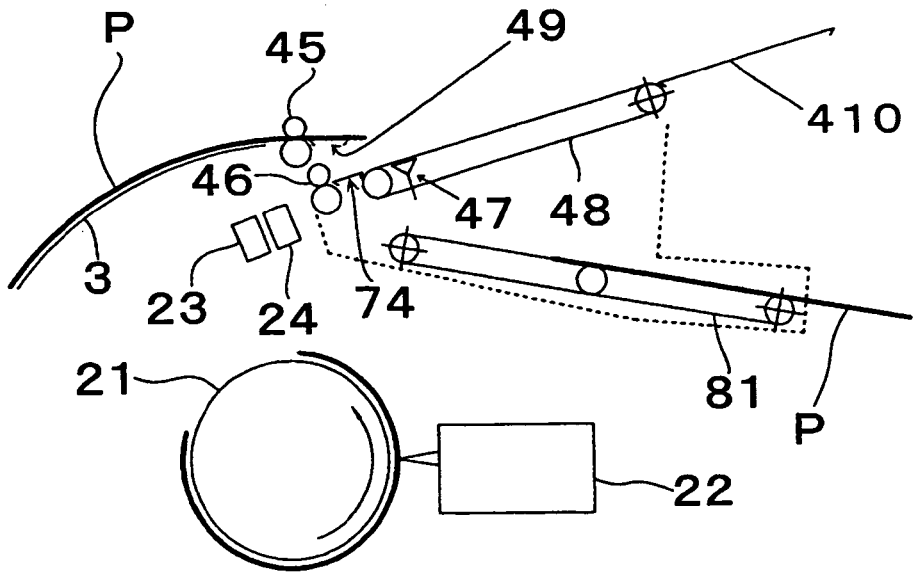

The plate P with an image recorded thereon is discharged from the discharge belt 81 to an automatic development apparatus not shown. FIG. 29 shows such a situation.

(Detailed Description of Punching Process)

Figure 34:
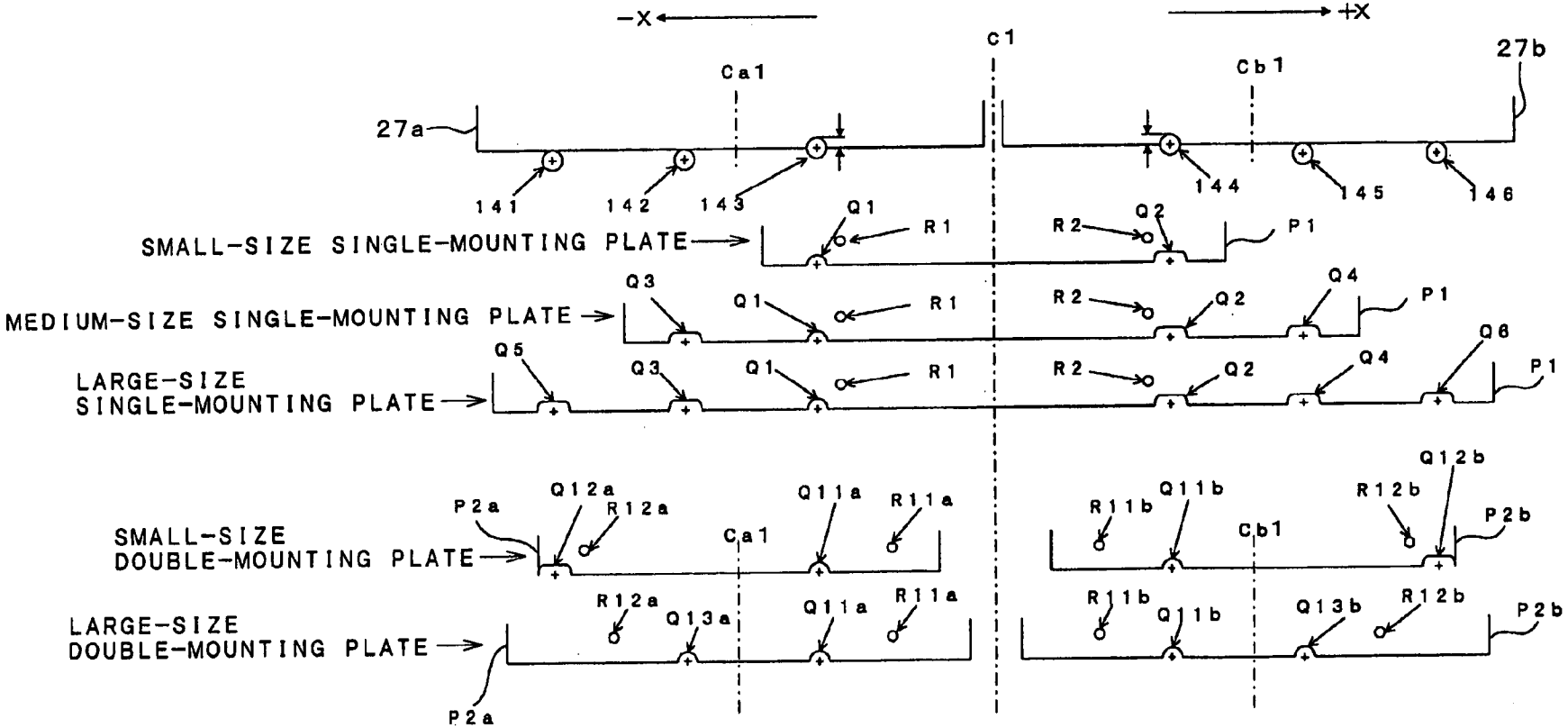
FIG. 34 is a view showing a positional relationship between positioning pins disposed on the surface of a drum, and the number and location of punches during the mounting of one or two plates on the surface of the drum.

Details of the punching process will be described with reference to FIG. 34. FIG. 34 is a schematic view showing a positional relationship between positioning pins 141 to 146 disposed on the surface of the drum 21, and the number and location of punches during the mounting of one or two plates P on the surface of the drum 21.

Referring to FIG. 34, six positioning pins (first to sixth positioning pins 141 to 146) are mounted upright on the surface of the drum 21. Each of the positioning pins 141 to 146 are of a perfectly circular sectional configuration, and has a diameter equal to that of the round punches 121*a* and 121*b* of the punchers 111*a* and 111*b*. The sectional configuration of the pins 141 and 146 need not always be perfectly circular, but may be other configurations so far as a portion of each of the pins 141 to 146 which is to come into contact with the plate P has a curvature equal to that of the holes punched by the round punches 121*a* and 121*b*.

The first to third positioning pins 141 to 143 are disposed on the surface of the drum 21 so as to define one edge of the first plate mounting region 27*a*, and the fourth to sixth positioning pins 144 to 146 are disposed on the surface of the drum 21 so as to define one edge of the second plate mounting region 27*b*.

The first to third positioning pins 141 to 143 and the fourth to sixth positioning pins 144 to 146 are symmetrical with respect to the centerline C1 of the drum 21.

The first to third positioning pins 141 to 143 are equally spaced along the X axis. Likewise, the fourth to sixth positioning pins 144 to 146 are equally spaced along the X axis so that the spacing between adjacent ones of the fourth to sixth positioning pins 144 to 146 is equal to the spacing between adjacent ones of the first to third positioning pins 141 to 143. The spacing between adjacent positioning pins may be set at various values depending on the length of the leading edge of the plate P to be used, and need not be limited to the above-mentioned spacing.

The first, second, fifth and sixth positioning pins 141, 142, 145 and 146 are at the same location as seen in the circumferential direction of the drum 21. The third and fourth positioning pins 143 and 144 are spaced a distance corresponding to the radius of the pins 141 to 146 in the backward direction of the rotation of the drum 21 apart from the first, second, fifth and sixth positioning pins 141, 142, 145 and 146.

The X-axis distance from the centerline C1 of the drum 21 to the third positioning pin 143 is equal to that from the centerline C1 to the fourth positioning pin 144.

Selectively bringing the first to sixth positioning pins 141 to 146 into contact with the leading edge of the plate P fed from the upper tray 41 of the plate feed/discharge unit 20 allows the positioning of plates P having a variety of sizes on the drum 21. The pressing portions 310 of the above-mentioned leading edge clamp 31 are mounted to the drum 21 so as to be able to press the leading edge of the plate P positioned by the positioning pins 141 to 146.

There are shown in FIG. 34 the configurations of the holes punched in the leading edges of plates P (P1, P2*a*, P2*b*) and the positioning pins 141 to 146 for contact with the leading edges of the plates P (P1, P2*a*, P2*b*) in respective techniques of mounting the plates P. The plates P shown herein include single-mounting plates P1 of small, medium and large sizes, and double-mounting plates P2*a*, P2*b* of small and large sizes.

In the image recorder 1, only two of the positioning pins are brought into contact with the leading edge of the plate P during the positioning of the plate P. At least one of the two positioning pins is brought into engagement with a semicircular hole punched by the round punch 121. The other positioning pin is brought into loose engagement with an elongated hole punched by the elongated punch 124 so as to contact a straight portion of the elongated hole or is brought into contact with a straight portion of the leading edge of the plate in which no holes are punched.

As shown in FIG. 34, elongated escape holes Q3, Q4, Q5, Q6, Q12*a*, Q12*b* or semicircular escape holes Q13*a*, Q13*b* are punched in portions of the leadings edges of the plates P which have the possibility of interfering with any one of the positioning pins 141 to 146. Thus, every plate P is positioned so that the leading edge thereof is parallel to the axial direction of the drum 21.

The small-size single-mounting plate P1 refers to a plate P1 having an X-axis dimension sufficiently less than the spacing between the second and fifth positioning pins 142 and 145.

The medium-size single-mounting plate P1 refers to a plate P1 having an X-axis dimension equal to or greater than the maximum length of the leading edge of the small-size single-mounting plate P1 and sufficiently less than the spacing between the first and sixth positioning pins 141 and 146. The plate P1 of this size is punched with the elongated escape holes Q3 and Q4 since there is a danger that opposite end portions of the leading edge thereof make contact with the second or fifth positioning pin 142 or 145.

The large-size single-mounting plate P1 refers to a plate P1 having an X-axis dimension equal to or greater than the maximum length of the leading edge of the medium-size single-mounting plate P1. The plate P1 of this size is punched with the elongated escape holes Q5 and Q6 in addition to the elongated escape holes Q3 and Q4 since there is a danger that opposite end portions of the leading edge thereof make contact with the first or sixth positioning pin 141 or 146.

The single-mounting plate P1 of any size is positioned on the drum 21 by bringing a round hole punched therein into engagement with the third positioning pin 143 and bringing an elongated hole punched therein into loose engagement with the fourth positioning pin 144. As required, one or more elongated holes are punched as the escape hole(s). As discussed above, the third and fourth positioning pins 143 and 144 are forward of the other positioning pins as seen in the plate feed direction. Thus, if the positioning holes and the escape holes are equal in depth (or a dimension of the hole in the circumferential direction of the drum), the leading edge of the plate P at the positioning holes makes contact with the positioning pins earlier than at the remaining portions. Therefore, the leading edge of the plate P does not contact the other positioning pins not to be used for the positioning of the plate P.

The small-size double-mounting plate P2 (P2*a*) for mounting in the first plate mounting region 27*a* refers to a plate P2 having an X-axis dimension equal to or greater than that which allows the positioning of the plate using the second and third positioning pins 142 and 143 and less than that which ensures the positioning of the plate using the first and third positioning pins 141 and 143.

The large-size double-mounting plate P2 (P2*a*) for mounting in the first plate mounting region 27*a* refers to a plate P2 having an X-axis dimension equal to or greater than that which ensures the positioning of the plate using the first and third pins 141 and 143.

The definition of the small and large sizes of the double-mounting plates P2 (P2*b*) for mounting in the second plate mounting region 27*b* will be omitted herein by reference to the above description.

Each single-mounting plate P1 is punched with printing holes R1 and R2. The double-mounting plate P2*a* for mounting in the first plate mounting region 27*a* is punched with printing holes R11*a* and R12*a*. The double-mounting plate P2*b* for mounting in the second plate mounting region 27*b* is punched with printing holes R11*b* and R12*b*.

The spacing between the printing holes shown is given merely as an example. When plates are fed from the same image recorder to a plurality of types of printing apparatuses (e.g., when the printing apparatuses are selectively used depending on the plate size), the spacing between the printing holes may be changed for each printing apparatus. The image recorder 1 according to this preferred embodiment, which comprises the punch unit 23 capable of adjusting the locations of the punches along the X axis, can easily make such change in location of the printing holes.

As discussed above, the image recorder 1 produces the punched holes Q1 to Q6, Q11*a*, Q11*b*, Q12*a*, Q12*b*, Q13*a*, Q13*b* in addition to the printing holes. To produce these punched holes, punching is required at a maximum of six locations for the holes (for the large-size single-mounting plate P1) except the printing holes. The image recorder 1 can easily perform the punching at the six locations since all of the punchers are movable and each of the two punchers 111*a* and 111*b* among the four punchers 111*a*, 111*b*, 112*a* and 112*b* has two punches.

The punching process (or the operation corresponding to Step S28 of FIG. 31) will be detailed for each size of the plates P.

(Punching Process for Small-Size Single-Mounting Plate P1)

Figure 35:
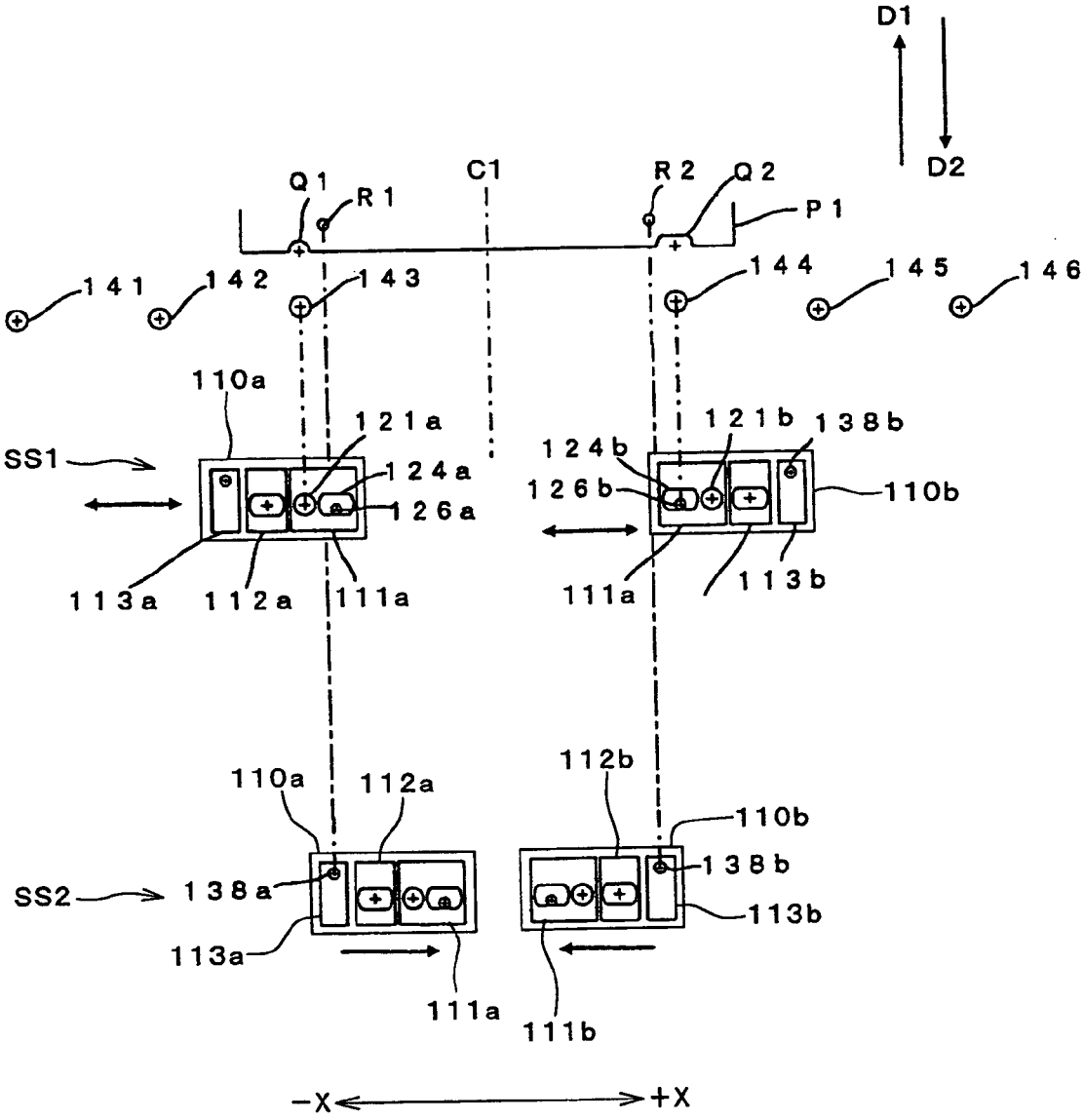
FIG. 35 is a view showing a positional relationship between a small-size single-mounting plate and the positioning pins, and a positional relationship between the punchers when punching the small-size single-mounting plate.

FIG. 35 is a view showing a positional relationship between the small-size plate P1 on the drum 21 and the positioning pins, and a movement direction of and a positional relationship between the punchers 111 to 113 when punching the plate P1 (in operating states SS1 and SS2). As shown in FIG. 35, the leading edge of the plate P1 is punched with the semicircular positioning hole Q1 and the elongated positioning hole Q2. The hole Q1 is for engagement with the third positioning pin 143, and the hole Q2 is for loose engagement with the fourth positioning pin 144. The leading edge of the plate P1 is further punched with the printing holes R1 and R2 to be used in printing operation in a subsequent step or the like.

The operating state SS1 of FIG. 35 shows the movement direction of and positional relationship between the punchers 111 to 113 in the operation of Step S4 described above with reference to FIG. 30. This operation moves the movable tables 110*a* and 110*b* of the punch unit 23 to the locations depending on the number and sizes of the plates P, and moves down the reference pins. The heavy arrows in FIG. 35 indicate that the movable tables 110*a* and 110*b* are moving along the X axis in this step.

Figure 36:
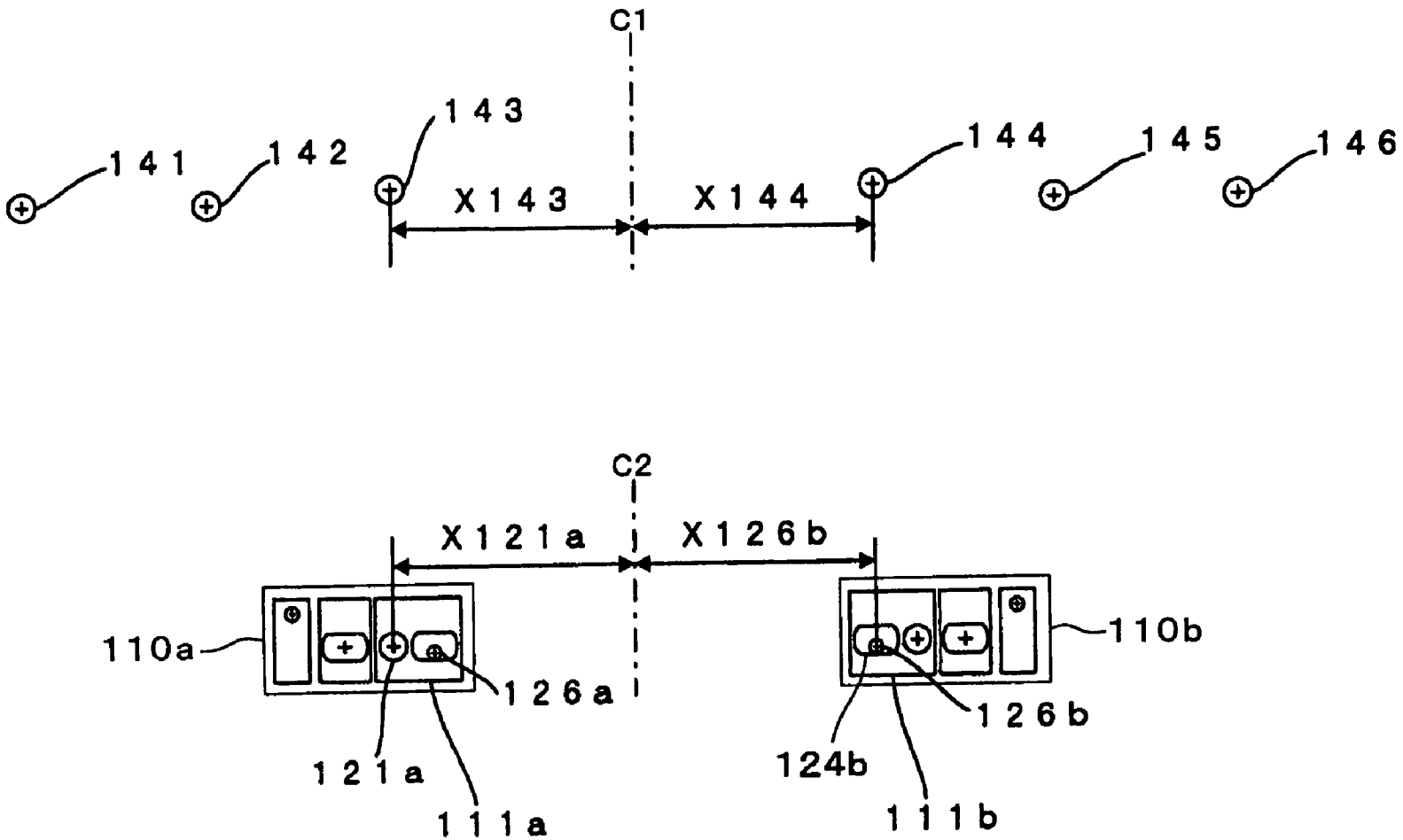
FIG. 36 is a schematic view showing a positional relationship between the punches, reference pins and the positioning pins.
Figure 37:
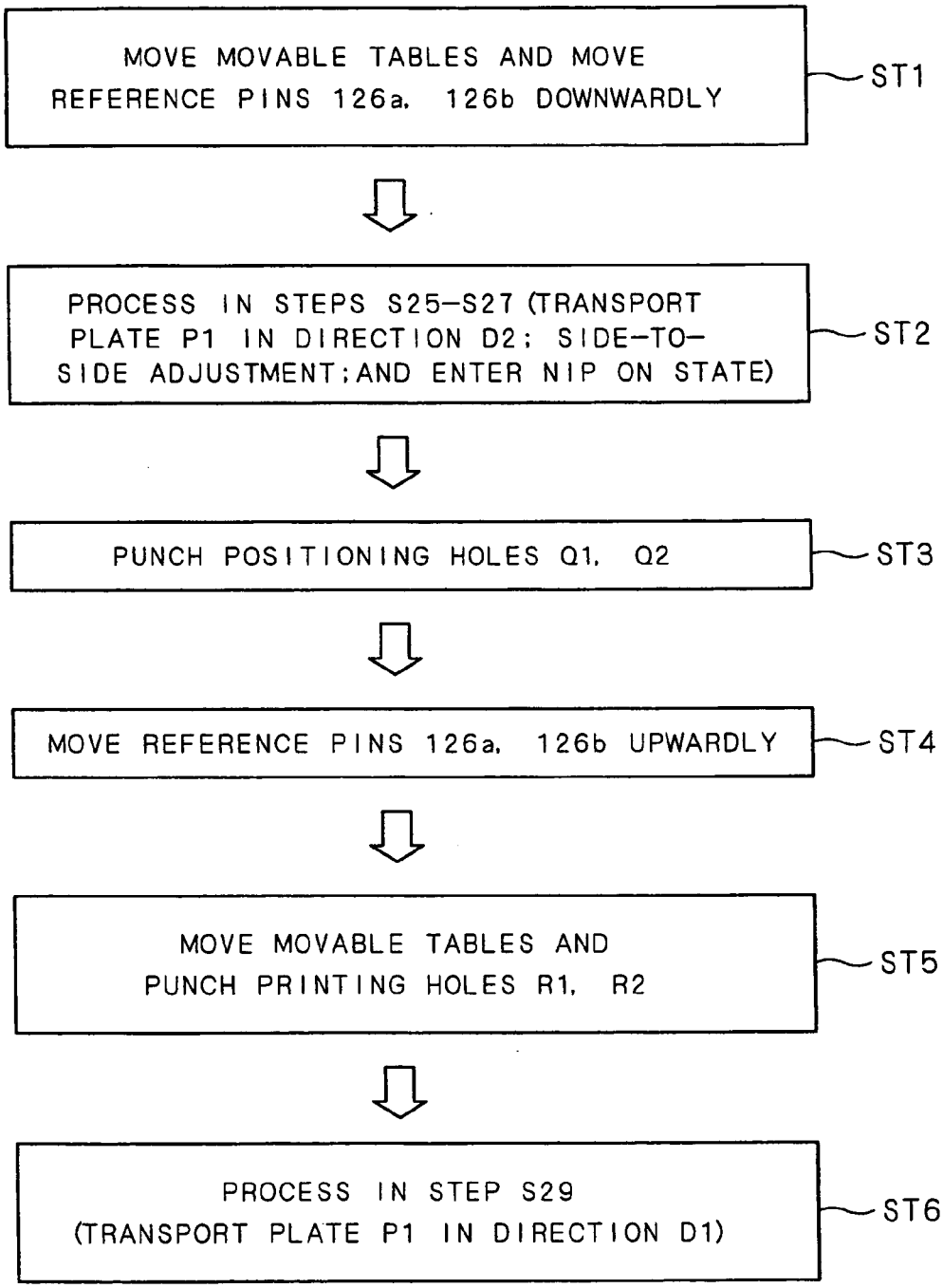
FIG. 37 illustrates the operation of punching holes in the small-size single-mounting plate in time sequence.

The operating state SS1 will be described in detail with reference to FIGS. 36 and 37. FIG. 36 is a view showing a positional relationship between the first to sixth positioning pins 141 to 146 on the drum 21 and the punchers 111*a* and 111*b* when punching the holes Q1 and Q2. FIG. 37 is a diagram illustrating the operation for punching the holes Q1, Q2, R1 and R2 in time sequence. The heavy open arrows in FIG. 37 indicate the passage of time.

For the small-size single-mounting plate P1, the movable table 110*a* of the first movable punch unit 102*a* moves, thereby to move the punchers 111*a*, 112*a*, 113*a* along the X axis as indicated by the left-hand arrow at the operating state SS1 as seen in FIG. 35. This moves the punchers 111*a*, 112*a*, 113*a* to such a location that an X-axis distance x121*a* from the center of the round punch 121*a* to the reference line C2 of the punch unit 23 is equal to an X-axis distance x143 from the center of the third positioning pin 143 to the centerline C1 of the drum 21, as illustrated in FIG. 36.

At the same time, the movable table 110*b* of the second movable punch unit 102*b* moves, thereby to move the punchers 111*b*, 112*b*, 113*b* to such a location that an X-axis distance xl26*a* from the center of the reference pin 126*b* to the reference line C2 of the punch unit 23 is approximately equal to an X-axis distance x144 from the center of the fourth positioning pin 144 to the centerline C1 of the drum 21. That is, the punchers 111*b*, 112*b*, 113*b* move along the X axis as indicated by the right-hand arrow at the operating state SS1 as seen in FIG. 35.

Next, a drive mechanism not shown of the puncher 111*a* moves the reference pin 126*a* down to the level of the clearance 123*a* (See FIG. 12). Similarly, in the puncher 111*b*, the reference pin 126*b* is moved down to the level of the clearance 123*b* (See FIG. 12). The operation described heretofore corresponds to a process ST1 shown in FIG. 37.

Next, a process ST2 corresponding to Steps S25 through S27 is performed. Specifically, the step of transporting the plate P1 at low speeds until the leading edge of the plate P1 comes into contact with the reference pins 126*a*, 126*b* (Step S25), the side-to-side adjustment step (Step S26), and the step of entering the nip ON state (Step S27) are carried out in succession.

This achieves the positioning of the leading edge of the plate P with respect to the punch unit 23.

Next, the round punch 121*a* of the puncher 111*a* punches the semicircular positioning hole Q1 in the leading edge of the plate P1. At the same time, the elongated punch 124*b* of the puncher 111*b* punches the elongated positioning hole Q2 in the leading edge of the plate P1 (in a process ST3).

Next, the reference pins 126*a* and 126*b* are moved upwardly to above the clearances 133*a* and 133*b*, respectively (in a process ST4).

The operating state SS1 is now completed, and then the operating state SS2 starts. In the operating state SS2, the first and second movable punch units 102*a* and 102*b* move, thereby to move the punchers 113*a* and 113*b* to such locations (shown at the operating state SS2 of FIG. 35) in which the punchers 113*a* and 113*b* can punch the printing holes R1 and R2, respectively. That is, the punchers 113*a* and 113*b* move along the X axis as indicated by the arrows at the operating state SS2 of FIG. 35. Next, in the locations at which the movement is completed, the punchers 113*a* and 113*b* are driven to punch the printing holes R1 and R2 in the plate P1 (in a process ST5).

When the punchers 113*a* and 113*b* in the locations shown in FIG. 36 can punch the printing holes R1 and R2, it is not necessary to move the movable tables 110*a* and 110*b* in the process ST5.

The above-mentioned technique of punching the holes includes moving the reference pins 126*a* and 126*b* upwardly prior to the aforementioned movement of the first and second movable punch units 102*a* and 102*b*, to prevent the reference pins 126*a* and 126*b* from interfering with the leading edge of the plate P1. This achieves satisfactory movement of the first and second movable punch units 102*a* and 102*b* if the leading edge of the plate P1 is wavy.

Thereafter, the plate P1 is transported in the direction D1 (in a process ST6). This process corresponds to Step S29 of FIG. 32.

(Punching Process for Medium-Size Single-Mounting Plate P1)

Figure 38:
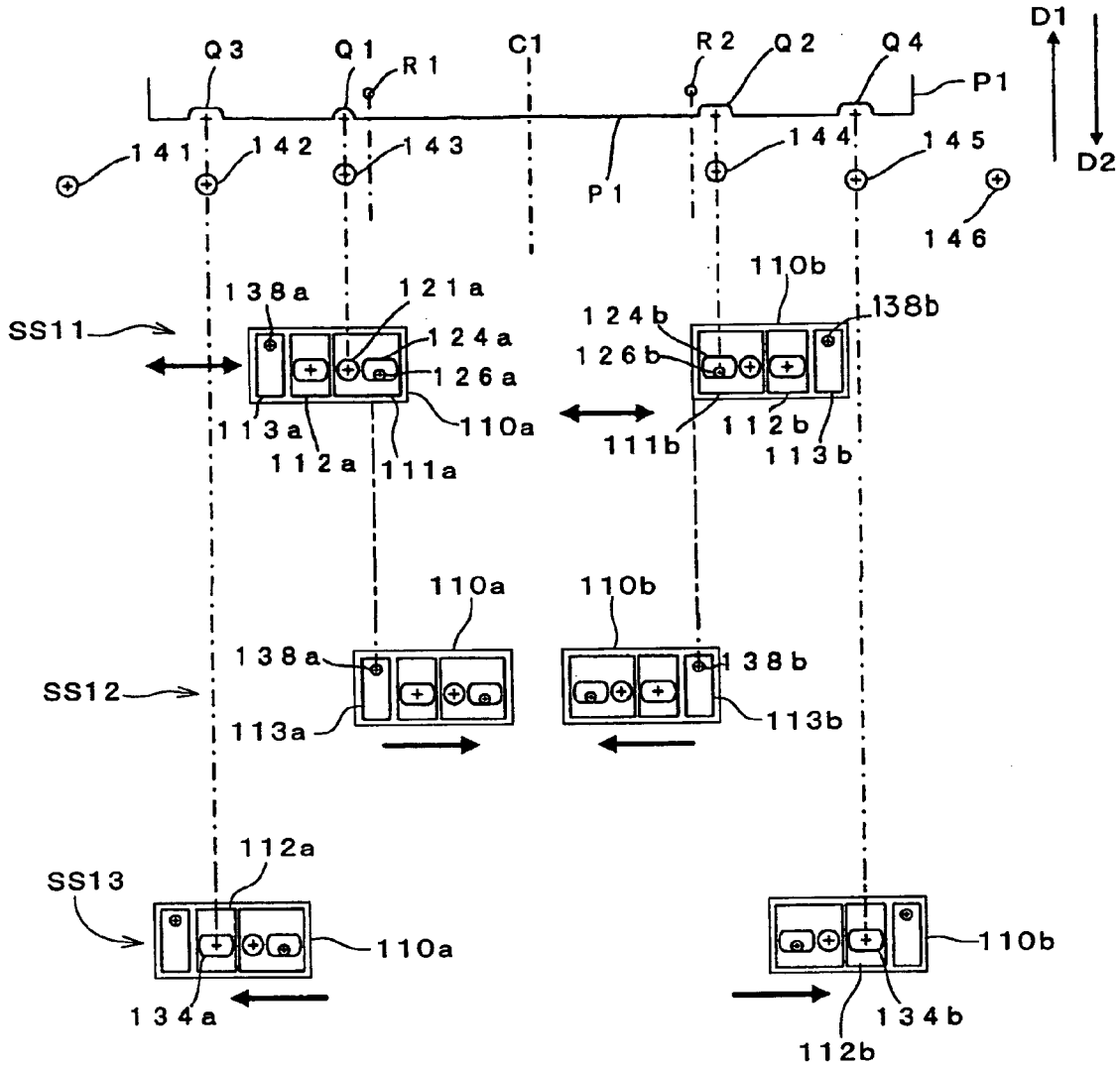
FIG. 38 is a view showing a positional relationship between a medium-size single-mounting plate and the positioning pins, and a positional relationship between the punchers when punching the medium-size single-mounting plate.

FIG. 38 is a view showing a positional relationship between the medium-size plate P1 on the drum 21 and the positioning pins, and a movement direction of and a positional relationship between the punchers 111 to 113 when punching the plate P1 (in operating states SS11 through SS13). The operating states SS11 and SS12 shown in FIG. 38 are identical with the operating states SS1 and SS2 shown in FIG. 35, and will not be described.

As shown in FIG. 38, the leading edge of the medium-size plate P1 is punched with the semicircular hole Q1 and the elongated holes Q2, Q3, Q4. The semicircular hole Q1 is for engagement with the third positioning pin 143, and the elongated positioning hole Q2 is for loose engagement with the fourth positioning pin 144. The provision of the elongated escape holes Q3 and Q4 in the plate P1 prevents the plate P1 from making contact with the second and fifth positioning pins 142 and 145. The leading edge of the plate P1 is further punched with the printing holes R1 and R2 to be used in printing operation in a subsequent step or the like.

Figure 39:
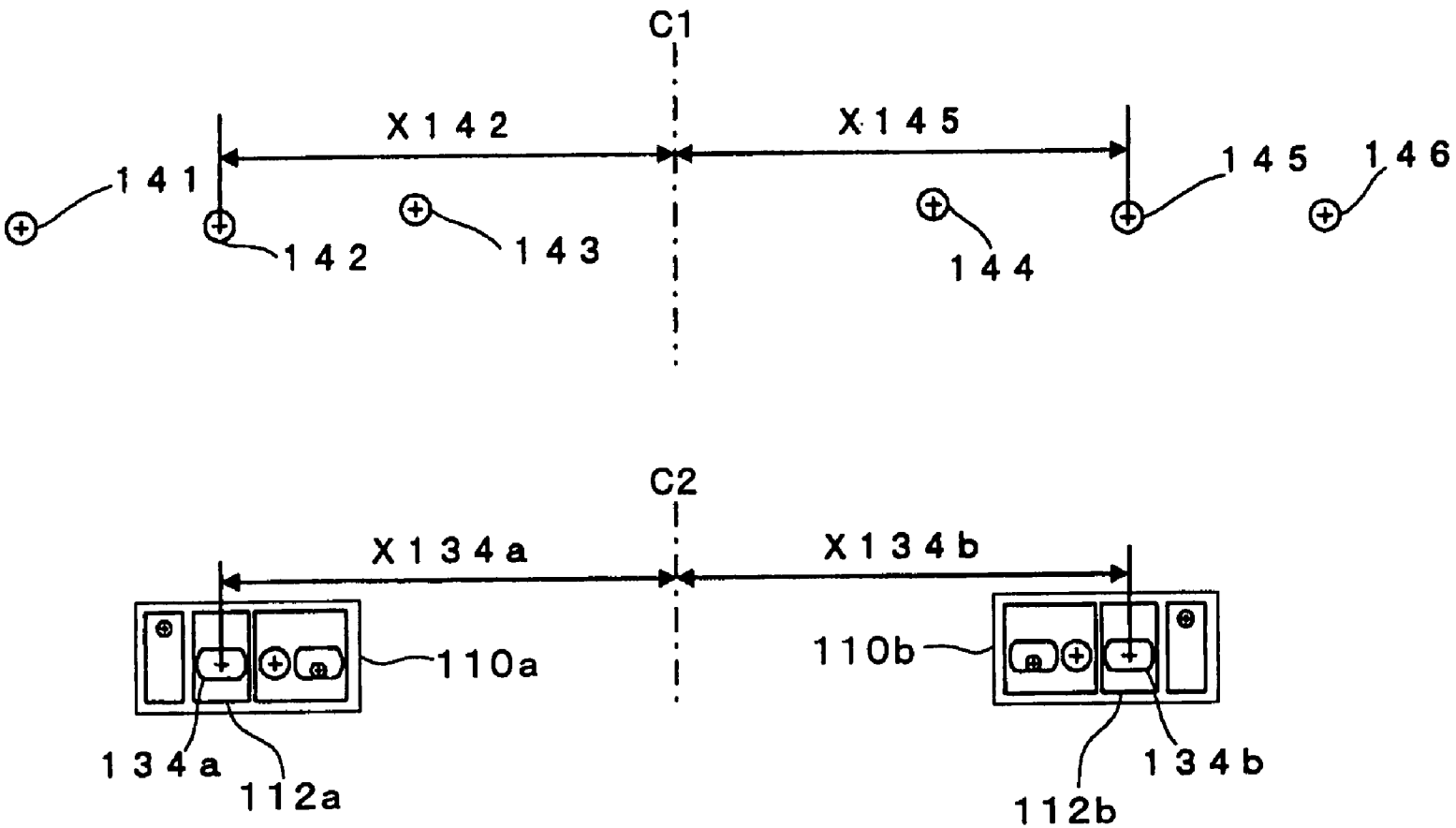
FIG. 39 is a schematic view showing a positional relationship between the punches, the reference pins and the positioning pins.
Figure 40:
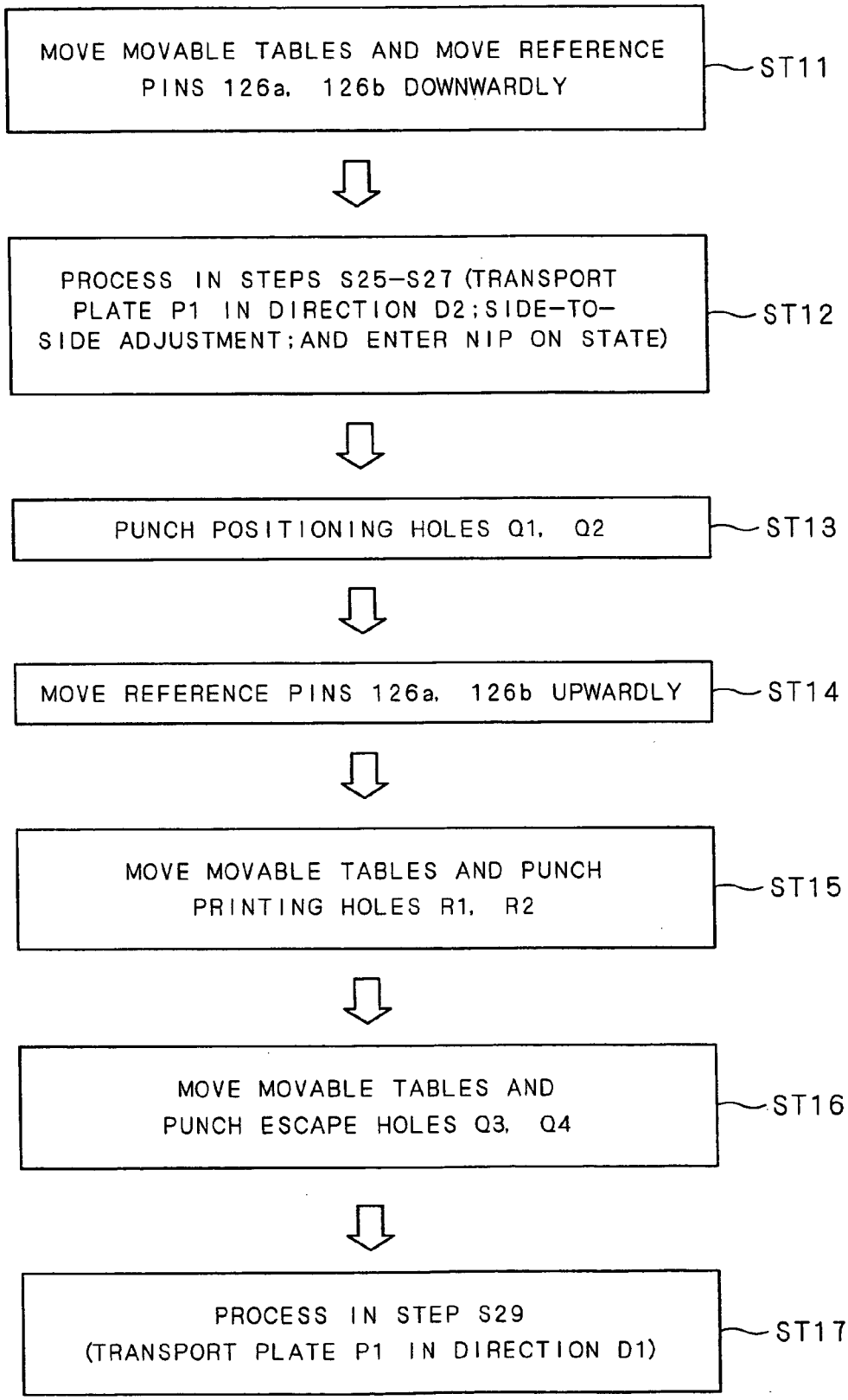
FIG. 40 illustrates the operation of punching holes in the medium-size single-mounting plate in time sequence.

FIG. 39 is a view showing a positional relationship between the first to sixth positioning pins 141 to 146 on the drum 21 and the punchers 111 to 113 when punching the elongated holes Q3 and Q4 in the operating state SS13. FIG. 40 is a diagram illustrating the operation for punching the holes Q1 to Q4 and the printing holes R1 and R2 in time sequence. The punching process for the medium-size plate P1 will be described with reference to FIGS. 39 and 40. Processes STI1 through ST15 shown in FIG. 40 are identical in operation with the processes ST1 through ST5 described above with reference to FIG. 37, and will not be described herein.

Upon punching the printing holes in the leading edge of the plate P in the process ST15 of FIG. 40, the image recorder 1 is placed into the operating state SS13. In the operating state SS13, the movable tables 110*a* and 110*b* of the first and second movable punch units 102*a* and 102*b* move, thereby to move the punchers 112*a* and 112*b* to such locations (shown in FIG. 39) that the punchers 112*a* and 112*b* can punch the escape holes Q3 and Q4, respectively. That is, the punchers 112*a* and 112*b* move along the X axis as indicated by the arrows at the operating state SS13 of FIG. 38.

Specifically, the first movable punch unit 102*a* moves the movable table 110*a* so that an X-axis distance x134*a* from the center of the elongated punch 134*a* to the reference line C2 of the punch unit 23 is equal to an X-axis distance x142 from the center of the second positioning pin 142 to the centerline C1 of the drum 21, as illustrated in FIG. 39.

Similarly, the second movable punch unit 102*b* moves the movable table 110*b* so that an X-axis distance xl34*b* from the center of the elongated punch 134*b* to the reference line C2 of the punch unit 23 is equal to an X-axis distance x145 from the center of the fifth positioning pin 145 to the centerline C1 of the drum 21. Since the elongated punches 134*a* and 134*b* are longer along the X axis than the positioning pins 142 and 145, the equality between the distances xl34*a* and xl42 and the equality between the distances x134*b* and x145 need not be exact.

Referring again to FIG. 40, in the locations at which the movement is completed, the punchers 112*a* and 112*b* of the respective movable punch units 102*a* and 102*b* are driven to punch the escape holes Q3 and Q4 in the plate P1 (in a process ST16).

Thereafter, the plate P1 is transported in the direction D1. This operation corresponds to Step S29 of FIG. 32 (in a process ST17).

(Punching Process for Large-Size Single-Mounting Plate P1)

Figure 41:
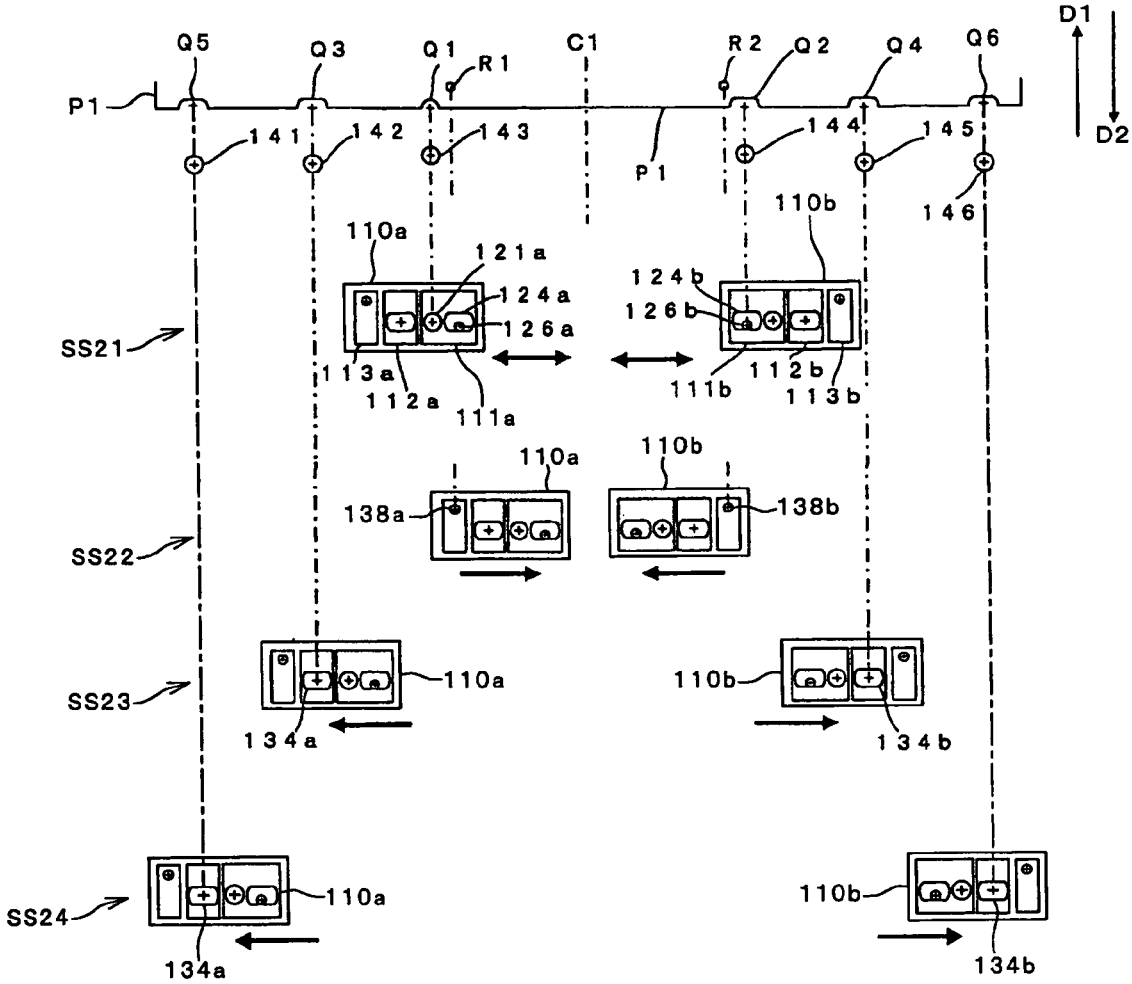
FIG. 41 is a view showing a positional relationship between a large-size single-mounting plate and the positioning pins, and a positional relationship between the punchers when punching the large-size single-mounting plate.

FIG. 41 is a view showing a positional relationship between the large-size plate P1 on the drum 21 and the positioning pins, and a movement direction of and a positional relationship between the punchers 111 to 113 when punching the plate P1 (in operating states SS21 through SS24). The operating states SS21 through SS23 shown in FIG. 41 are identical with the operating states SS11 through SS13 shown in FIG. 38, and will not be described.

As shown in FIG. 41, the leading edge of the plate P1 is punched with the semicircular positioning hole Q1, the elongated positioning hole Q2, the elongated escape holes Q3 to Q6, and the printing holes R1 and R2. The semicircular positioning hole Q1 is for engagement with the third positioning pin 143, and the elongated positioning hole Q2 is for loose engagement with the fourth positioning pin 144. The provision of the elongated escape holes Q3 to Q6 in the plate P1 prevents the plate P1 from making contact with the first, second, fifth and sixth positioning pins 141, 142, 145 and 146.

Figure 42:
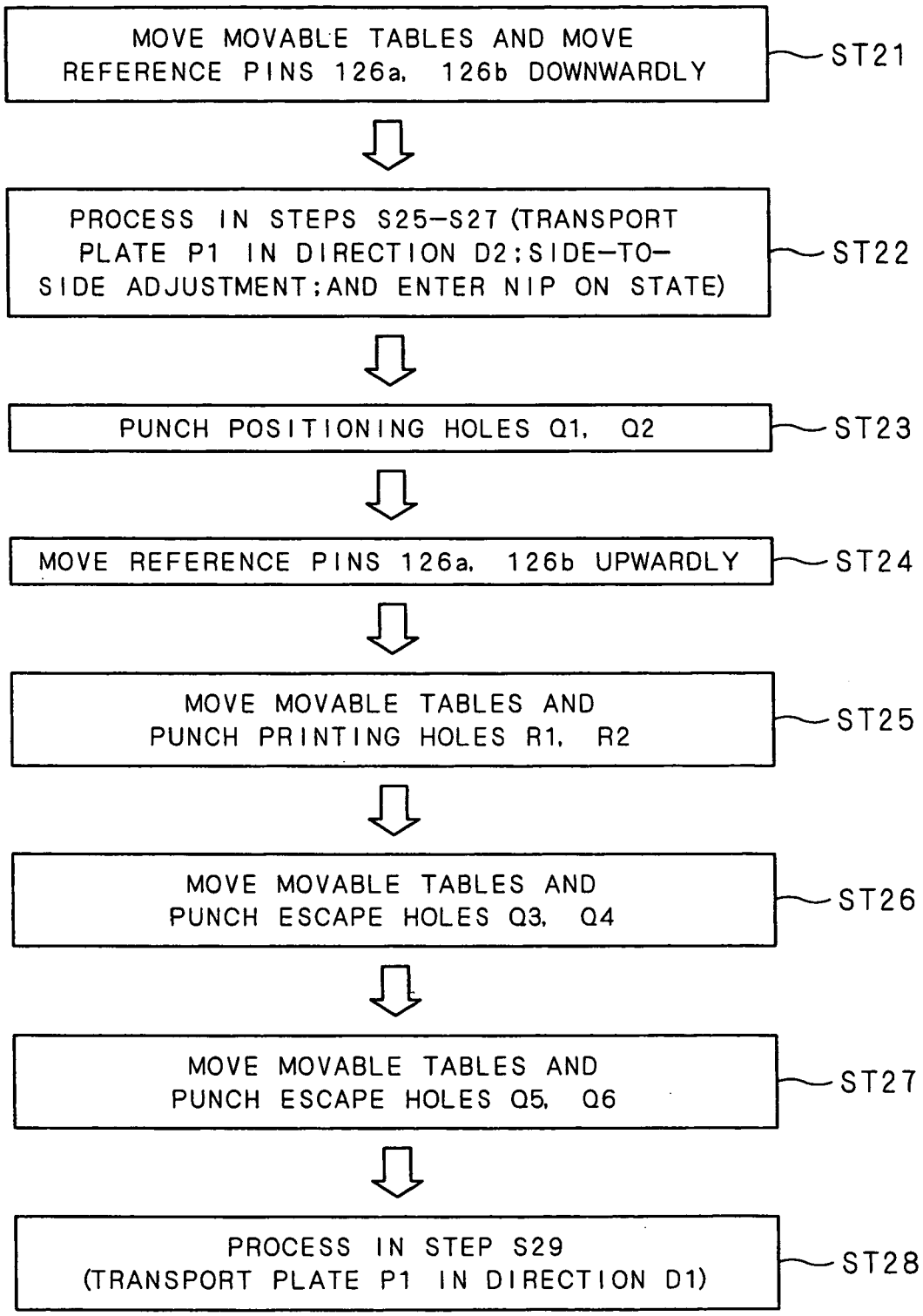
FIG. 42 illustrates the operation of punching holes in the large-size single-mounting plate in time sequence.

FIG. 42 is a diagram illustrating the operation for punching the holes Q1 to Q6, and the printing holes R1 and R2 in time sequence.

Processes ST21 through ST25 shown in FIG. 42 are identical in operation with the processes ST1 through ST5 described above with reference to FIG. 37. A process ST26 shown in FIG. 42 is identical in operation with the process ST16 described above with reference to FIG. 40. For this reason, the processes ST21 through ST26 will not be described in detail herein.

Upon punching the escape holes Q3 and Q4 in the leading edge of the plate P1 in the process ST26 of FIG. 42, the image recorder 1 is placed into the operating state SS24. In the operating state SS24, the movable tables 110*a* and 110*b* of the first and second movable punch units 102*a* and 102*b* move, thereby to move the punchers 112*a* and 112*b* to such locations that the punchers 112*a* and 112*b* can punch the escape holes Q5 and Q6, respectively. That is, the punchers 112*a* and 112*b* move along the X axis as indicated by the arrows at the operating state SS24 of FIG. 41.

Specifically, the first movable punch unit 102*a* moves the movable table 110*a* so that the X-axis distance x134*a* from the center of the elongated punch 134*a* to the reference line C2 of the punch unit 23 is equal to an X-axis distance x141 (not shown) from the center of the first positioning pin 141 to the centerline C1 of the drum 21.

Similarly, the second movable punch unit 102*b* moves the movable table 110*b* so that the X-axis distance x134*b* from the center of the elongated punch 134*b* to the reference line C2 of the punch unit 23 is equal to an X-axis distance x146 (not shown) from the center of the sixth positioning pin 146 to the centerline C1 of the drum 21.

Next, in the locations at which the movement is completed, the punchers 112*a* and 112*b* of the first and second movable punch units 102*a* and 102*b* are driven to punch the escape holes Q5 and Q6 in the plate P1 (in a process ST27).

Thereafter, the plate P1 is transported in the direction D1. This operation corresponds to Step S29 of FIG. 32 (in a process ST28).

(Punching Process for Small-Size Double-Mounting Plates P2)

Figure 43:
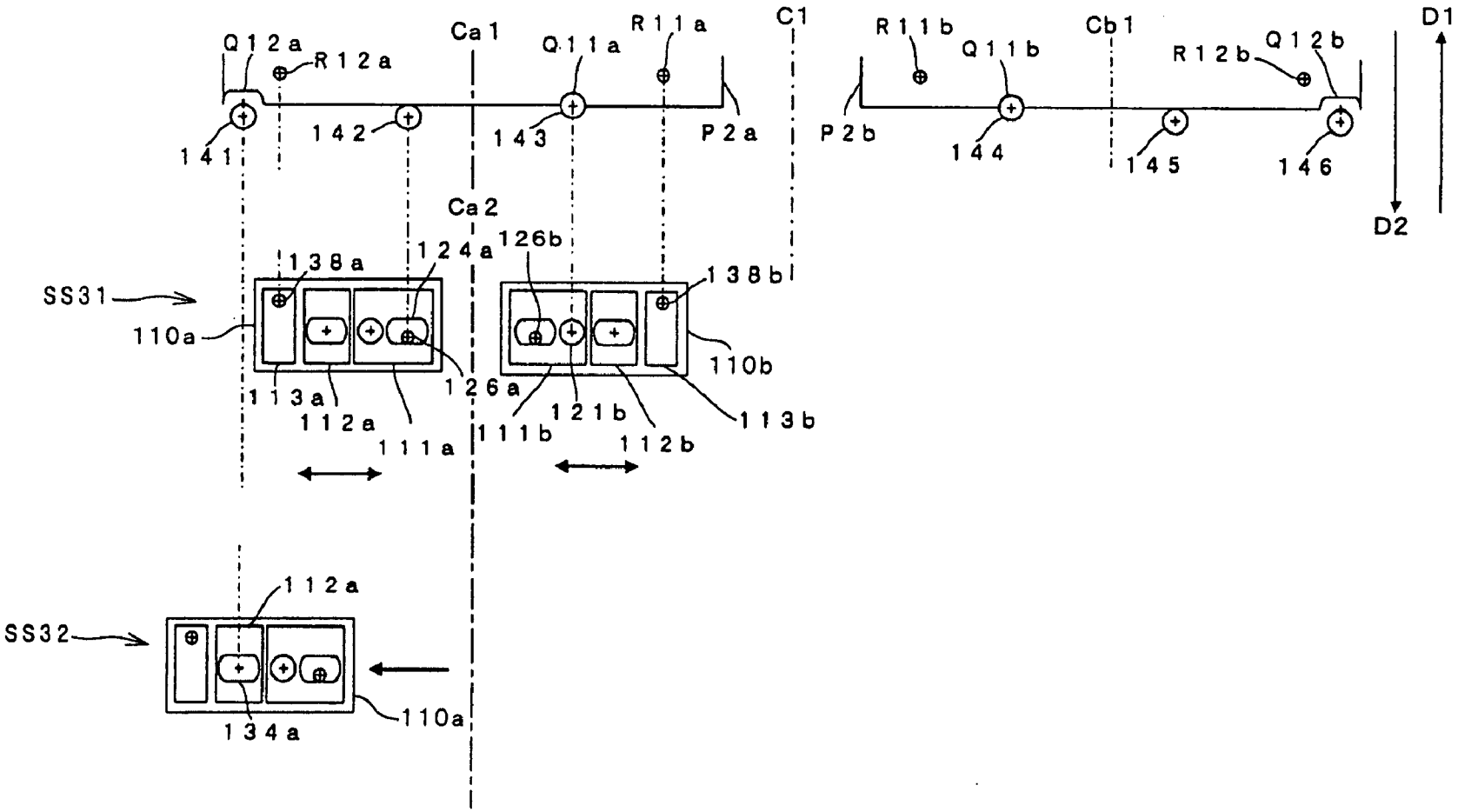
FIG. 43 is a view showing a positional relationship between a small-size double-mounting plate and the positioning pins, and a positional relationship between the punchers when punching the small-size double-mounting plate.

FIG. 43 is a view showing a positional relationship between the small-size double-mounting plates P2*a*, P2*b* on the drum 21 and the positioning pins, and a movement direction of and a positional relationship between the punchers 111 to 113 when punching the plate P2*a* (in operating states SS31 and SS32).

When the image recorder 1 performs the punching process on the two plates P2*a* and P2*b*, the order in which the punching process is performed, in principle, is: first the plate P2*a* (or the plate P2 for mounting in the first plate mounting region 27*a*), and then the plate P2*b* (or the plate P2 for mounting in the second plate mounting region 27*b*). However, when the movable tables 110*a* and 110*b* are in the second plate mounting region 27*b* at the beginning of the punching process, the punching process may be performed first on the plate P2*b*.

As shown in FIG. 43, the leading edge of the plate P2*a* (P2*b*) is punched with the semicircular positioning hole Q 11*a* (Q11*b*), the elongated escape hole Q12*a* (Q12*b*), and the printing holes R11*a* (R11*b*) and R12*a* (Rl2*b*).

The operating state SS31 of FIG. 43 indicates the operation in Step S4 described above with reference to FIG. 30. This operation moves the movable tables 110*a* and 110*b* of the punch unit 23 to the locations depending on the number and sizes of the plates P.

Figure 44:
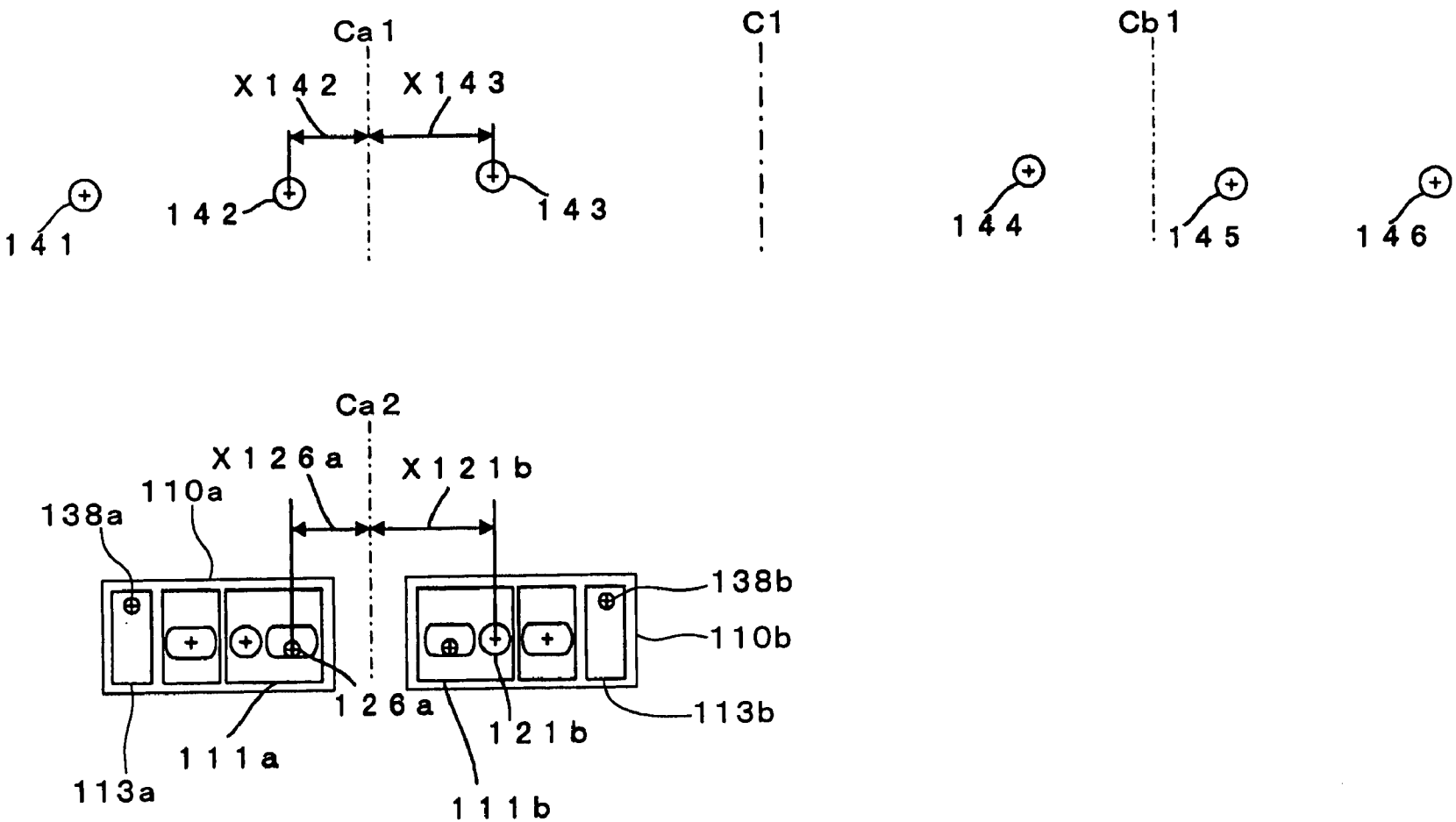
FIG. 44 is a schematic view showing a positional relationship between the punches, the reference pins and the positioning pins.
Figure 45:
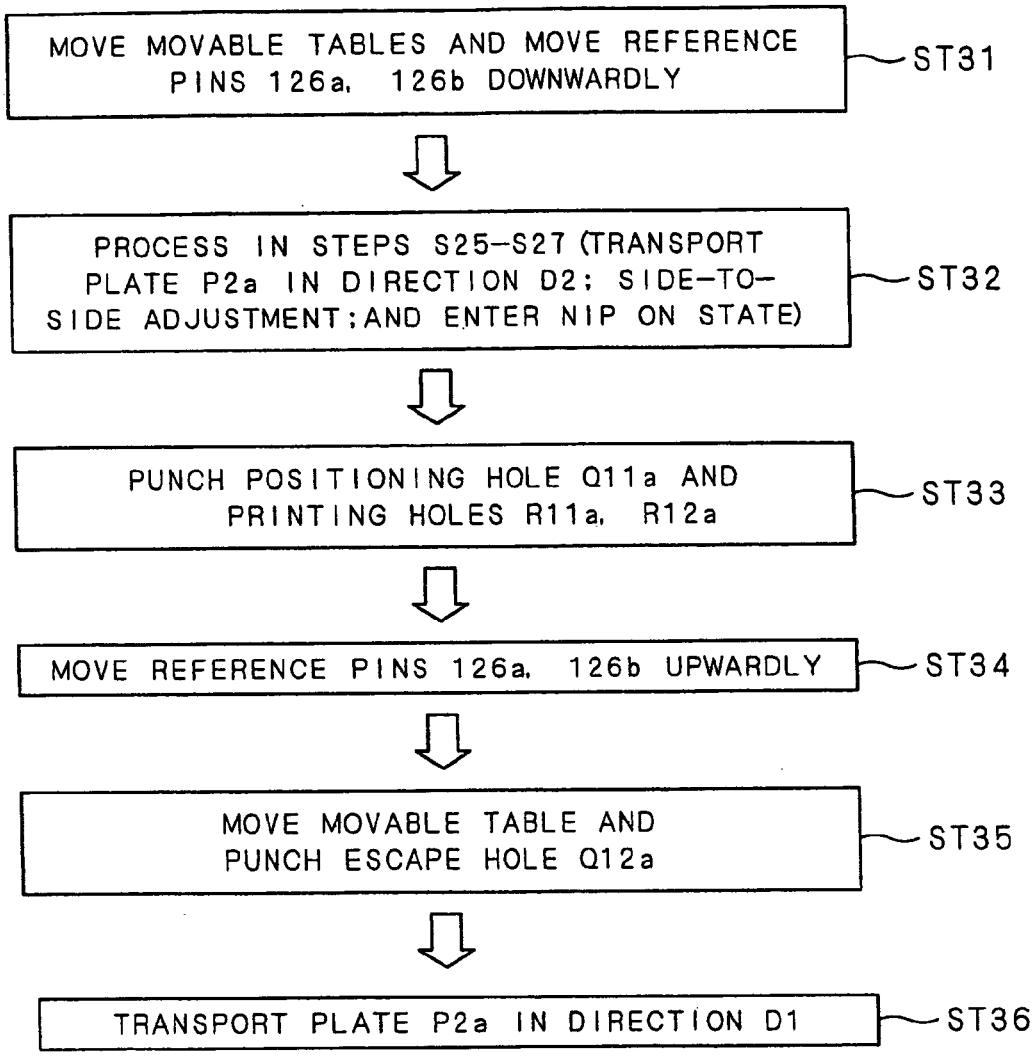
FIG. 45 illustrates the operation of punching holes in the small-size double-mounting plate in time sequence.

FIG. 44 is a view showing a positional relationship between the first to sixth positioning pins 141 to 146 on the drum 21 and the punchers 111*a* and 111*b* when punching the holes Q11*a* and Q12*a* in the operating state SS31. FIG. 45 is a diagram illustrating the operation for punching the holes Q11*a*, Ql2*a* and the printing holes R11*a*, R12*a* in the plate P2*a* in time sequence. The operating state SS31 will be described with reference to FIGS. 44 and 45.

First, the first movable punch unit 102*a* moves the movable table 110*a* so that an X-axis distance x126*a* from the reference line Ca2 of the first movable punch unit 102*a* to the center of the reference pin 126*a* is equal to the X-axis distance x142 from the centerline Ca1 of the first plate mounting region 27*a* to the center of the second positioning pin 142.

Similarly, the second movable punch unit 102*b* moves the movable table 110*b* so that an X-axis distance x121*b* from the reference line Ca2 of the first movable punch unit 102*a* to the center of the round punch 121*b* is equal to the X-axis distance x143 from the centerline Ca1 of the first plate mounting region 27*a* to the center of the third positioning pin 143, as illustrated in FIG. 44.

Concurrently with the above movement, the reference pin 126*a* of the puncher 111*a* is moved down to the level of the clearance 123*a*, and the reference pin 126*b* of the puncher 111*b* is moved down to the level of the clearance 123*b*. The operation described heretofore corresponds to a process ST31 shown in FIG. 45.

Figure 31:
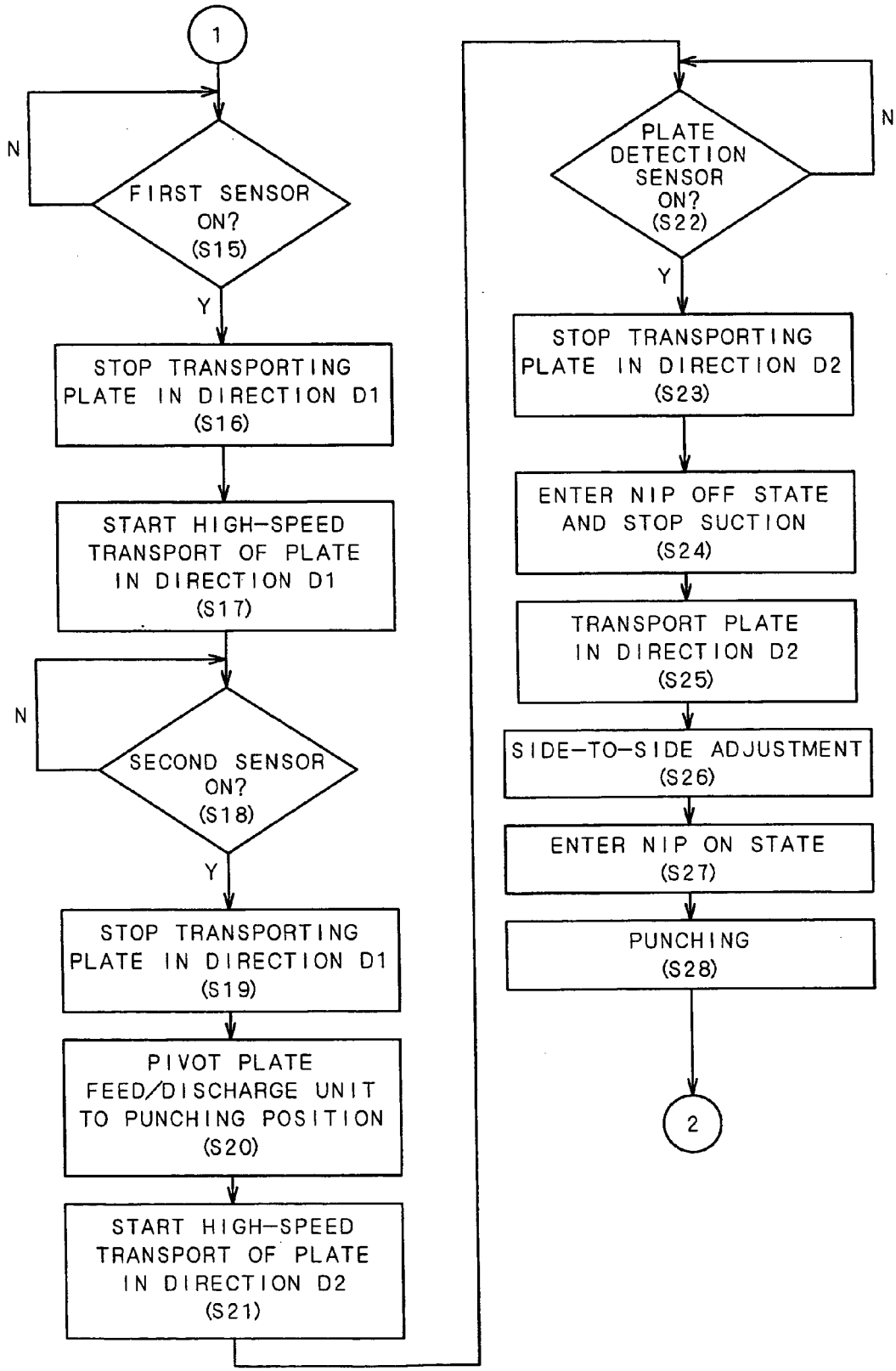
Figure 32:
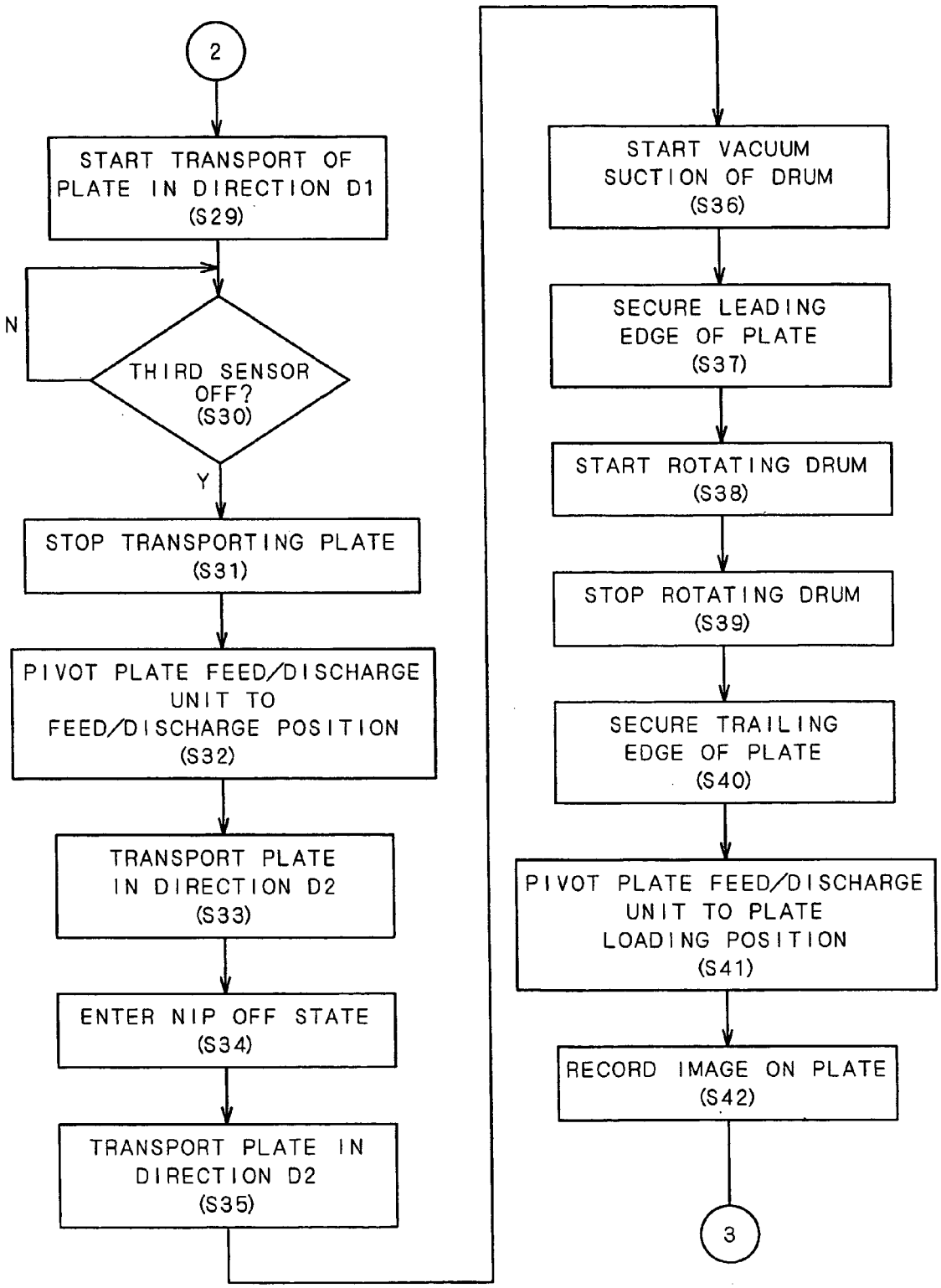
Figure 33:
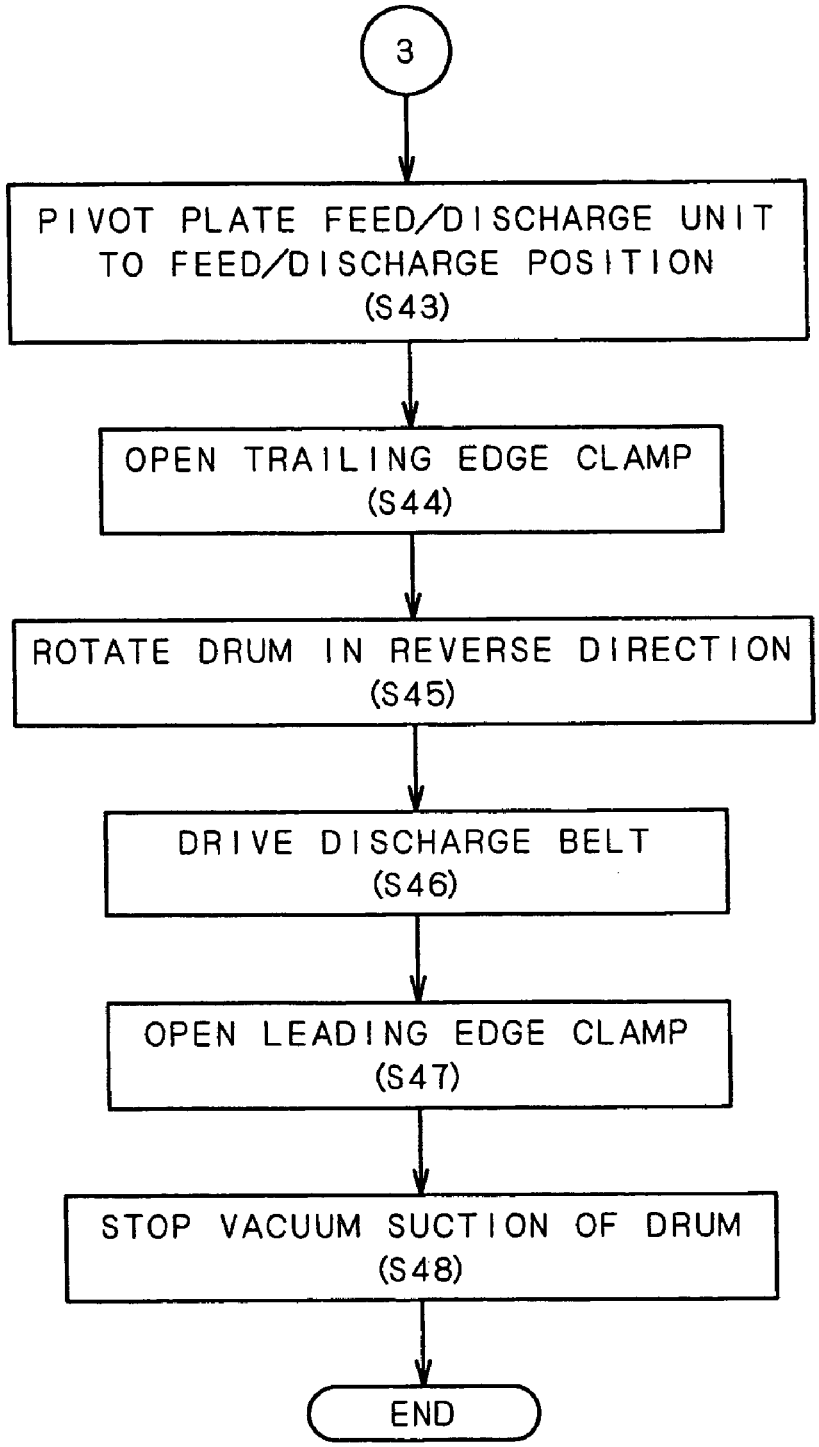

Next, operation in Steps S25 through S27 of FIG. 31 is performed (in a process ST32). Specifically, the step of transporting the plate P2*a* at low speeds until the leading edge of the plate P2*a* comes into contact with the reference pins 126*a*, 126*b* (Step S25), the side-to-side adjustment step (Step S26), and the step of entering the nip ON state (Step S27) are carried out in succession.

Next, a drive mechanism not shown of the puncher 111*b* causes the round punch 121*b* to punch the semicircular positioning hole Q11*a* in the leading edge of the plate P2*a*. At the same time, the punchers 113*a* and 113*b* are driven to cause the punches 138*a* and 138*b* to punch the printing holes R12*a* and R11*a*, respectively, in the leading edge of the plate P2*a* (in a process ST33).

To produce a multicolor print with high accuracy by printing images recorded on respective plates of different colors one over another on a printing material, it is necessary that all of the plates have the same positional relationship between the recorded image and the printing holes. The location of the recorded image on the plate is influenced by the location of the positioning holes. Therefore, attainment of a high-quality multicolor image involves the need that all of the plates have accurately the same positional relationship between the printing holes and the positioning holes.

In the image recorder 1, the punchers 111*b* and 113*b* are manufactured so that the positional relationship between the punch 138*b* for punching the printing hole R11*a* and the round punch 121*b* for punching the positioning hole Q11*a* is identical with the positional relationship between the holes R11*a* and Q11*a*. This provides a constantly fixed positional relationship between the printing hole R11*a* and the positioning hole Q11*a* in all of the plates, thereby to produce a high-accuracy multicolor print.

Next, the reference pins 126*a* and 126*b* are moved upwardly to above the clearances 133*a* and 133*b*, respectively (in a process ST34).

Then, the movable table 110*a* of the first movable punch unit 102*a* is moved, thereby to move the puncher 112*a* to such a location that the puncher 112*a* can punch the escape hole Q12*a* That is, the puncher 112*a* moves along the X axis as indicated by the arrow at the operating state SS32 of FIG. 43. More specifically, the movable table δ 10*a* is moved so that an X-axis distance from the center of the elongated punch 134*a* to the reference line Ca2 of the first movable punch unit 102*a* is equal to an X-axis distance from the center of the first positioning pin 141 to the centerline Ca1 of the first plate mounting region 27*a*.

Next, in the location at which the movement is completed, the punch 138*a* is driven to punch the escape hole Q12*a* in the leading edge of the plate P2*a* (in a process ST35).

Thereafter, the plate P2*a* is transported in the direction D1 back onto the upper tray 41 (in a process ST36).

Figure 46:
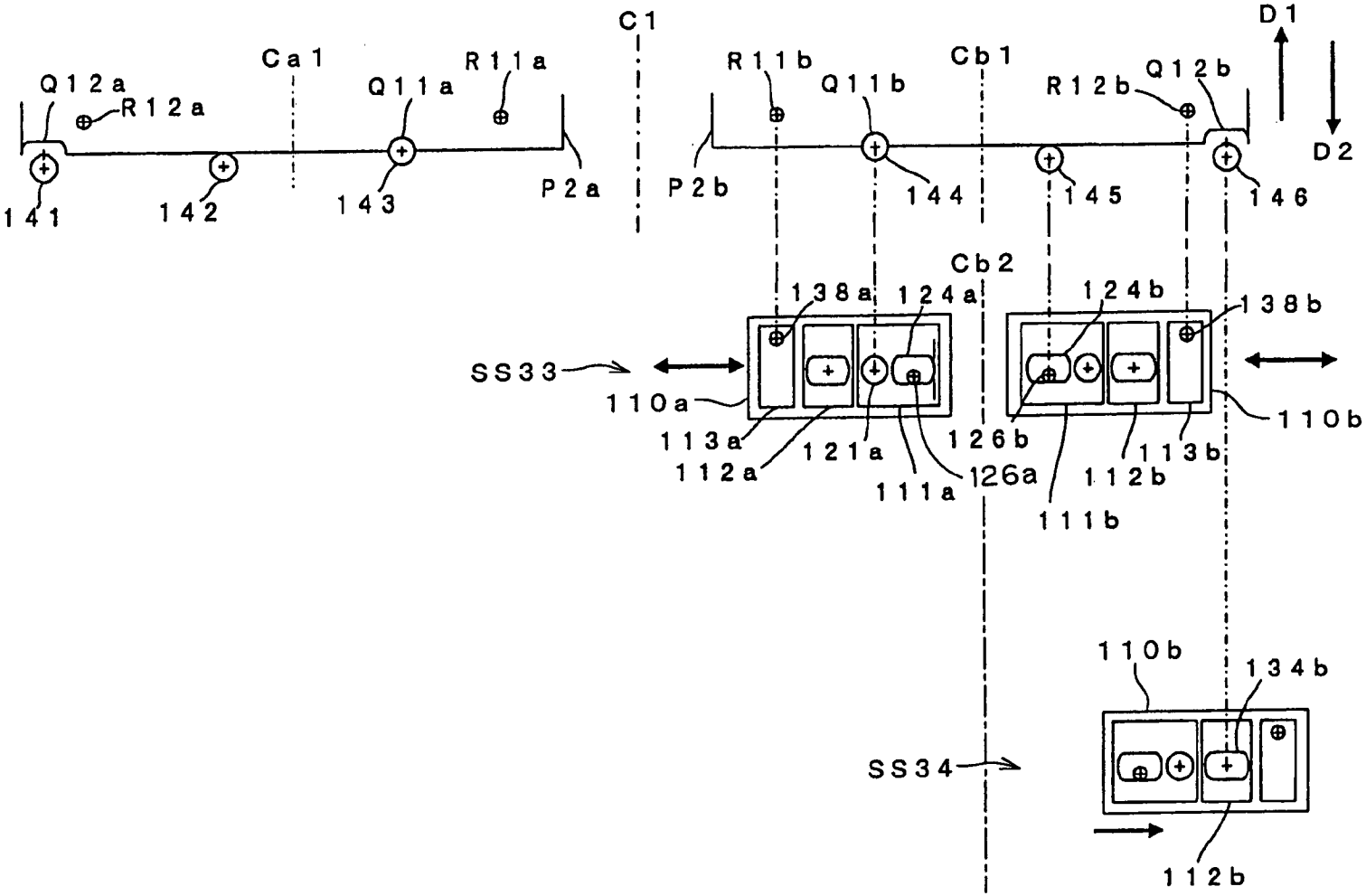
FIG. 46 is a view showing a positional relationship between a small-size double-mounting plate and the positioning pins, and a positional relationship between the punchers when punching the small-size double-mounting plate.
Figure 47:
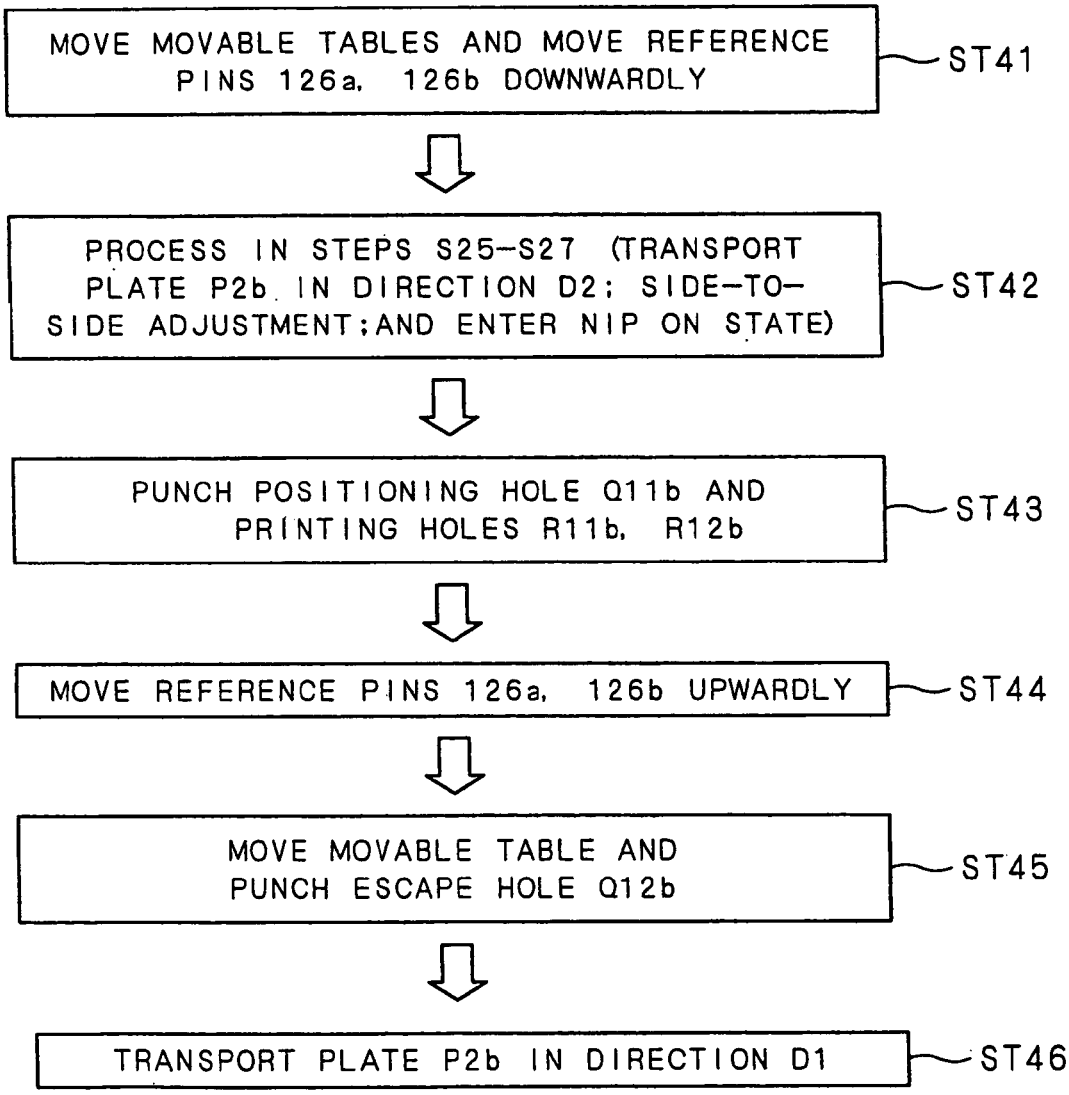
FIG. 47 illustrates the operation of punching holes in the small-size double-mounting plate in time sequence.

When the punching process on the plate P2*a* is completed, the punching process is then performed on the plate P2*b*. FIG. 46 is a view showing a positional relationship between the small-size double-mounting plates P2*a*, P2*b* on the drum 21 and the positioning pins, and a movement direction of and a positional relationship between the punchers 111 to 113 when punching the plate P2*b* (in operating states SS33 and SS34). FIG. 47 is a diagram illustrating the operation for punching the holes Q11*b*, Q12*b* and the printing holes R11*b*, R12*b* in the plate P2*b* in time sequence. The operating state SS34 will be described with reference to FIGS. 46 and 47.

First, the first and second movable tables 110*a* and 110*b* are moved to predetermined locations. That is, the operation corresponding to Step S4 described above with reference to FIG. 30 is performed. This operation moves the first and second movable tables 110*a* and 110*b* of the punch unit 23 to the locations depending on the number and sizes of the plates P (in the operating state SS33).

Specifically, the second movable punch unit 102*b* moves the movable table 110*b* so that an X-axis distance from the reference line Cb2 of the second movable punch unit 102*b* to the center of the reference pin 126*b* is equal to an X-axis distance from the centerline Cb1 of the second plate mounting region 27*b* to the center of the fifth positioning pin 145.

The first movable punch unit 102*a* moves the movable table 110*a* so that an X-axis distance from the reference line Cb2 of the second movable punch unit 102*b* to the center of the round punch 121*a* is equal to an X-axis distance from the centerline Cb1 of the second plate mounting region 27*b* to the center of the fourth positioning pin 144.

Concurrently with the above movement, the reference pin 126*a* of the puncher 111*a* is moved down to the level of the clearance 123*a*, and the reference pin 126*b* of the puncher 11*b* is moved down to the level of the clearance 123*b*. The operation described heretofore corresponds to a process ST41 shown in FIG. 47.

Next, operation in Steps S25 through S27 of FIG. 31 is performed (in a process ST42). Specifically, the step of transporting the plate P2*b* at low speeds until the leading edge of the plate P2*b* comes into contact with the reference pins 126*a*, 126*b* (Step S25), the side-to-side adjustment step (Step S26), and the step of entering the nip ON state (Step S27) are carried out in succession.

Next, the drive mechanism not shown of the puncher 11*a* causes the round punch 121*a* to punch the semicircular positioning hole Q11*b* in the leading edge of the plate P2*b*. At the same time, the punchers 113*a* and 113*b* are driven to cause the punches 138*a* and 138*b* to punch the printing holes R 11*b* and R12*b*, respectively, in the leading edge of the plate P2*b* (in a process ST43).

In the image recorder 1, the punchers 11*a*, 111*b* and 113*a* are manufactured so that the positional relationship between the punch 138*a* for punching the printing hole R11*b* and the round punch 121*a* for punching the positioning hole Q11*b* is identical with the positional relationship between the holes R11*b* and Q11*b*. This provides a constantly fixed positional relationship between the printing hole R11*b* and the positioning hole Q11*b* in all of the plates, thereby to produce a high-accuracy multicolor print.

Next, the reference pins 126*a* and 126*b* are moved upwardly to above the clearances 133*a* and 133*b*, respectively (in a process ST44).

Then, the image recorder 1 is placed into the operating state SS34. The second movable punch unit 102*b* moves the movable table 110*b*, thereby to move the puncher 112*b* to such a location that the puncher 112*b* can punch the escape hole Q12*b*. More specifically, the movable table 110*b* is moved so that an X-axis distance from the center of the elongated punch 134*b* to the reference line Cb2 of the second movable punch unit 102*b* is equal to an X-axis distance from the center of the sixth positioning pin 146 to the centerline Cb1 of the second plate mounting region 27*b*.

Next, in the location at which the movement is completed, the elongated punch 134*b* is driven to punch the escape hole Q12*b* in the leading edge of the plate P2*b* (in a process ST45).

Thereafter, the plate P2*b* is transported in the direction D1 back onto the upper tray 41 (in a process ST46).

This completes the punching process on the small-size double-mounting plates P2*a* and P2*b*.

(Punching Process for Large-Size Double-Mounting Plates P2)

Figure 48:
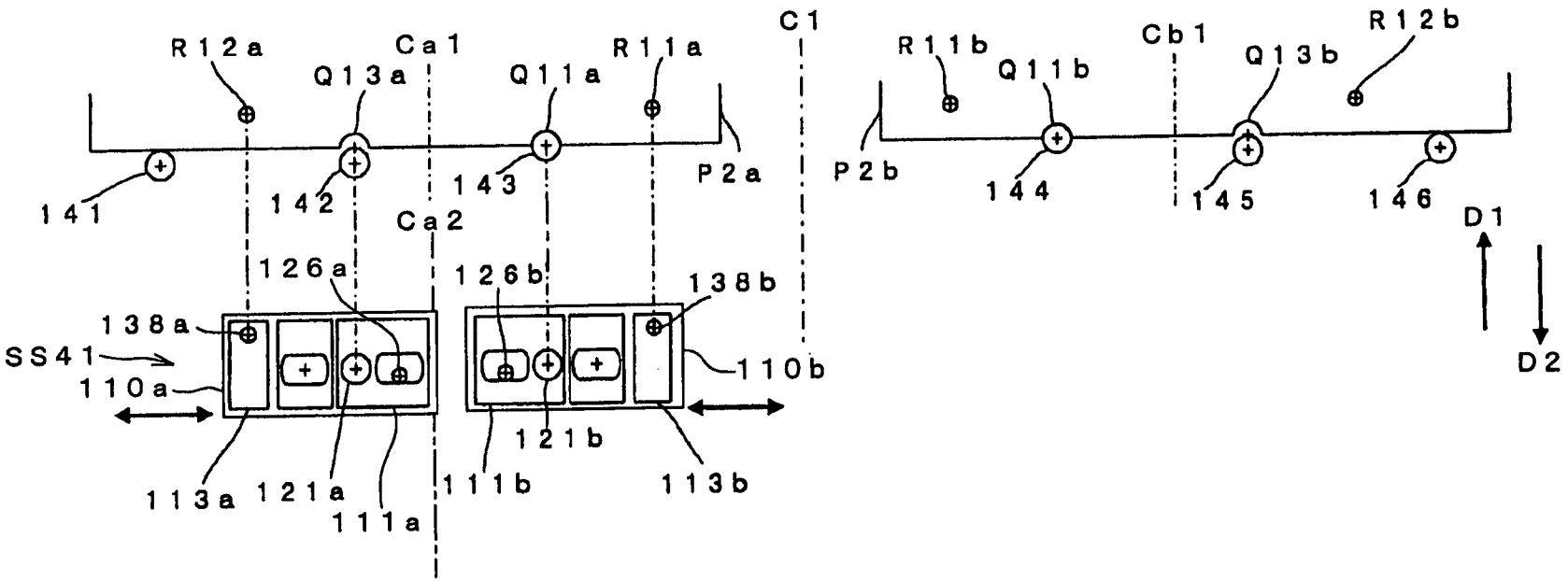
FIG. 48 is a view showing a positional relationship between a large-size double-mounting plate and the positioning pins, and a positional relationship between the punchers when punching the large-size double-mounting plate.
Figure 49:
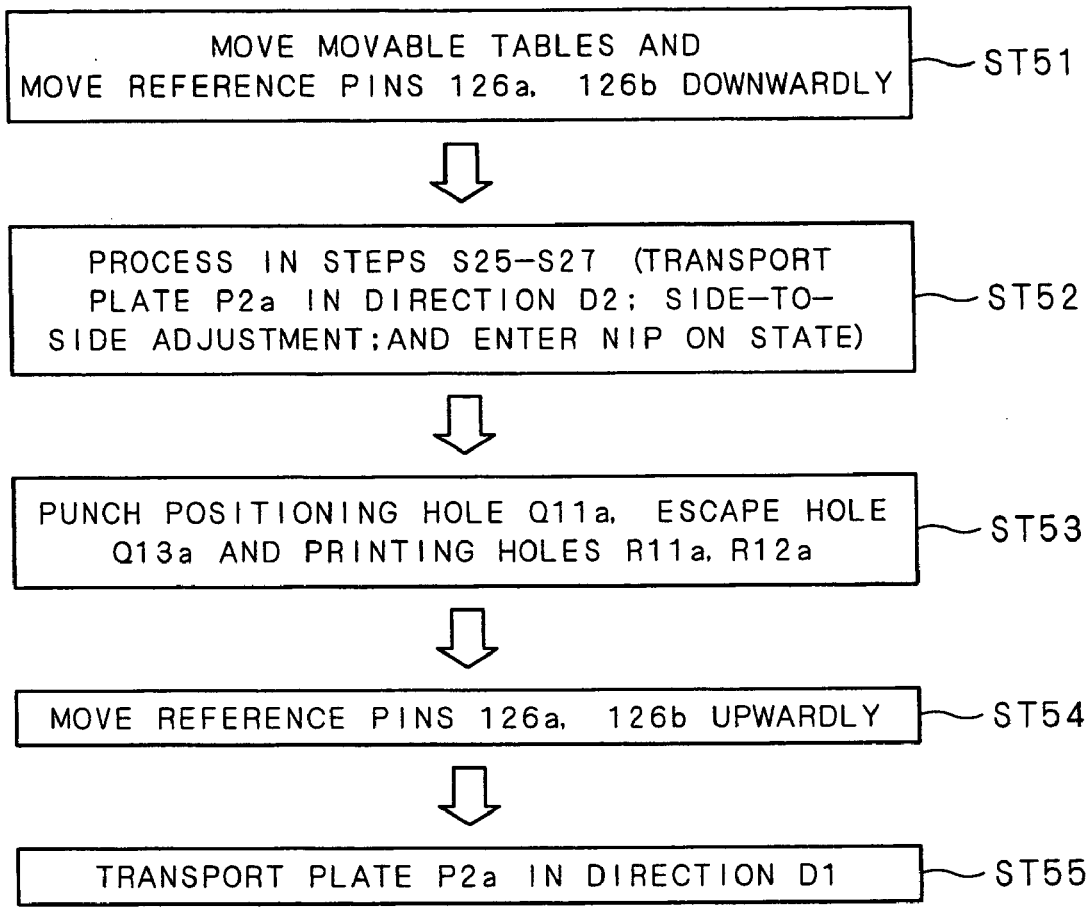
FIG. 49 illustrates the operation of punching holes in the large-size double-mounting plate in time sequence.

FIG. 48 is a view showing a positional relationship between the large-size double-mounting plates P2*a*, P2*b* on the drum 21 and the first to sixth positioning pins 141 to 146, and a movement direction of and a positional relationship between the punchers 111*a*, 111*b*, 113*a* and 113*b* when punching the plate P2*a* (in an operating state SS41). FIG. 49 is a diagram illustrating the operation for punching the holes Q11*a*, Q13*a* and the printing holes R11*a*, R12*a* in the plate P2*a* in time sequence.

As shown in FIG. 48, the leading edge of the plate P2*a* (P2*b*) is punched with the semicircular positioning hole Q11*a* (Q11*b*), the semicircular escape hole Q13*a* (Ql3*b*), and the printing holes R11*a* (R11*b*) and R12*a* (R12*b*).

The operating state SS41 of FIG. 48 indicates the operation in Step S4 described above with reference to FIG. 30. When the large-size double-mounting plates P2 are used, the first and second movable punch units 102*a* and 102*b* are controlled in a manner to be described below.

The first movable punch unit 102*a* moves the movable table 110*a* so that an X-axis distance from the center of the round punch 121*a* of the puncher 113*a* to the reference line Ca2 of the first movable punch unit 102*a* is equal to an X-axis distance from the center of the second positioning pin 142 on the drum 21 to the centerline Ca1.

The second movable punch unit 102*b* moves the movable table 110*b* so that an X-axis distance from the center of the round punch 121*b* of the puncher 111*b* to the reference line Ca2 of the first movable punch unit 102*a* is equal to an X-axis distance from the center of the third positioning pin 143 on the drum 21 to the centerline Ca1.

Concurrently with the above movement, the reference pin 126*a* of the puncher 111*a* is moved down to the level of the clearance 123*a*, and the reference pin 126*b* of the puncher 111*b* is moved down to the level of the clearance 123*b*. The operation described heretofore corresponds to a process ST51 shown in FIG. 49.

Next, operation in Steps S25 through S27 of FIG. 31 is performed (in a process ST52).

Next, the puncher 111*a* is driven to cause the round punch 121*a* to punch the semicircular escape hole Q13*a* in the leading edge of the plate P2*a*. At the same time, the puncher 111*b* is driven to cause the round punch 121*b* to punch the semicircular positioning hole Q11*a* in the leading edge of the plate P2*a*. Also simultaneously, the punchers 113*a* and 113*b* are driven to punch the printing holes R12*a* and R11*a*, respectively, in the leading edge of the plate P2*a* (in a process ST53).

Next, the reference pins 126*a* and 126*b* are moved upwardly (in a process ST54). Thereafter, the plate P2*a* is transported in the direction D1 back onto the upper tray 41 (in a process ST55).

Figure 50:
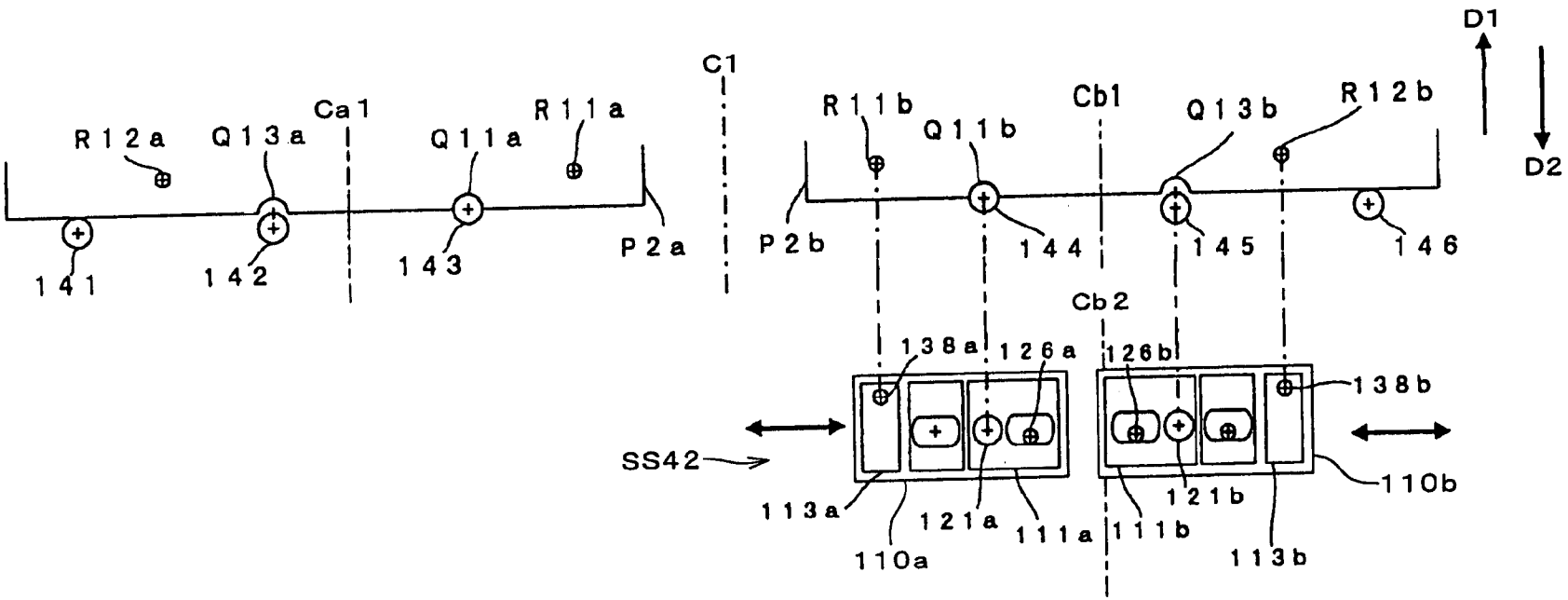
FIG. 50 is a view showing a positional relationship between a large-size double-mounting plate and the positioning pins, and a positional relationship between the punchers when punching the large-size double-mounting plate.
Figure 51:
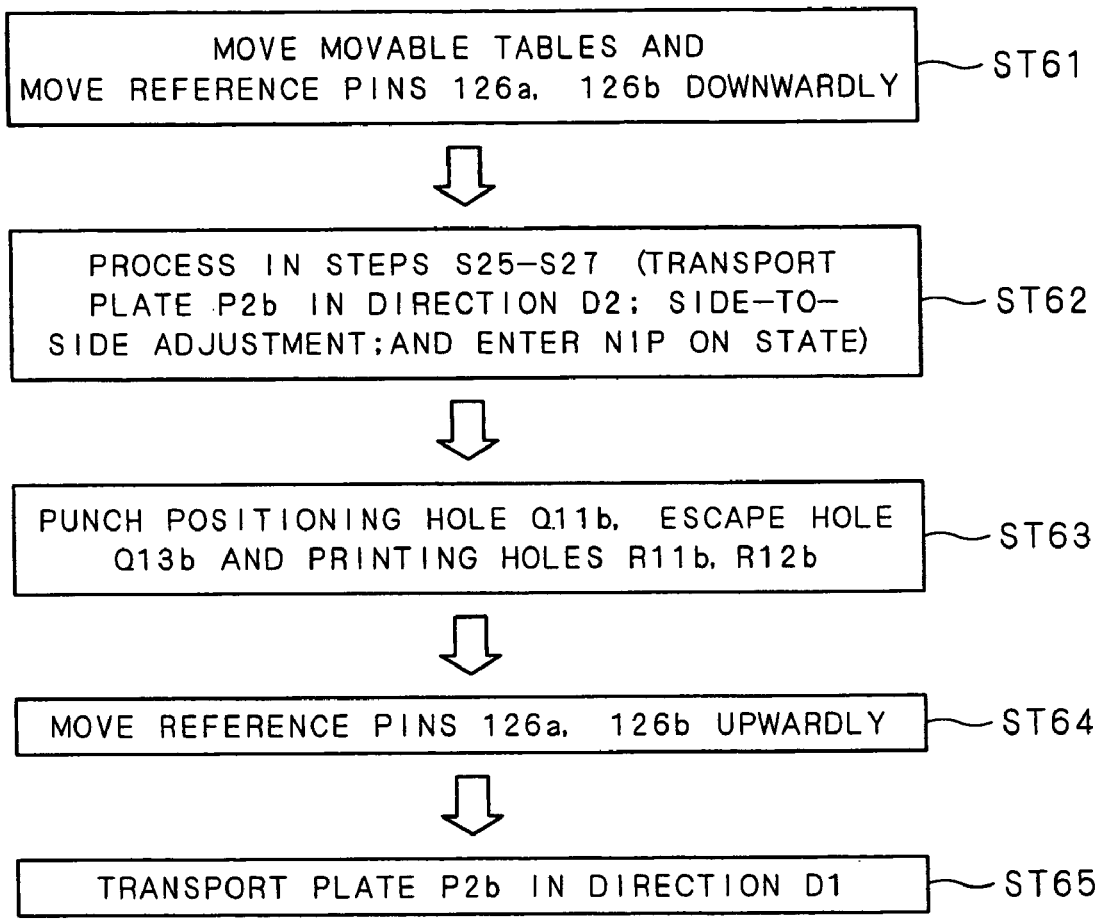
FIG. 51 illustrates the operation of punching holes in the large-size double-mounting plate in time sequence.

When the punching process on the plate P2*a* is completed, the punching process is then performed on the plate P2*b*. FIG. 50 is a view showing a positional relationship between the large-size double-mounting plates P2*a*, P2*b* on the drum 21 and the first to sixth positioning pins 141 to 146, and a movement direction of and a positional relationship between the punchers 111*a*, 111*b*, 113*a* and 113*b* when punching the plate P2*b* (in an operating state SS42). FIG. 51 is a diagram illustrating the operation for punching the holes Q11*b*, Q13*b* and the printing holes R11*b*, R12*b* in the plate P2*b* in time sequence.

First, the first movable punch unit 102*a* moves the movable table 110*a* so that an X-axis distance from the reference line Cb2 of the second movable punch unit 102*b* to the center of the round punch 121*a* is equal to an X-axis distance from the centerline Cb1 of the second plate mounting region 27*b* to the center of the fourth positioning pin 144.

The second movable punch unit 102*b* moves the movable table 110*b* so that an X-axis distance from the reference line Cb2 of the second movable punch unit 102*b* to the center of the round punch 121*b* is equal to an X-axis distance from the centerline Cb1 of the second plate mounting region 27*b* to the center of the fifth positioning pin 145.

Concurrently with the above movement, the reference pin 126*a* of the puncher 111*a* is moved down to the level of the clearance 123*a*, and the reference pin 126*b* of the puncher 111*b* is moved down to the level of the clearance 123*b*. The operation described heretofore corresponds to a process ST61 shown in FIG. 51.

Next, operation in Steps S25 through S27 of FIG. 31 is performed (in a process ST62).

Next, the puncher 111*a* is driven to cause the round punch 121*a* to punch the semicircular positioning hole Q11*b* in the leading edge of the plate P2*b*. At the same time, the puncher 111*b* is driven to cause the round punch 121*b* to punch the semicircular escape hole Q13*b* in the leading edge of the plate P2*b*. Also simultaneously, the punchers 113*a* and 113*b* are driven to punch the printing holes R11*b* and R12*b*, respectively, in the leading edge of the plate P2*b* (in a process ST63).

Next, the reference pins 126*a* and 126*b* are moved upwardly (in a process ST64). Thereafter, the plate P2*b* is transported in the direction D1 back onto the upper tray 41 (in a process ST65). This completes the punching process on the plates P2*a* and P2*b*.

In the above description, the upper tray 41 is loaded with two plates of the same size. However, when the upper tray 41 is loaded with two plates P2 of different sizes, the procedure described with reference to FIGS. 43 through 51 may be suitably changed, thereby allowing the proper punching process to be carried out on the two plates P2.

In the aforementioned preferred embodiment, the location of the reference pins for use in positioning the plate during punching is substantially the same as the location of the positioning pins for use in positioning the plate on the drum. This prevents the degradation of the quality of a printed material produced by printing on a printing sheet using an image recorded on the plate if the leading edge of the plate is wavy.

This will be described with reference to FIG. 45. As shown in FIG. 45, the plate P2*a* is subjected to the positioning by the reference pins 126*a* and 126*b* (in the process ST32) prior to the punching by the punch unit 23 (in the process ST33).

It is assumed that the plate P2*a* has a wavy portion situated to be brought into contact with the reference pin 126*a*. Then, the plate P2*a* is subjected to the positioning in an orientation inclined by the amount of the wavy portion, and then the holes Q11*a*, Q12*a* and the printing holes R11*a*, R12*a* are punched in the printing plate P2*a*. Thereafter, the plate P2*a* is subjected to the positioning on the drum 21 by the positioning pins 142 and 143. If the second positioning pin 142 is situated to be clear of the wavy portion, the plate P2*a* is fixed in an uninclined orientation on the drum 21, and then the recording heads 22 record an image on the plate P2*a*.

Such a difference in amount of inclination of the plate between the process of forming the printing holes and the process of recording the image causes different positional relationships between the recorded image and the printing holes depending on plates. This results in the lower overprinting accuracy provided when the same image is overprinted on a printing sheet by using these plates, to degrade the quality of the printed material.

In the image recorder 1 according to the present invention, the centering and the plate transport are performed so that a portion of the plate P2*a* which is to be brought into contact with the reference pin 126*a* makes contact with the positioning pin 142 on the drum 21. Therefore, the image recorder 1 prevents the aforementioned degradation of the quality of the printed material.

In the above description, the punch unit 23 disposed in the image recorder 1 is used to punch the positioning holes, the printing holes and the escape holes. However, a punch unit of the same type may be prepared as an individual plate punch apparatus outside the image recorder 1 and be used to punch virgin plates.

Additionally, the holes other than the positioning holes may be punched by an internal punch unit of the image recorder 1 or an external plate punch apparatus after the image is recorded on the plate.

While the invention has been described in detail, the foregoing description is in all aspects illustrative and not restrictive. It is understood that numerous other modifications and variations can be devised without departing from the scope of the invention.

What is claimed is:

1. An image recorder, comprising:

a guide member guiding an image recording material introduced;

a transport mechanism having an ascent surface above which said guide member is terminated, said transport mechanism being operable to receive said image recording material from said guide member and convey said image recording material along said ascent surface;

a tray having an ascent slope on which at least a leading part of said image recording material is received from said transport mechanism;

a reverse controller reversing a convey direction of said transport mechanism whereby a feeding direction of said image recording material is reversed;

a drum on which said image recording material is fed from said tray and said transport mechanism in response to reversal of said convey direction, said image recording material being wound on said drum; and an image recording device recording an image on said image recording material wound on said drum.

2. The image recorder according to claim 1, wherein said transport mechanism comprises a conveyer defining said ascent surface thereon, and a suction pad catching said image recording material and leading said image recording material along said ascent surface of said transport mechanism.

3. The image recorder according to claim 2, wherein said suction pad is operable to pull-down said image recording material onto said ascent surface of said transport mechanism.

4. The image recorder according to claim 3, further comprising:

an element for increasing inclination of said ascent surface of said transport mechanism when said convey direction of said transport mechanism is reversed.

5. A method of leading an image recording material onto a drum for image-recording, said method comprising the steps of: introducing said image recording material along a guide member; leading said image recording material onto an ascent surface of a transport mechanism; conveying said image recording material along said ascent surface toward and at least partially onto an ascent slope of a tray; reversing a feeding direction of said image recording material; and catching said image recording material on said drum.

6. The method in accordance with claim 5, wherein the step of leading said image recording material onto said ascent surface comprises the step of catching said image recording material with a suction pad and leading said image recording material onto said ascent surface.

7. The method in accordance with claim 6, wherein inclination of said ascent surface of a transport mechanism is increased in synchronism with reversal of said feeding direction of said image recording material.

* * * * *